US010507476B2

(12) United States Patent
Kim et al.

(10) Patent No.: US 10,507,476 B2
(45) Date of Patent: Dec. 17, 2019

(54) SPRINKLER WITH BRAKE ASSEMBLY

(71) Applicant: Rain Bird Corporation, Azusa, CA (US)

(72) Inventors: Eugene Ezekiel Kim, Orinda, CA (US); Radu Marian Sabau, Glendora, CA (US)

(73) Assignee: Rain Bird Corporation, Azusa, CA (US)

( * ) Notice: Subject to any disclaimer, the term of this patent is extended or adjusted under 35 U.S.C. 154(b) by 149 days.

(21) Appl. No.: 15/478,641

(22) Filed: Apr. 4, 2017

(65) Prior Publication Data

US 2017/0203311 A1 Jul. 20, 2017

Related U.S. Application Data

(63) Continuation of application No. 14/175,828, filed on Feb. 7, 2014, now Pat. No. 9,700,904.

(51) Int. Cl.
*B05B 3/00* (2006.01)
*B05B 3/06* (2006.01)
(Continued)

(52) U.S. Cl.
CPC ..... *B05B 3/005* (2013.01); *B05B 3/003* (2013.01); *B05B 3/0486* (2013.01); *B05B 3/063* (2013.01);
(Continued)

(58) Field of Classification Search
CPC ..... B05B 3/0486; B05B 3/1007; B05B 3/08; B05B 3/005; B05B 3/003; B05B 3/063
(Continued)

(56) References Cited

U.S. PATENT DOCUMENTS 1,239,229 A 9/1917 Shaw
1,407,335 A 2/1922 Reynolds
(Continued)

FOREIGN PATENT DOCUMENTS

AU 2006235876 A1 5/2007
AU 2012201884 A1 4/2012
(Continued)

OTHER PUBLICATIONS

Cross sectional view of Rain Bird Variable Arc Nozzle , Nozzle publicly available more than one year before Feb. 8, 2013, 1 page.
(Continued)

*Primary Examiner* — Steven J Ganey
(74) *Attorney, Agent, or Firm* — Fitch, Even, Tabin & Flannery, LLP

(57) ABSTRACT

In one aspect, a sprinkler is provided having a nozzle, a deflector that receives fluid flow from the nozzle, and a friction or viscous brake assembly that controls rotation of a deflector. The friction or viscous brake assembly is releasably connected to the frame in order to enhance serviceability of the sprinkler. In another aspect, a sprinkler is provided having a frame, a deflector rotatably connected to the frame, a nozzle, and a nozzle socket of the frame. The nozzle and nozzle socket have interlocking portions that releasably connect the nozzle to the frame. The nozzle may be easily removed for servicing. Further, the nozzle socket can be configured to receive a plurality of nozzles having different flow characteristics. A nozzle can be selected and utilized with the sprinkler according to the desired application for the sprinkler.

9 Claims, 72 Drawing Sheets

(51) Int. Cl.

| | |
|---|---|
| ***B05B 3/04*** | (2006.01) |
| ***B05B 3/08*** | (2006.01) |
| ***B05B 3/10*** | (2006.01) |
| ***B05B 15/65*** | (2018.01) |

(52) U.S. Cl.
CPC ..... *B05B 3/08* (2013.01); *B05B 3/1007* (2013.01); *B05B 15/65* (2018.02)

(58) Field of Classification Search
USPC .... 239/222.11, 222.13, 222.15, 222.17, 231, 239/232, 600
See application file for complete search history.

(56) References Cited

U.S. PATENT DOCUMENTS

| | | | |
|---|---|---|---|
| 1,435,140 | A | 11/1922 | Rolland |
| 1,779,983 | A | 10/1930 | Roach |
| 1,805,782 | A | 5/1931 | Munz |
| 1,932,427 | A | 10/1933 | Stone |
| 1,950,712 | A | 3/1934 | Coles |
| 2,064,066 | A | 12/1936 | Jepson |
| 2,086,515 | A | 7/1937 | Evans |
| 2,108,787 | A | 2/1938 | Coles |
| 2,177,100 | A | 10/1939 | Frame |
| 2,200,017 | A | 5/1940 | Anderson |
| 2,212,533 | A | 8/1940 | Zimmerman |
| 2,239,942 | A | 4/1941 | Stone |
| 2,273,401 | A | 2/1942 | Ferrando |
| 2,338,273 | A | 1/1944 | Wilkins |
| 2,423,762 | A | 7/1947 | Samuel |
| 2,488,234 | A | 11/1949 | Perry |
| 2,530,779 | A | 11/1950 | Owbridge |
| 2,604,163 | A | 7/1952 | Exline |
| 2,783,094 | A | 2/1957 | Storie |
| 2,819,115 | A | 1/1958 | Arnold |
| 3,009,648 | A | 11/1961 | Hait |
| 3,009,651 | A | 11/1961 | Wolf |
| 3,022,012 | A | 2/1962 | Sharp |
| 3,029,028 | A | 4/1962 | Skerritt |
| 3,070,192 | A | 12/1962 | Barkalow |
| 3,090,563 | A | 5/1963 | Cheeseboro |
| 3,107,752 | A | 10/1963 | Mclean |
| 3,195,817 | A | 7/1965 | Sandie |
| 3,292,863 | A | 12/1966 | Nelson |
| 3,387,785 | A | 6/1968 | Jaggers |
| 3,408,009 | A | 10/1968 | Eby |
| 3,408,055 | A | 10/1968 | Machiels |
| 3,448,928 | A | 6/1969 | Disbrow |
| 3,533,561 | A | 10/1970 | Henderson |
| 3,682,389 | A | 8/1972 | Chapin |
| 3,744,720 | A | 7/1973 | Meyer |
| 3,788,552 | A | 1/1974 | Roberts |
| 3,799,453 | A | 3/1974 | Hart |
| 3,814,326 | A | 6/1974 | Bartlett |
| 3,857,446 | A | 12/1974 | Kenny |
| 3,861,503 | A | 1/1975 | Nash |
| 3,913,170 | A | 10/1975 | Nakane |
| 3,918,645 | A | 11/1975 | Mohler |
| 3,933,210 | A | 1/1976 | Skidmore |
| 3,958,761 | A | 5/1976 | Watanabe |
| 3,994,441 | A | 11/1976 | Testa |
| 4,019,686 | A | 4/1977 | Palma |
| 4,083,410 | A | 4/1978 | Anderson |
| 4,091,996 | A | 5/1978 | Nelson |
| 4,154,402 | A | 5/1979 | Fletcher |
| 4,161,286 | A | 7/1979 | Beamer |
| 4,162,038 | A | 7/1979 | Ridgway |
| 4,168,033 | A | 9/1979 | von Bernuth |
| D253,364 | S | 11/1979 | McFadden |
| 4,182,494 | A | 1/1980 | Wichman |
| 4,193,548 | A | 3/1980 | Meyer |
| 4,198,001 | A | 4/1980 | Rodriguez |
| 4,228,956 | A | 10/1980 | Varner |
| 4,231,521 | A | 11/1980 | Hermine |
| 4,231,522 | A | 11/1980 | Drechsel |
| 4,235,379 | A | 11/1980 | Beamer |
| 4,256,262 | A | 3/1981 | Rosenberg |
| D259,438 | S | 6/1981 | Meyer |
| D259,733 | S | 6/1981 | Tisserat |
| 4,330,087 | A | 5/1982 | Wood |
| 4,364,519 | A | 12/1982 | Kreitzberg |
| D269,034 | S | 5/1983 | Wood |
| 4,405,018 | A | 9/1983 | Fischer |
| 4,434,937 | A | 3/1984 | Pitchford |
| 4,440,345 | A | 4/1984 | Figwer |
| 4,440,346 | A | 4/1984 | Wiley |
| 4,443,028 | A | 4/1984 | Hayes |
| 4,492,339 | A | 1/1985 | Kreitzberg |
| 4,498,626 | A | 2/1985 | Pitchford |
| 4,498,628 | A | 2/1985 | Tucker |
| 4,560,108 | A | 12/1985 | Rubinstein |
| 4,566,632 | A | 1/1986 | Sesser |
| D282,960 | S | 3/1986 | O'Neill et al. |
| 4,580,729 | A | 4/1986 | Pounder |
| 4,595,141 | A | 6/1986 | Cherundolo |
| D286,066 | S | 10/1986 | Goessling |
| 4,618,100 | A | 10/1986 | White |
| 4,625,715 | A | 12/1986 | Bucher |
| 4,625,915 | A | 12/1986 | Cockman |
| 4,660,766 | A | 4/1987 | Nelson |
| 4,689,432 | A | 8/1987 | Tsien |
| D291,725 | S | 9/1987 | Huckenbeck |
| 4,710,142 | A | 12/1987 | Lovell |
| 4,715,543 | A | 12/1987 | Rinkewich |
| D296,464 | S | 6/1988 | Marmol |
| 4,760,959 | A | 8/1988 | Gorney |
| 4,781,328 | A | 11/1988 | Robertson |
| 4,787,557 | A | 11/1988 | Jackson |
| 4,796,810 | A | 1/1989 | Zakai |
| 4,796,811 | A | 1/1989 | Davisson |
| 4,801,089 | A | 1/1989 | Zeman |
| 4,805,838 | A | 2/1989 | Greenberg |
| 4,815,662 | A | 3/1989 | Hunter |
| 4,819,872 | A | 4/1989 | Rosenberg |
| 4,846,406 | A | 7/1989 | Christy |
| 4,867,378 | A | 9/1989 | Kah |
| 4,869,431 | A | 9/1989 | Jubert |
| 4,869,432 | A | 9/1989 | Christy |
| 4,886,211 | A | 12/1989 | Cohen |
| D305,454 | S | 1/1990 | Beal |
| 4,905,903 | A | 3/1990 | Katzer |
| 4,909,441 | A | 3/1990 | Christy |
| D308,411 | S | 6/1990 | Allemann |
| 4,932,590 | A | 6/1990 | Hunter |
| 4,938,322 | A | 7/1990 | Sugasawara |
| 4,944,476 | A | 7/1990 | Olson |
| 4,953,788 | A | 9/1990 | Hansen |
| 4,955,539 | A | 9/1990 | Ruttenberg |
| 4,971,250 | A | 11/1990 | Hunter |
| 4,986,474 | A | 1/1991 | Schisler |
| 5,007,586 | A | 4/1991 | Cohen |
| 5,031,835 | A | 7/1991 | Rojas |
| 5,037,269 | A | 8/1991 | Halberg |
| 5,058,806 | A | 10/1991 | Rupar |
| 5,080,286 | A | 1/1992 | Morrison |
| RE33,823 | E | 2/1992 | Nelson |
| 5,086,977 | A | 2/1992 | Kah |
| 5,090,621 | A | 2/1992 | McMillen |
| 5,098,020 | A | 3/1992 | Cooper |
| 5,104,045 | A | 4/1992 | Kah |
| 5,109,929 | A | 5/1992 | Spears |
| 5,123,593 | A | 6/1992 | Rundle |
| 5,158,231 | A | 10/1992 | Christen |
| 5,191,811 | A | 3/1993 | Kogure |
| 5,199,646 | A | 4/1993 | Kah |
| 5,211,267 | A | 5/1993 | Clark |
| 5,213,016 | A | 5/1993 | Kah |
| 5,224,653 | A | 7/1993 | Nelson |
| 5,232,157 | A | 8/1993 | Laffrey |
| 5,288,022 | A | 2/1994 | Sesser |
| 5,297,737 | A | 3/1994 | Davisson |
| 5,307,993 | A | 5/1994 | Simonetti |
| 5,335,859 | A | 8/1994 | Thayer |

(56) References Cited

U.S. PATENT DOCUMENTS

| | | | |
|---|---|---|---|
| 5,353,989 | A | 10/1994 | Drechsel |
| 5,372,307 | A | 12/1994 | Sesser |
| 5,377,914 | A | 1/1995 | Christen |
| 5,383,600 | A | 1/1995 | Verbera |
| 5,409,168 | A | 4/1995 | Nelson |
| 5,415,348 | A | 5/1995 | Nelson |
| 5,439,176 | A | 8/1995 | Bussiere |
| RE35,037 | E | 9/1995 | Kah |
| 5,476,223 | A | 12/1995 | Drechsel |
| 5,544,814 | A | 8/1996 | Spenser |
| 5,622,316 | A | 4/1997 | Drechsel |
| 5,671,885 | A | 9/1997 | Davisson |
| 5,671,886 | A | 9/1997 | Sesser |
| 5,687,909 | A | 11/1997 | Dean |
| 5,730,365 | A | 3/1998 | Messinger |
| 5,760,373 | A | 6/1998 | Colling |
| 5,762,269 | A | 6/1998 | Sweet |
| 5,823,580 | A | 10/1998 | Ungerecht |
| 5,860,745 | A | 1/1999 | Squyres |
| 5,868,316 | A | 2/1999 | Scott |
| 5,909,848 | A | 6/1999 | Zink |
| 5,911,894 | A | 6/1999 | Colling |
| 5,947,387 | A | 9/1999 | Zink |
| 5,964,414 | A | 10/1999 | Hardy |
| 5,971,297 | A | 10/1999 | Sesser |
| 5,980,112 | A | 11/1999 | Matthews |
| 5,992,760 | A | 11/1999 | Kearby |
| 6,019,295 | A | 2/2000 | McKenzie |
| 6,074,119 | A | 6/2000 | Schlanger |
| 6,085,994 | A | 7/2000 | Zink |
| 6,095,432 | A | 8/2000 | Casagrande |
| 6,135,364 | A | 10/2000 | Nickish |
| 6,142,386 | A | 11/2000 | Spenser |
| 6,145,760 | A | 11/2000 | Harris |
| 6,193,169 | B1 | 2/2001 | Steinhilber |
| 6,209,802 | B1 | 4/2001 | Koivunen |
| 6,244,521 | B1 | 6/2001 | Sesser |
| 6,260,770 | B1 | 7/2001 | Epstein |
| 6,264,115 | B1 | 7/2001 | Liska |
| 6,322,110 | B1 | 11/2001 | Banker |
| 6,390,386 | B2 | 5/2002 | Krohn |
| 6,443,372 | B1 | 9/2002 | Hsu |
| 6,464,151 | B1 | 10/2002 | Cordua |
| D466,585 | S | 12/2002 | Alkalay |
| 6,488,218 | B1 | 12/2002 | Townsend |
| 6,494,384 | B1 | 12/2002 | Meyer |
| 6,499,672 | B1 | 12/2002 | Sesser |
| 6,530,532 | B1 | 3/2003 | Santiesteban |
| 6,557,787 | B2 | 5/2003 | Swan |
| 6,581,981 | B2 | 6/2003 | Cooper |
| D481,444 | S | 10/2003 | Guo |
| 6,651,905 | B2 | 11/2003 | Sesser |
| 6,688,539 | B2 | 2/2004 | Vander Griend |
| 6,736,332 | B2 | 5/2004 | Sesser |
| 6,755,287 | B2 | 6/2004 | Hadden |
| 6,802,458 | B2 | 10/2004 | Gregory |
| 6,814,304 | B2 | 11/2004 | Onofrio |
| 6,814,305 | B2 | 11/2004 | Townsend |
| 6,827,291 | B2 | 12/2004 | Townsend |
| 6,854,668 | B2 | 2/2005 | Wancho |
| D502,758 | S | 3/2005 | Gomez |
| 6,899,285 | B2 | 5/2005 | Goettl |
| 6,899,287 | B2 | 5/2005 | Pinch |
| 6,976,543 | B1 | 12/2005 | Fischer |
| D516,166 | S | 2/2006 | Gregory |
| D516,669 | S | 3/2006 | Antonucci |
| 7,025,287 | B2 | 4/2006 | Perkins |
| 7,032,836 | B2 | 4/2006 | Sesser |
| 7,086,608 | B2 | 8/2006 | Perkins |
| 7,097,117 | B2 | 8/2006 | Zur |
| 7,100,842 | B2 | 9/2006 | Meyer |
| 7,108,204 | B2 | 9/2006 | Johnson |
| 7,111,796 | B2 | 9/2006 | Olson |
| 7,143,957 | B2 | 12/2006 | Nelson |
| 7,159,795 | B2 | 1/2007 | Sesser |
| 7,168,634 | B2 | 1/2007 | Onofrio |
| 7,198,456 | B2 | 4/2007 | Kolle |
| 7,201,238 | B2 | 4/2007 | Marvin |
| 7,232,078 | B2 | 6/2007 | Kah |
| 7,240,860 | B2 | 7/2007 | Griend |
| 7,287,710 | B1 | 10/2007 | Nelson |
| 7,299,999 | B2 | 11/2007 | Walker |
| 7,303,148 | B2 | 12/2007 | Campbell |
| 7,303,153 | B2 | 12/2007 | Han |
| 7,325,753 | B2 | 2/2008 | Gregory |
| RE40,440 | E | 7/2008 | Sesser |
| 7,395,977 | B2 | 7/2008 | Pinch |
| 7,458,527 | B2 | 12/2008 | Lutzki |
| 7,472,840 | B2 | 1/2009 | Gregory |
| 7,487,924 | B2 | 2/2009 | Johnson |
| 7,562,833 | B2 | 7/2009 | Perkins |
| 7,581,687 | B2 | 9/2009 | Feith |
| 7,584,904 | B2 | 9/2009 | Townsend |
| 7,584,906 | B2 | 9/2009 | Lev |
| 7,611,077 | B2 | 11/2009 | Sesser |
| 7,624,935 | B2 | 12/2009 | Nelson |
| 7,635,096 | B2 | 12/2009 | Wright |
| 7,677,474 | B2 | 3/2010 | Markley |
| 7,703,706 | B2 | 4/2010 | Walker |
| 7,717,361 | B2 | 5/2010 | Nelson |
| 7,766,259 | B2 | 8/2010 | Feith |
| 7,770,821 | B2 | 8/2010 | Pinch |
| 7,780,093 | B2 | 8/2010 | Johnson |
| 7,789,323 | B2 | 9/2010 | Nelson |
| 7,798,431 | B2 | 9/2010 | Eader |
| 7,832,659 | B1 | 11/2010 | Collins |
| 7,954,731 | B2 | 6/2011 | Antonucci |
| 7,980,488 | B2 | 7/2011 | Townsend |
| RE42,596 | E | 8/2011 | Sesser |
| 8,006,919 | B2 | 8/2011 | Renquist |
| 8,016,210 | B2 | 9/2011 | Wright |
| 8,074,897 | B2 | 12/2011 | Hunnicutt |
| 8,104,963 | B2 | 1/2012 | Hibi |
| 8,177,148 | B1 | 5/2012 | Renquist |
| 8,220,724 | B2 | 7/2012 | Wright |
| 8,272,583 | B2 | 9/2012 | Hunnicutt |
| 8,282,022 | B2 | 10/2012 | Porter |
| 8,328,112 | B2 | 12/2012 | Johnson |
| 8,336,788 | B2 | 12/2012 | Perkins |
| 8,366,321 | B2 | 2/2013 | Yazawa |
| 8,366,322 | B2 | 2/2013 | Hibi |
| 8,371,392 | B2 | 2/2013 | Ba-Abbad |
| 8,434,695 | B2 | 5/2013 | Barzuza |
| 8,434,696 | B2 | 5/2013 | Wright |
| 8,480,013 | B2 | 7/2013 | Causby |
| 8,511,586 | B2 | 8/2013 | Einav |
| 8,540,171 | B2 | 9/2013 | Renquist |
| 8,544,768 | B2 | 10/2013 | Wright |
| 8,567,691 | B2 | 10/2013 | Townsend |
| 8,567,696 | B2 | 10/2013 | Walker |
| 8,567,699 | B2 | 10/2013 | Sesser |
| 8,579,210 | B2 | 11/2013 | Huang |
| 8,590,808 | B2 | 11/2013 | Roach |
| 8,640,978 | B2 | 2/2014 | Gregory |
| 8,646,734 | B2 | 2/2014 | Vered Shaol |
| 8,651,400 | B2 | 2/2014 | Walker |
| 8,668,153 | B2 | 3/2014 | Johnson |
| 8,668,155 | B2 | 3/2014 | Wright |
| 8,672,236 | B2 | 3/2014 | Gal |
| 8,672,242 | B2 | 3/2014 | Hunnicutt |
| 8,684,322 | B2 | 4/2014 | Park |
| 8,695,900 | B2 | 4/2014 | Hunnicutt |
| 8,727,238 | B1 | 5/2014 | Clark |
| 8,746,590 | B1 | 6/2014 | Collins |
| 8,783,582 | B2 | 7/2014 | Robertson |
| 8,789,768 | B2 | 7/2014 | Hunnicutt |
| 8,888,023 | B2 | 11/2014 | Barton |
| RE45,263 | E | 12/2014 | Sesser |
| 8,899,497 | B2 | 12/2014 | Gorny |
| 8,925,837 | B2 | 1/2015 | Walker |
| 8,931,571 | B2 | 1/2015 | Sarkisyan |
| 8,991,724 | B2 | 3/2015 | Sesser |
| 8,991,726 | B2 | 3/2015 | Kah |
| 8,991,730 | B2 | 3/2015 | Kah |

(56) References Cited

U.S. PATENT DOCUMENTS

| | | | |
|---|---|---|---|
| 8,998,109 | B2 | 4/2015 | Katzman |
| 9,022,300 | B2 | 5/2015 | Nies |
| 9,056,214 | B2 | 6/2015 | Barmoav |
| 9,079,202 | B2 | 7/2015 | Walker |
| 9,089,857 | B2 | 7/2015 | Sesser |
| 9,095,859 | B2 | 8/2015 | Sesser |
| 9,138,768 | B2 | 9/2015 | Jahan |
| 9,174,227 | B2 | 11/2015 | Robertson |
| 9,248,459 | B2 | 2/2016 | Kah |
| 9,291,276 | B2 | 3/2016 | Keren |
| 9,295,998 | B2 | 3/2016 | Shadbolt |
| 9,314,952 | B2 | 4/2016 | Walker |
| 9,327,297 | B2 | 5/2016 | Walker |
| 9,387,496 | B2 | 7/2016 | Kah |
| 9,403,175 | B2 | 8/2016 | Boyles |
| 9,403,176 | B2 | 8/2016 | Townsend |
| 9,403,177 | B2 | 8/2016 | Sesser |
| 9,427,751 | B2 | 8/2016 | Kim |
| 9,433,950 | B2 | 9/2016 | Chamorro Canet |
| 9,440,250 | B2 | 9/2016 | Walker |
| 9,492,832 | B2 | 11/2016 | Kim |
| 9,504,209 | B2 | 11/2016 | Kim |
| 9,511,383 | B2 | 12/2016 | Drechsel |
| 9,511,387 | B2 | 12/2016 | Keren |
| 9,534,619 | B2 | 1/2017 | Sesser |
| 9,592,518 | B2 | 3/2017 | Drechsel |
| 9,700,904 | B2 | 7/2017 | Kim |
| 10,201,818 | B2 | 2/2019 | Duffin |
| 10,213,802 | B2 | 2/2019 | Kah, Jr. |
| 10,232,388 | B2 | 3/2019 | Glezerman |
| 10,232,389 | B1 | 3/2019 | Forrest |
| 10,239,067 | B2 | 3/2019 | Glezerman |
| 10,322,422 | B2 | 6/2019 | Simmons |
| 10,322,423 | B2 | 6/2019 | Walker |
| 10,350,619 | B2 | 7/2019 | Kim |
| 2002/0139868 | A1 | 10/2002 | Sesser |
| 2002/0162901 | A1 | 11/2002 | Hunter |
| 2002/0166900 | A1 | 11/2002 | Sesser |
| 2004/0046047 | A1 | 3/2004 | Townsend |
| 2004/0046055 | A1 | 3/2004 | Townsend |
| 2004/0050955 | A1 | 3/2004 | Sesser |
| 2004/0108391 | A1 | 6/2004 | Onofrio |
| 2004/0124266 | A1 | 7/2004 | Pinch |
| 2004/0164178 | A1 | 8/2004 | Kah |
| 2004/0164179 | A1 | 8/2004 | Corbett |
| 2004/0195362 | A1 | 10/2004 | Walker |
| 2004/0227007 | A1 | 11/2004 | Sesser |
| 2004/0262426 | A1 | 12/2004 | Antonucci et al. |
| 2005/0035211 | A1 | 2/2005 | Perkins |
| 2005/0145394 | A1 | 7/2005 | Wancho |
| 2006/0000932 | A1 | 1/2006 | Gregory |
| 2006/0006253 | A1 | 1/2006 | Nelson |
| 2006/0006254 | A1 | 1/2006 | Meyer |
| 2006/0038036 | A1 | 2/2006 | Perkins |
| 2006/0054716 | A1 | 3/2006 | Lutzki |
| 2006/0065759 | A1 | 3/2006 | Olson |
| 2006/0108445 | A1 | 5/2006 | Pinch |
| 2006/0150899 | A1 | 7/2006 | Han |
| 2006/0273192 | A1 | 12/2006 | Markley |
| 2007/0029404 | A1 | 2/2007 | Markley |
| 2007/0040045 | A1 | 2/2007 | Cohen |
| 2007/0095936 | A1 | 5/2007 | Ungerecht |
| 2007/0181711 | A1 | 8/2007 | Sesser |
| 2007/0246560 | A1 | 10/2007 | Townsend |
| 2008/0054093 | A1 | 3/2008 | Nelson |
| 2008/0054094 | A1 | 3/2008 | Nelson |
| 2008/0257982 | A1 | 10/2008 | Kah |
| 2008/0277489 | A1 | 11/2008 | Townsend |
| 2008/0277498 | A1 | 11/2008 | Townsend |
| 2009/0008484 | A1 | 1/2009 | Feith |
| 2009/0078788 | A1 | 3/2009 | Holmes |
| 2009/0159382 | A1 | 6/2009 | Chemouni |
| 2009/0173803 | A1 | 7/2009 | Kah |
| 2009/0188988 | A1 | 7/2009 | Walker |
| 2009/0188991 | A1 | 7/2009 | Russell |
| 2009/0283615 | A1 | 11/2009 | Walker |
| 2009/0314859 | A1 | 12/2009 | Causby |
| 2009/0321537 | A1 | 12/2009 | Nelson |
| 2010/0006669 | A1 | 1/2010 | Thompson |
| 2010/0294851 | A1 | 11/2010 | Johnson |
| 2011/0024522 | A1 | 2/2011 | Anuskiewicz |
| 2011/0024523 | A1 | 2/2011 | Sesser |
| 2011/0024526 | A1 | 2/2011 | Feith |
| 2011/0024809 | A1 | 2/2011 | Janesick |
| 2011/0031332 | A1 | 2/2011 | Sesser |
| 2011/0114755 | A1 | 5/2011 | Katzman |
| 2011/0147488 | A1 | 6/2011 | Walker |
| 2011/0198411 | A1 | 8/2011 | Antonucci |
| 2011/0248093 | A1 | 10/2011 | Kim |
| 2012/0153051 | A1 | 6/2012 | Kah |
| 2012/0205467 | A1 | 8/2012 | Renquist |
| 2012/0273592 | A1 | 11/2012 | Zhang |
| 2012/0318888 | A1 | 12/2012 | Gandin |
| 2013/0043327 | A1 | 2/2013 | Barmoav |
| 2013/0082119 | A1 | 4/2013 | Sesser |
| 2013/0105596 | A1 | 5/2013 | Kah |
| 2013/0126635 | A1 | 5/2013 | Klinefelter |
| 2013/0140379 | A1 | 6/2013 | Boyles |
| 2013/0199372 | A1 | 8/2013 | Nock |
| 2013/0228636 | A1 | 9/2013 | Sanders |
| 2013/0327846 | A1 | 12/2013 | Sesser |
| 2013/0334340 | A1 | 12/2013 | Walker |
| 2014/0008459 | A1 | 1/2014 | Wright |
| 2014/0027526 | A1 | 1/2014 | Shadbolt |
| 2014/0027527 | A1 | 1/2014 | Walker |
| 2014/0110501 | A1 | 4/2014 | Lawyer |
| 2014/0224900 | A1 | 8/2014 | Kim |
| 2014/0246513 | A1 | 9/2014 | Terrell |
| 2014/0263732 | A1 | 9/2014 | Heren |
| 2014/0263757 | A1 | 9/2014 | Walker |
| 2014/0312143 | A1 | 10/2014 | Duffin |
| 2014/0339334 | A1 | 11/2014 | Kah |
| 2014/0353402 | A1 | 12/2014 | Kah |
| 2015/0028128 | A1 | 1/2015 | Kah |
| 2015/0102126 | A1 | 4/2015 | Russell |
| 2015/0144716 | A1 | 5/2015 | Barmoav |
| 2015/0165455 | A1 | 6/2015 | Kah |
| 2015/0273492 | A1 | 10/2015 | Barmoav |
| 2015/0321207 | A1 | 11/2015 | Kah |
| 2016/0375457 | A1 | 12/2016 | Sesser |
| 2017/0056899 | A1 | 3/2017 | Kim |
| 2018/0221895 | A1 | 8/2018 | McCarty |
| 2018/0280994 | A1 | 10/2018 | Walker |
| 2018/0311684 | A1 | 11/2018 | Lawyer |
| 2019/0015849 | A1 | 1/2019 | Geerligs |
| 2019/0054480 | A1 | 2/2019 | Sesser |
| 2019/0054481 | A1 | 2/2019 | Sesser |
| 2019/0118195 | A1 | 4/2019 | Geerligs |
| 2019/0133059 | A1 | 5/2019 | DeWitt |
| 2019/0143361 | A1 | 5/2019 | Kah, Jr. |
| 2019/0193095 | A1 | 6/2019 | Sesser |

FOREIGN PATENT DOCUMENTS

| | | | |
|---|---|---|---|
| AU | 2012100324 | A4 | 5/2012 |
| CN | 87102965 | A | 12/1987 |
| CN | 102366733 | A | 3/2012 |
| CN | 102366734 | A | 3/2012 |
| CN | 102466061 | A | 5/2012 |
| DE | 2906023 | A1 | 9/1979 |
| WO | 2005120717 | A2 | 12/2005 |
| WO | 2010010535 | A1 | 1/2010 |

OTHER PUBLICATIONS

European Patent Office, Extended European Search Report for European Application No. 14749231.8 dated Feb. 13, 2017, 8 pages.

International Search Report and Written Opinion dated Jun. 10, 2014, from related International (PCT) Patent Application No. PCT/US2014/015391, 7 pages.

NaanDanJain Irrigation, Magic Drive La brochure, copyright date Sep. 2014, 1 page.

(56) References Cited

OTHER PUBLICATIONS

NaanDanJain Irrigation, Mamkad 16 brochure, copyright date Mar. 2013, 1 page.
NaanDanJain Irrigation, Opal Brochure, copyright date Mar. 2013, 1 page.
NaanDanJain Irrigation, Super 10 LA brochure, copyright date Mar. 2013, 1 page.
Nelson Irrigation Corporation, R10 & R10 Turbo brochure, dated Jun. 21, 2011, accessed from www.nelsonirrigation.com/resources/ on Jan. 11, 2017, 8 pages.
Nelson Irrigation Corporation, R2000 brochure, dated Jun. 20, 2011, accessed from www.nelsonirrigation.com/resources/ on Jan. 11, 2017, 8 pages.
Nelson Irrigation Corporation, R33 & R33LP brochure, dated Jun. 20, 2011, accessed from www.nelsonirrigation.com/resources on Jan. 11, 2017, 4 pages.
Pictures of NaanDanJain MagicDrive LA. Publicly available Feb. 2015, 5 pages.
Pictures of Nelson R10 Sprinklers. Publicly available more than one year before Feb. 8, 2013, 7 pages.
Pictures of Nelson R10 Turbo Sprinklers. Publicly available more than one year before Feb. 8, 2013, 7 pages.
Pictures of Nelson Rotator Sprinkler, publicly available more than one year before Feb. 8, 2013, 6 pages.
Pictures of Rain Bird 5000 Plus Sprinkler and Nozzle, publicly available more than one year before Feb. 8, 2013, 3 pages.
Pictures of Rain Bird Impact Sprinkler, publicly available more than one year before Feb. 8, 2013, 5 pages.
State Intellectual Property Office of the People's Republic of China, Notification of the First Office Action dated Nov. 30, 2016 for Chinese Patent Application No. 201480013801.X, 9 pages, Informal English Translation 10 pages.
Toro Australia Pty. Ltd., Toro Irrigation: Waterbird, from www.toro.com.au, accessed prior to Feb. 8, 2013, 3 pages.
U.S. Appl. No. 13/763,487; Office Action dated Sep. 13, 2016, 22 pages.
U.S. Appl. No. 13/763,487; Office Action dated Nov. 20, 2014, 17 pages.
U.S. Appl. No. 13/763,487; Office Action dated Dec. 31, 2015, 15 pages.
U.S. Appl. No. 13/763,487; Office Action dated May 1, 2017, 23 pages.
U.S. Appl. No. 13/829,142; Notice of Allowance dated Jul. 18, 2016, 5 pages.
U.S. Appl. No. 13/829,142; Office Action dated Nov. 17, 2014, 6 pages.
U.S. Appl. No. 14/175,828; Notice of Allowance dated Jan. 23, 2017, 8 pages.
U.S. Appl. No. 14/175,828; Notice of Allowance dated Feb. 27, 2017, 7 pages.
U.S. Appl. No. 14/175,828; Office Action dated Apr. 20, 2016, 6 pages.
U.S. Appl. No. 14/175,828; Notice of Allowance dated Oct. 12, 2016, 7 pages.
U.S. Appl. No. 13/763,487; Office Action dated Jun. 29, 2018 (pp. 1-20).
U.S. Appl. No. 15/350,601; Office Action dated Dec. 3, 2018 (pp. 1-13).
Office Action dated Nov. 7, 2017 for U.S. Appl. No. 13/763,487, 28 pages.
Office Action dated Mar. 29, 2018 for U.S. Appl. No. 15/350,601, 14 pages.
U.S. Appl. No. 13/763,487; Notice of Allowance dated Feb. 25, 2019 (pp. 1-8).
Rain Bird Corporation, Pictures of Rain Bird® LF Series Sprinkler, publicly available more than one year before Feb. 8, 2013 (12 pages).
USPTO; U.S. Appl. No. 15/350,601; Office Action dated Jun. 25, 2019; (pp. 1-14).

SECTION A-A

SECTION B-B

SECTION C-C

1023

SPRINKLER WITH BRAKE ASSEMBLY

CROSS-REFERENCE TO RELATED APPLICATION

This application is a continuation of prior application Ser. No. 14/175,828, filed Feb. 7, 2014, which is hereby incorporated herein by reference in its entirety.

FIELD

This invention relates to irrigation sprinklers and, more particularly, to rotary sprinklers.

BACKGROUND

There are many different types of sprinkler constructions used for irrigation purposes, including impact or impulse drive sprinklers, motor driven sprinklers, and rotating reaction drive sprinklers. Included in the category of rotating reaction drive sprinklers are a species of sprinklers known as spinner or a rotary sprinklers which are often used in the irrigation of agricultural crops and orchards. Typically, such spinner type sprinklers comprise a stationary support structure or frame which is adapted to be coupled with a supply of pressurized water, and a rotatable deflector supported by the frame for rotation about a generally vertical axis. Most rotary type sprinklers employ either a rotating reaction drive nozzle or a fixed nozzle which ejects a stream of water vertically onto a rotating deflector. The deflector redirects the stream into a generally horizontal spray and the deflector is rotated by a reaction force created by the impinging stream from the fixed nozzle.

One shortcoming that has been encountered with rotary-type sprinklers is that due to a very high rate of rotation of the rotary devices, the distance the water is thrown from the sprinkler may be substantially reduced. This has created a need to control or regulate the rotational speed of the deflector and thereby also regulate the speed at which the water streams are swept over the surrounding terrain area. A relatively slow deflector rotational speed is desired to maximize throw-distance, and therefore a variety of brake devices have been developed to accomplish this end.

In one approach, a viscous brake device is used to control rotation of the deflector. The viscous brake device utilizes drag produced by rotation of a brake rotor within a viscous fluid. While suitable for some sprinklers, the viscous brake device may not provide constant rotation speed when the ambient temperature or supply pressure changes.

Another shortcoming encountered with rotary-type sprinklers is that the sprinklers have frame supports that interfere with the water stream after it has been redirected by the deflector. There have been a number of attempts to minimize this interference including utilizing supports with different cross-sectional shapes. However, even with these approaches, the water stream still impacts the supports every time the deflector completes a rotation. This produces a reduced, but still present, shadow in the spray pattern of the sprinkler.

Yet another shortcoming of some prior rotary-type sprinklers is the serviceability of the sprinkler. Rotary-type sprinklers often have two typical types of failures that require the sprinkler to be removed from the water supply in order to be fixed. The first type of failure occurs when the nozzle becomes plugged with debris from the water supply. For some sprinklers, the nozzle is installed from the underside of the sprinkler such that the sprinkler needs to be removed from the water supply in order to remove and clean the nozzle. The second type of failure occurs when the deflector of the sprinkler stops rotating or spins out of control. In this case, the braking system has failed and the entire sprinkler will be replaced.

Some prior sprinklers utilize viscous braking to control the rotational speed of the deflectors of the sprinklers. One problem with this approach is that the viscosity of the working fluid changes inversely with temperature. As a result, the deflector rotates faster as temperature increases, and slower as the temperature decreases. This change in rotational speed may negatively affect the area that is covered by the sprinkler, or it may cause the deflector to stall during low temperature conditions when coupled with low pressure operation.

DETAILED DESCRIPTION OF THE PREFERRED EMBODIMENTS

Figure 1:
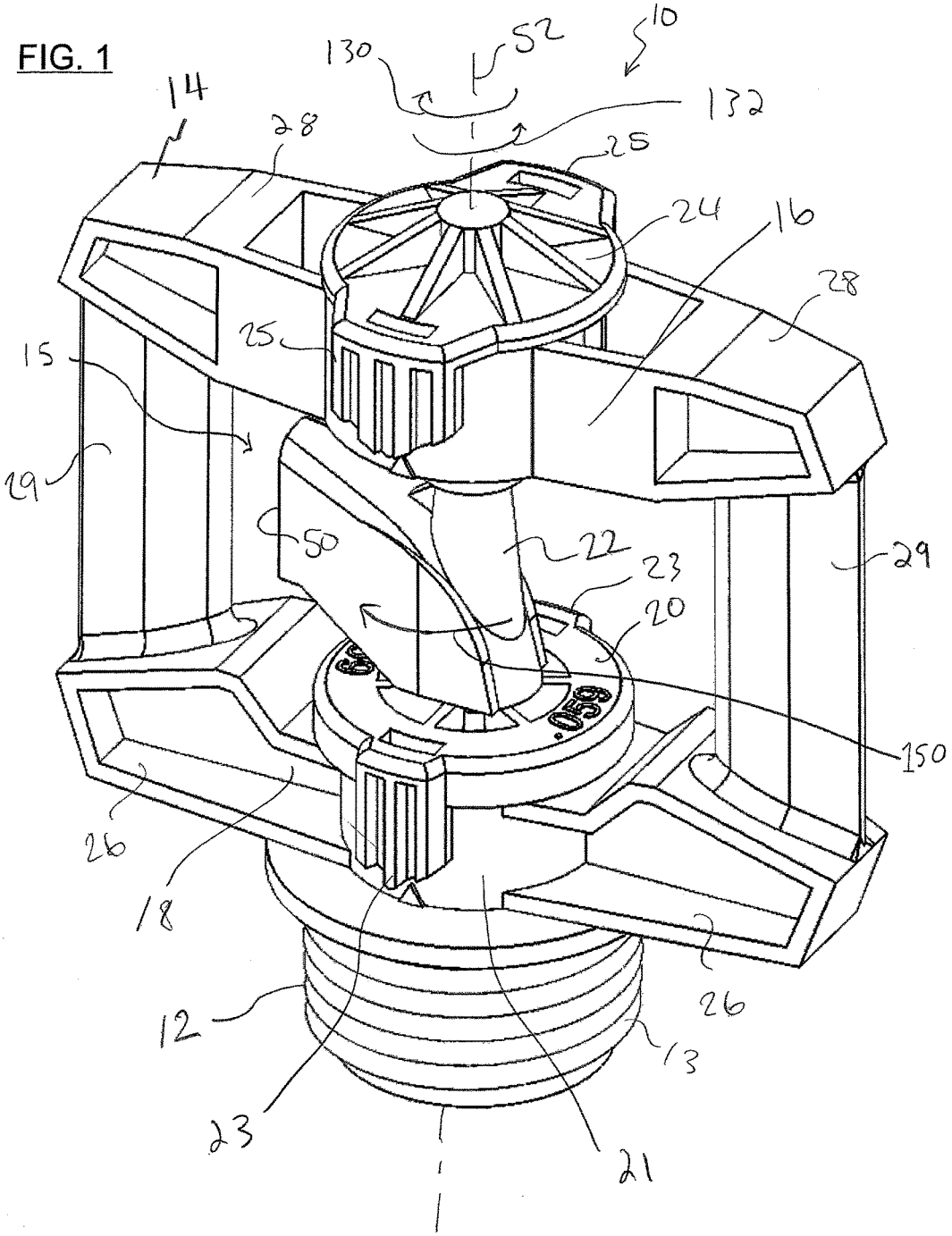
FIG. 1 is a perspective view of a rotary sprinkler.

With reference to FIGS. 1-5, an improved rotary sprinkler 10 is provided having a fitting 12 for connecting to a standpipe or other fluid supply conduit, such as by using threads 13. The sprinkler 10 has a frame 14 with an upper portion 16 and a lower portion 18 connected to the fitting 12. A spinner assembly 15 is connected to the frame upper portion 16 and a nozzle 20 is removably connected to a socket 21 defined by the frame lower portion 18. In one approach, the nozzle 20 is secured to the frame 14 by a pair of releasable connections 23 and can be replaced with another nozzle 20 having flow characteristics desired for a particular application. Fluid travels through the fitting 12, into the nozzle 20, and is discharged from the nozzle 20 as a jet. The spinner assembly 15 includes a deflector 22 disposed above the nozzle 20 which receives the jet of fluid from the nozzle 20. The spinner assembly 15 further includes a brake device 24 removably coupled to the frame upper portion 16 and configured to limit the rate of rotation of the deflector 22. The brake device 24 is secured to the frame 14 with a pair of releasable connections 25. It should be noted that although the sprinkler 10 is illustrated as being disposed in an upright position, the sprinkler can also be mounted in, for example, an inverted position.

Figure 5:
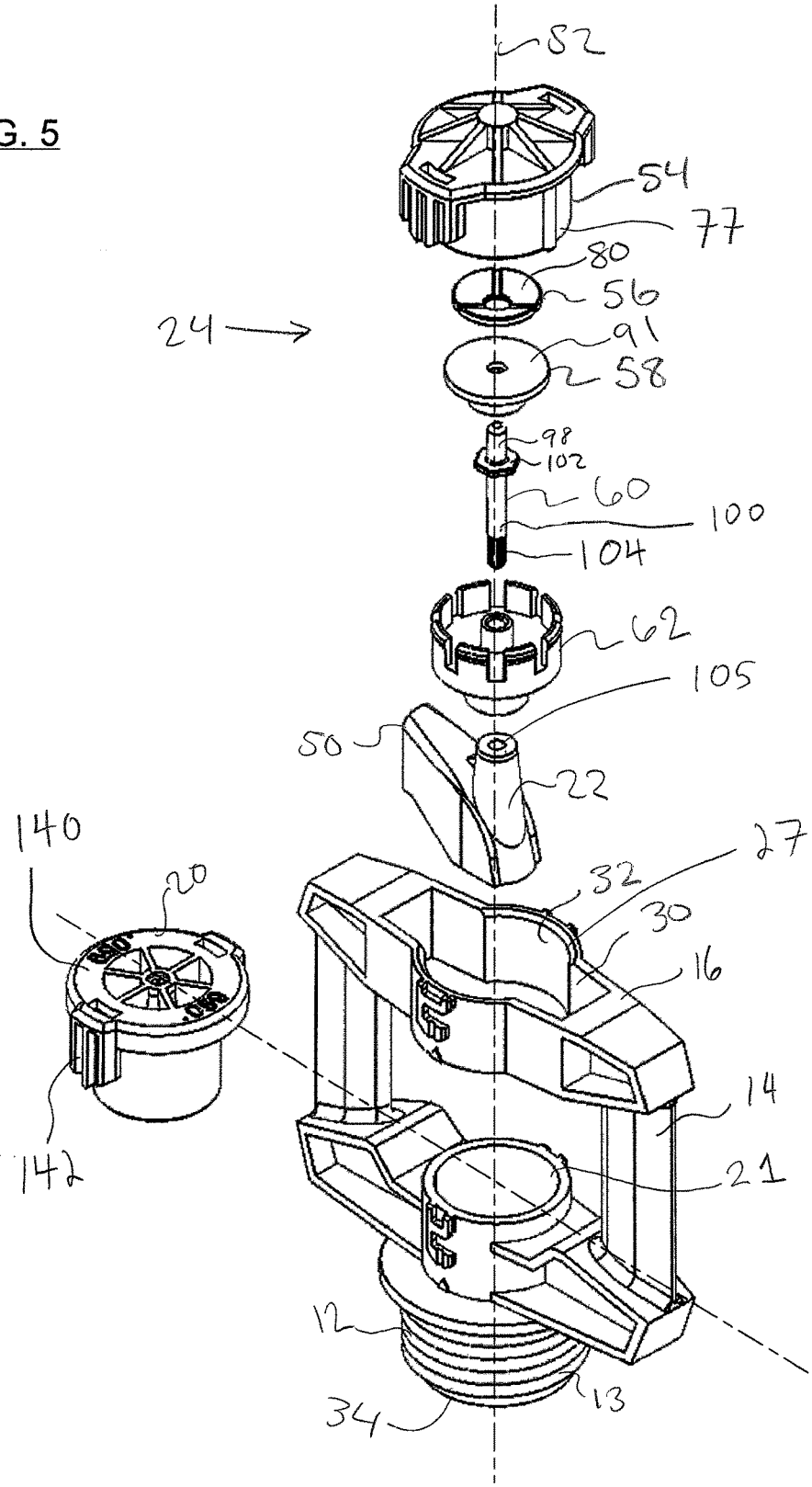
FIG. 5 is an exploded perspective view of the rotary sprinkler of FIG. 1.

The frame 14 comprises a pair of horizontal lower support members 26 extending radially from opposite sides of the nozzle socket 21. A pair of upper support members 28 are attached in a similar manner to the upper portion 16 as those attached to the lower portion 18. The support members 26 outwardly terminate at arms or supports 29 of the frame 14. The upper portion 16 has a yoke 27 with opening 30 defined by a wall 32 of the yoke 27, as shown in FIG. 5. The brake device 24 is disposed within the opening 30 and is supported by the support members 28. Preferably, the upper and lower portions 16 and 18, members 26 and 28, and supports 29 forming the frame 14 are formed as a single unit, such as by molding the frame 14 from a suitable plastic material. Although the frame 14 is illustrated with two supports 29, the frame 14 may alternatively have one, three, four, or more supports 29 as desired.

Figure 6:
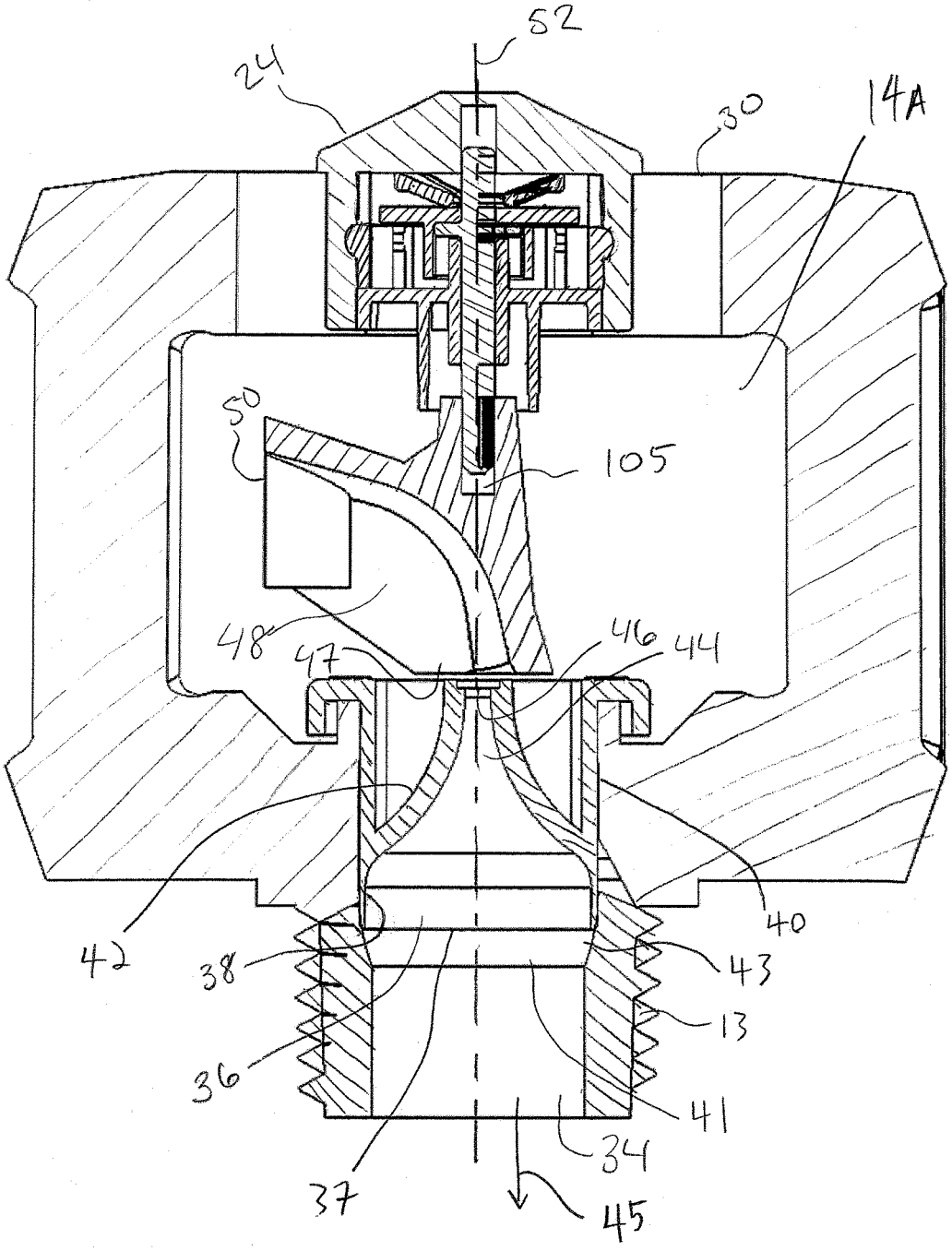
FIG. 6 is a cross-sectional view taken along line 6-6 in FIG. 3.

Referring to FIGS. 5 and 6, the fitting 12 defines an inlet 34 through which fluid flows into the sprinkler 10. The inlet 34 leads to an opening 36 of the nozzle 20 defined by a nozzle inner wall 38. The nozzle inner wall 38 has a tapered configuration that decreases in thickness until reaching an upstream lip 37 of the nozzle 20. The fitting 12 includes a cup portion 41 with a tapered surface 43 that is inclined relative to the longitudinal axis 52 of the sprinkler 10. During assembly, the upstream lip 37 of the nozzle 20 is advanced in direction 45 into nozzle socket 21 until the upstream lip 37 engages the tapered surface 43 (see FIGS. 5 and 6). This engagement causes the fitting tapered surface 43 to slightly compress the upstream lip 37, which provides a positive leak-proof seal between the nozzle 20 and the fitting 12.

The nozzle 20 has a nozzle body 40 that houses a nozzle portion 42, defining a fluid passageway 44 through the nozzle portion 42, and terminating at a nozzle exit 46. The nozzle portion 42 increases the speed of the fluid as it travels through the passageway 44. The fluid leaves the nozzle 20 through the exit 46 as a jet and travels into an inlet opening 47 of the deflector 22 and along a channel 48 of the deflector 22, before exiting the deflector 22 through a deflector outlet opening 50. The exiting fluid causes the deflector 22 to rotate about a longitudinal axis 52 of the sprinkler 10 and disperses the fluid outward from the sprinkler 10, as discussed in greater detail below.

Referring to FIGS. 5-15, the brake device 24 connects the deflector 22 to the frame 14 and permits rotational and vertical movement of the deflector 22 within an opening 14*a* of the frame 14. The brake device 24 utilizes friction between surfaces to restrict and control the rate of rotation of the deflector 22. More specifically, the brake device 24 is formed as a self-contained module which is releasably and removably attached to the frame 14 so that the brake device 24 can be easily replaced. The brake device 24 is top serviceable and can be removed from above the sprinkler 10 while the frame 14 and lower end fitting 12 remain connected to the fluid supply. This simplifies maintenance of the sprinkler 10 and permits the brake device 24 to be easily removed from the frame 14, such as if the brake device 24 locks up and prevents rotation of the deflector 22 or if the brake device fails and permits the deflector 22 to spin out of control. Another advantage provided by the brake device 24 is that the deflector 22 can be easily replaced or serviced by removing the brake device 24 from the frame 14. Further, the removable brake device 24 provides access to the nozzle 20 for removal and maintenance, such as cleaning the nozzle 20.

Figure 3:
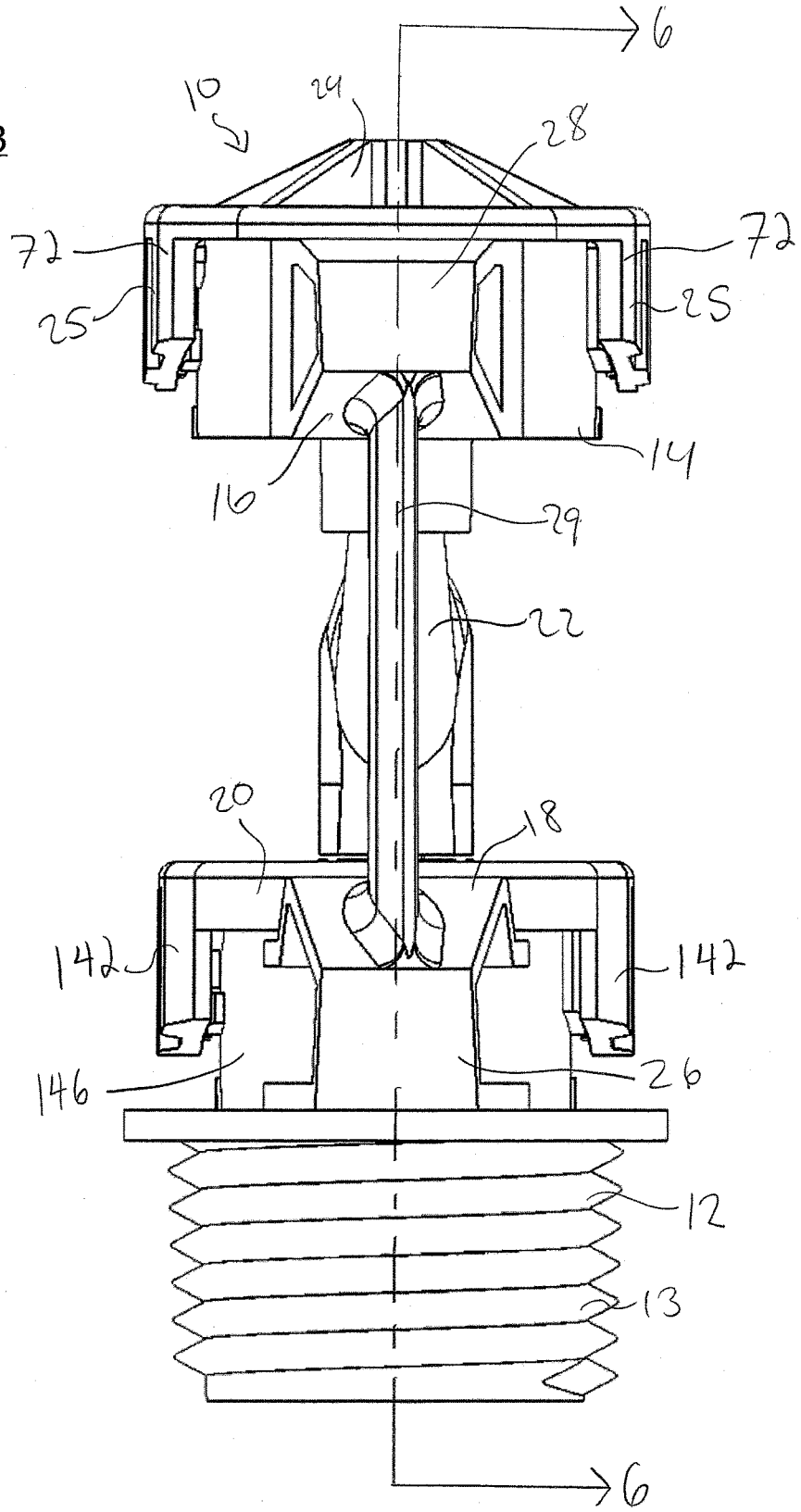
FIG. 3 is a side elevational view of the rotary sprinkler of FIG. 1.
Figure 4:
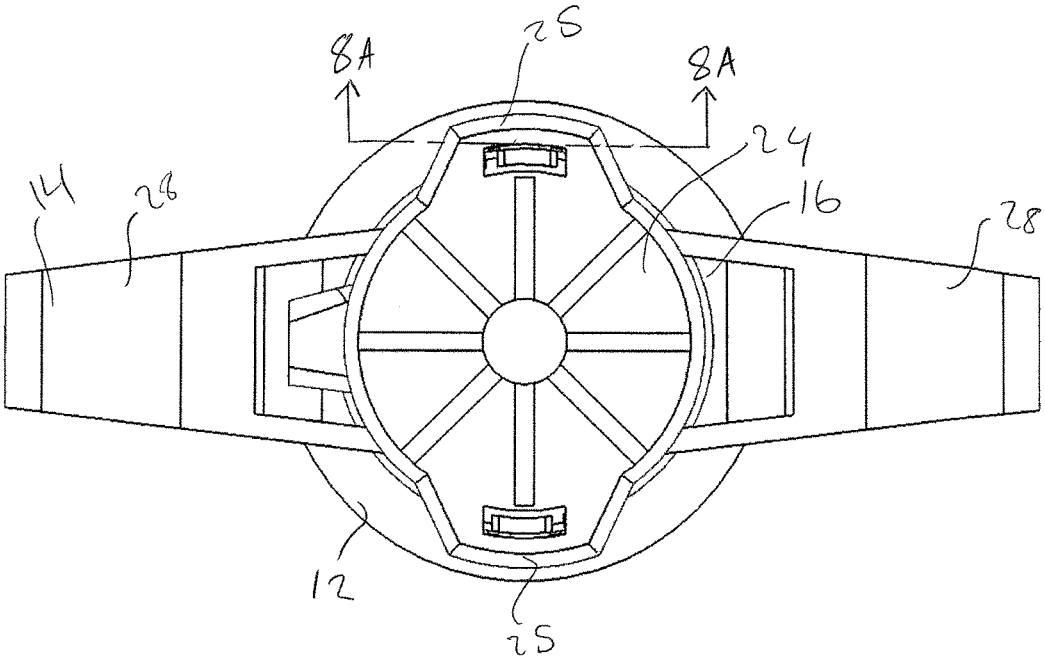
FIG. 4 is a top plan view of the rotary sprinkler of FIG. 1.
Figure 7:
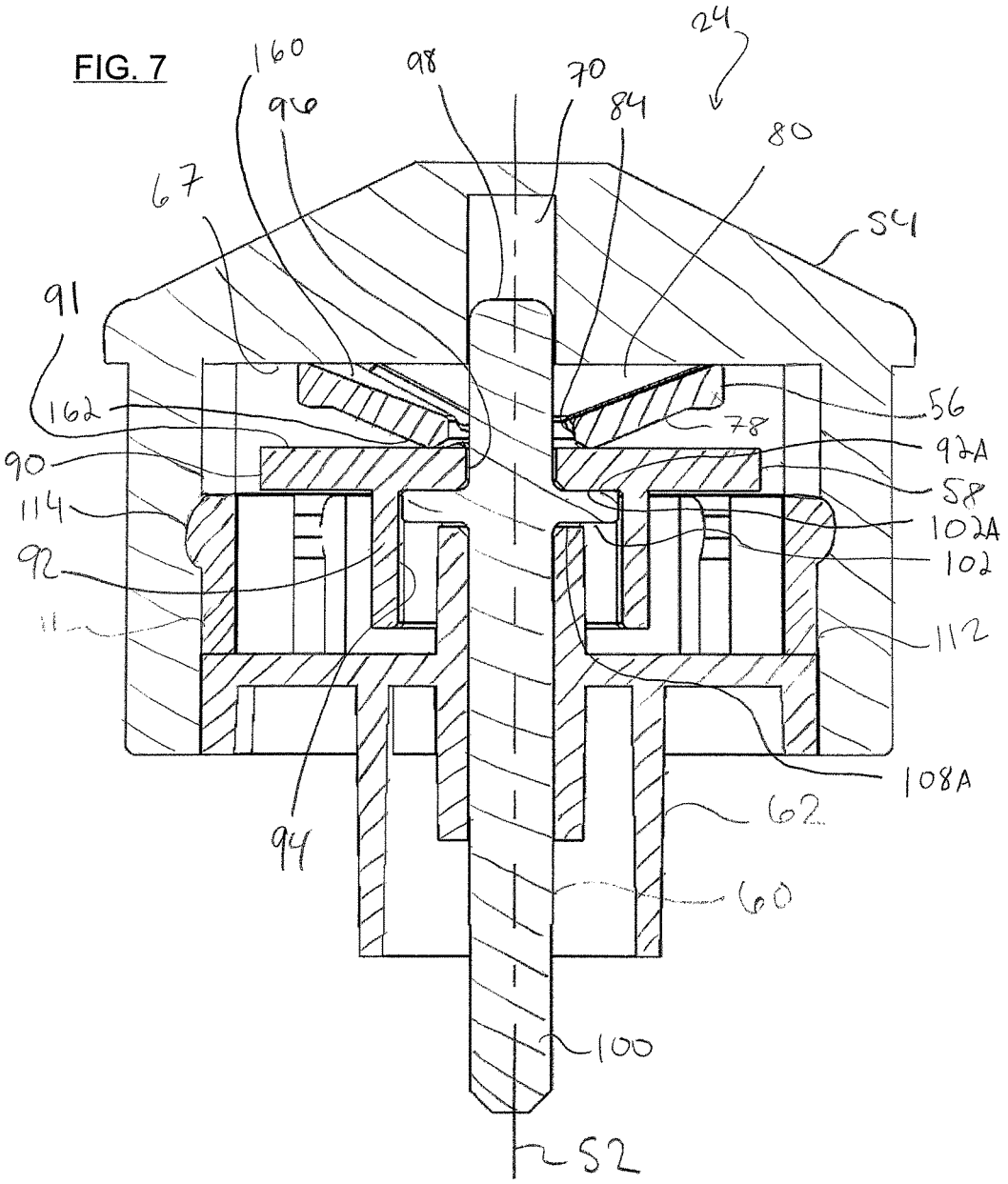
FIG. 7 is a partial enlarged view of FIG. 6 showing a brake device of the sprinkler.
Figure 8:
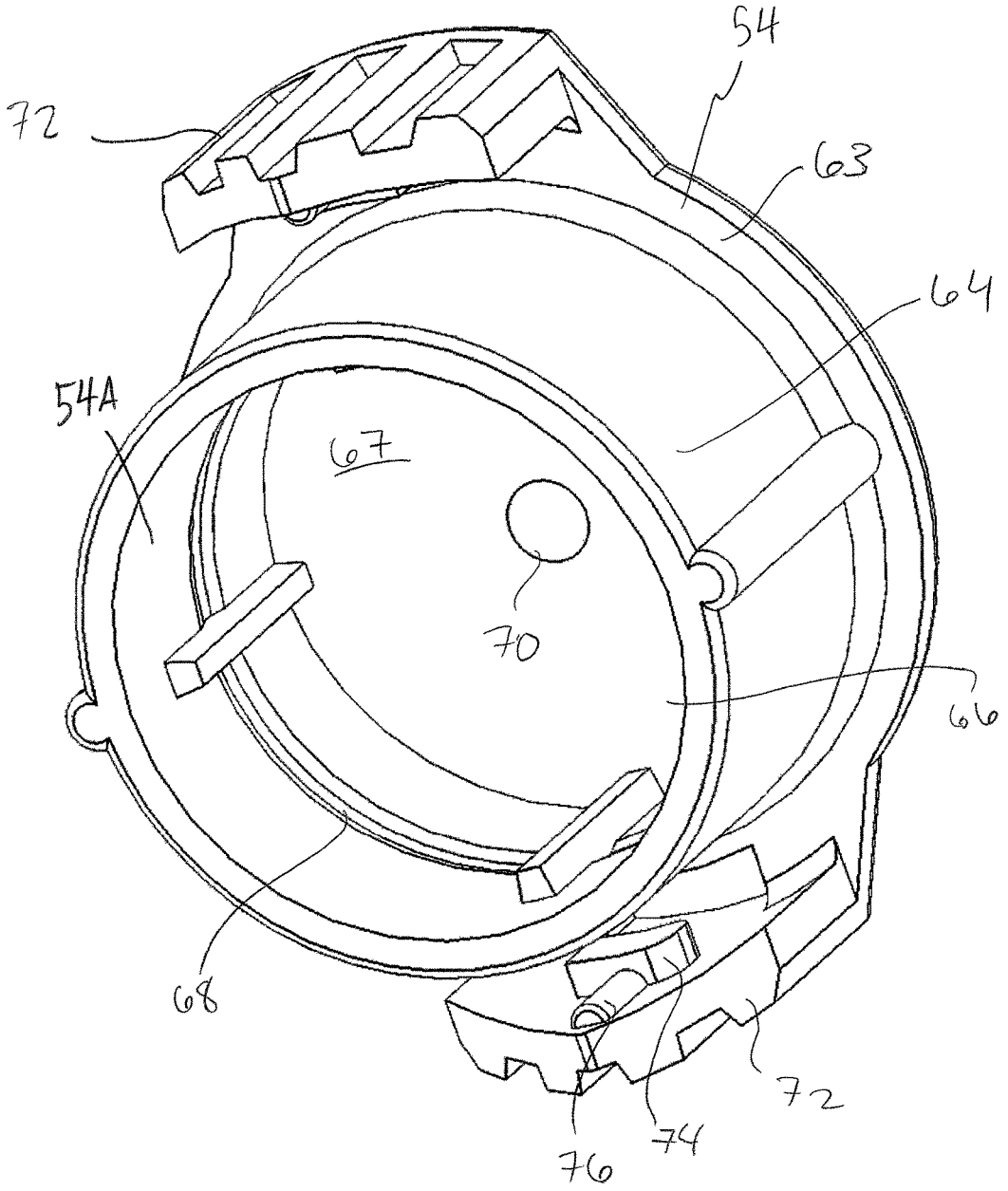
FIG. 8 is a perspective view of a cap of the brake device of FIG. 7.
Figure 8A:
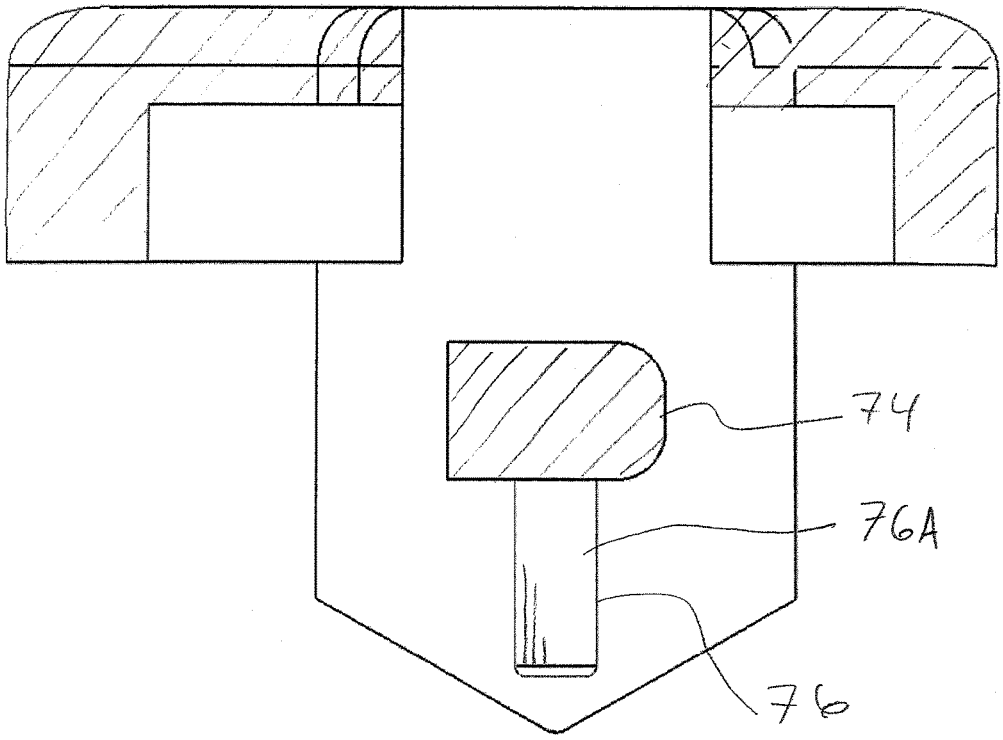
FIG. 8A is a cross-sectional view taken along line 8A-8A in FIG. 4.
Figure 19:
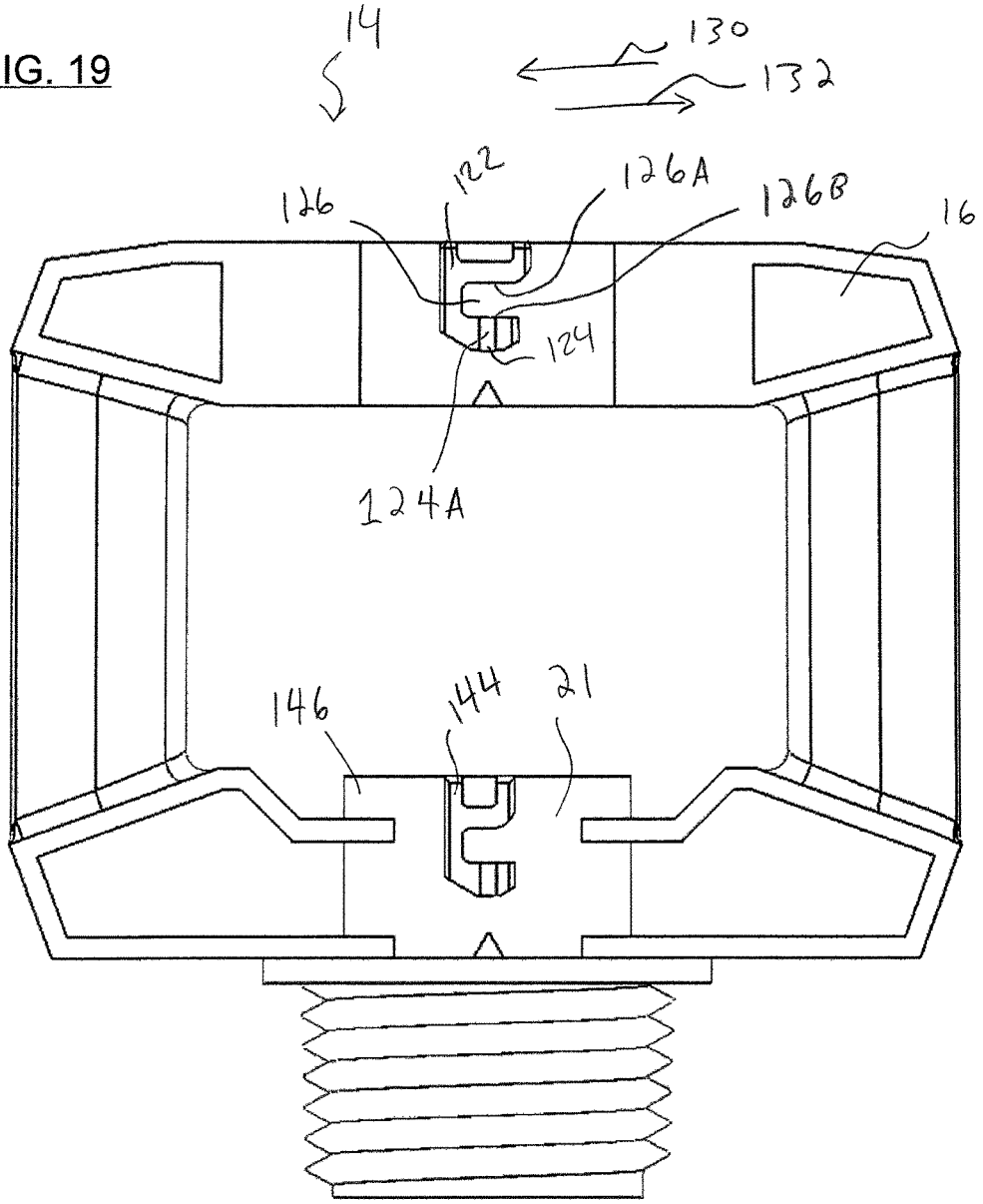
FIG. 19 is a front elevational view of a sprinkler frame of the rotary sprinkler of FIG. 1.
Figure 20:
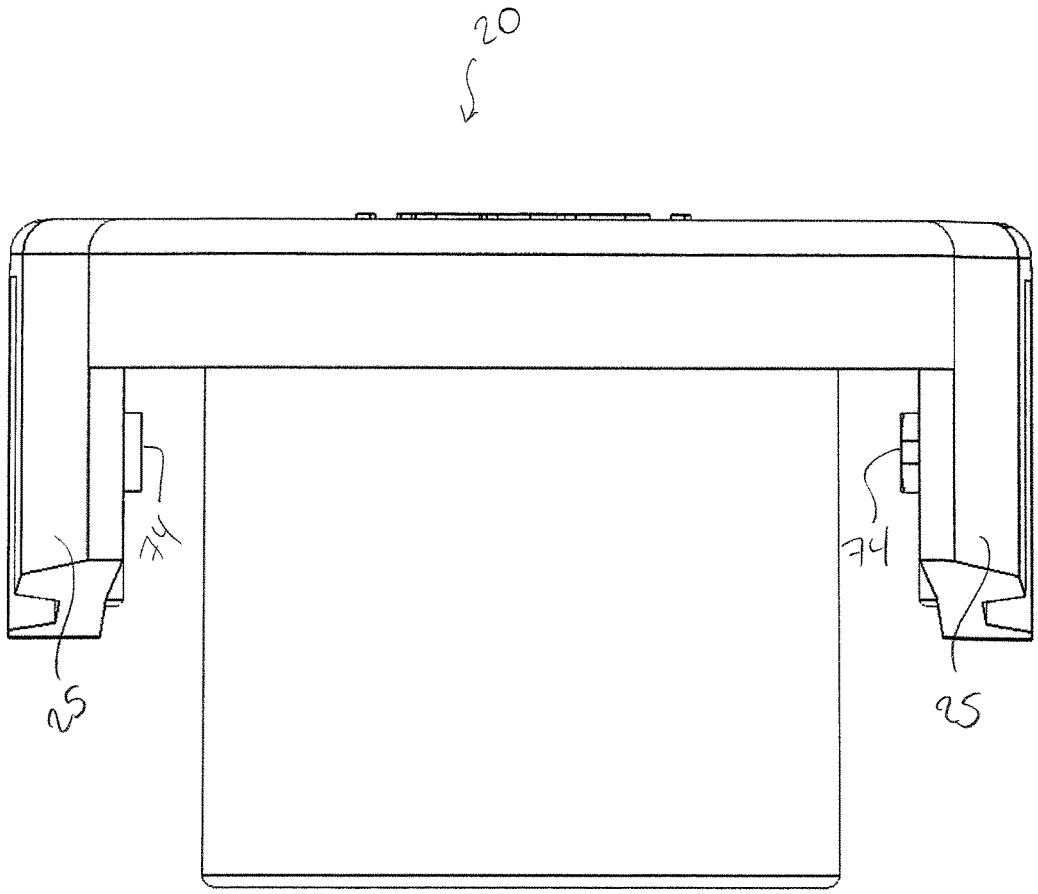
FIG. 20 is a side elevational view of a nozzle of the rotary sprinkler of FIG. 1.

The brake device 24 includes a housing cap 54, a brake member 56, a brake plate 58, a brake shaft 60, and a base member 62, as shown in FIGS. 5 and 7. The cap 54 has a body 63 with a sleeve 64 extending longitudinally downward and defining a recess 66 for receiving components of the brake device 24, shown in FIGS. 7-8*a*. Inside of the recess 66, the cap 54 has a lower cap surface 67, a groove 68, and a blind bore 70. The brake device 24 and frame upper portion 16 have interlocking portions that permit the brake device 24 to be releasably secured to the upper portion 16. In one form, the interlocking portions form a bayonet-style connection between the brake device 24 and the frame upper portion 16. The interlocking portions include a pair tabs 72 depending from opposite sides of the body 63, as shown in FIGS. 3 and 8. The tabs 72 have a protrusion 74 and a detent 76 that engage corresponding features of the frame 14. Referring to FIGS. 19 and 20, a pair of coupling members 122 are disposed on opposite sides of the upper portion 16 of the frame 14. Each coupling member 122 has a recess 124 and an opening 126 adapted to frictionally engage the detent 76 and protrusion 74, respectively, of the brake device 24 and restrict turning and longitudinal movement of the brake device 24 relative to the frame upper portion 16.

To connect the brake device 24 to the frame 14, a distal end 77 of the cap 54 (see FIG. 5) is advanced into the frame opening 30, with the cap 54 rotationally positioned about the axis 52 so the depending tabs 25 do not pass over the coupling members 122, but are instead positioned laterally to the coupling members 122. When the protrusions 74 of the brake device 24 are axially aligned with the openings 126 of the coupling members 122, the cap 54 and tabs 72 thereof are turned in direction 130 to a locked position, which causes the protrusion 74 to slide into the opening 126 (see FIGS. 1 and 19). The detents 76 cam over the coupling members 122, which causes the tabs 72 to bias outward, and engage the recesses 124. The biasing action produces a reaction force that maintains the detents 76 in the recesses 124 against unintentional dislodgement. The opening 126 has walls 126A, 126B that engage the protrusion 74 and restrict longitudinal movement of the brake device 24 along the axis 52. Further, the brake device detents 76 have convex outer surfaces 76A that engage complimentary concave surfaces 124A of the frame recesses 124 (see FIGS. 8A and 19). The engagement between the detents 76 and the recesses 124 restricts rotary movement of the tabs 72 away from the locked position. The cap 54, restricted from rotary or longitudinal displacement, is thereby releasably secured to the frame 14. To disengage the brake device 24 from the frame 14, the cap 54 is turned in direction 132 which unseats the detents 76 from the recesses 124 and disengages the brake device tabs 72 from the frame coupling members 122 (see FIG. 1).

With reference to FIGS. 5 and 19, the nozzle 20 is releasably coupled to the lower portion 18 of the frame 14 with interlocking portions of the nozzle 20 and the frame nozzle socket 21. In one form, the interlocking portions of the nozzle 20 and the nozzle socket 21 are similar to the releasable connection of the brake device 24 to the frame upper portion 14. Further, the nozzle 20 is connected to the nozzle socket 21 in a manner similar to the process of installing the brake device 24 on the frame upper portion 16. The nozzle 20 has a collar 140 with depending tabs 142 configured to engage coupling members 144 disposed on an outer wall 146 of the nozzle socket 21 (see FIGS. 2 and 19).

Figure 2:
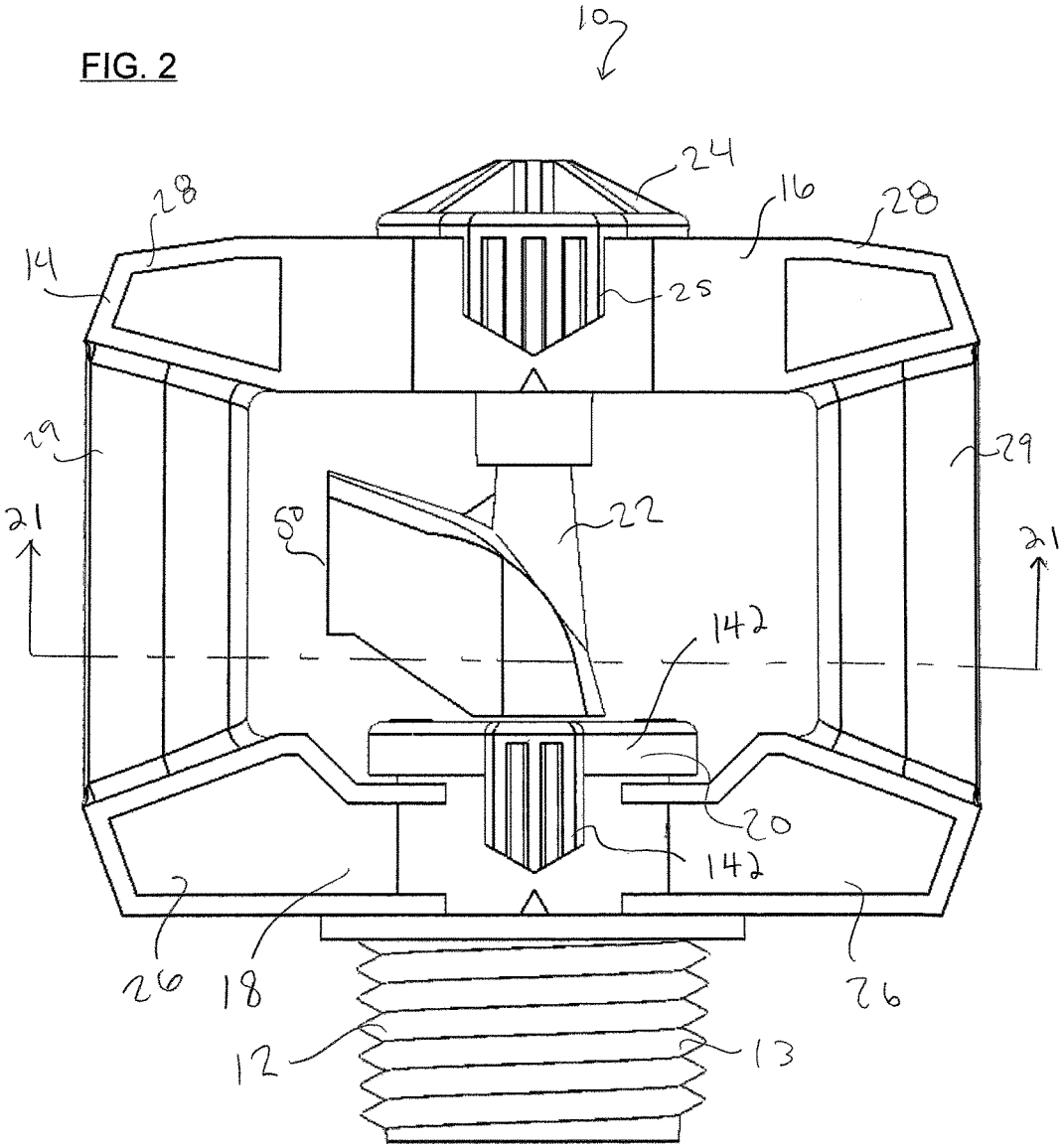
FIG. 2 is a front elevational view of the rotary sprinkler of FIG. 1.

As shown in FIG. 2, the deflector 22 is positioned above and closely approximate the nozzle 20. The brake device 24 may be disengaged from the frame 14 (and the deflector 22 moved upwardly) to provide clearance for removal of the nozzle 20. It will be appreciated that both the brake device 24 and the nozzle 20 are top serviceable and can be removed without removing the sprinkler 10 from the fluid supply.

The sprinkler 10 may be configured to receive different nozzles 20 having a variety of flow rates, etc. for a desired sprinkler application. The collar 140 and depending tabs 142 are similar between the different nozzles 20 in order to permit the different nozzles 20 to be releasably engaged with the nozzle socket coupling member 144.

The brake assembly 24 includes a brake member 56 and a clamping device, such as a brake plate 58 and a brake surface 67, which clamp the brake member 56 and slow the rotation of the deflector 22 as shown in FIG. 7. The brake plate 58 is positioned below the brake member 56 and is coupled to a shaft 60 which carries the deflector 22 such that the brake plate 58 turns with rotation of the deflector 22. The brake surface 67 is disposed on an underside of the cap 24 (on an opposite side of the brake member 56 from the brake plate 58) and is stationary relative to the rotating brake member 56. As discussed in greater detail below, fluid striking the deflector 22 rotates the deflector 22 and brake plate 58, shifts the brake plate 58 upward, and compresses the brake member 56 between the brake plate 58 and the brake surface 67. This produces frictional resistance to turning of the deflector 22.

Figure 9:
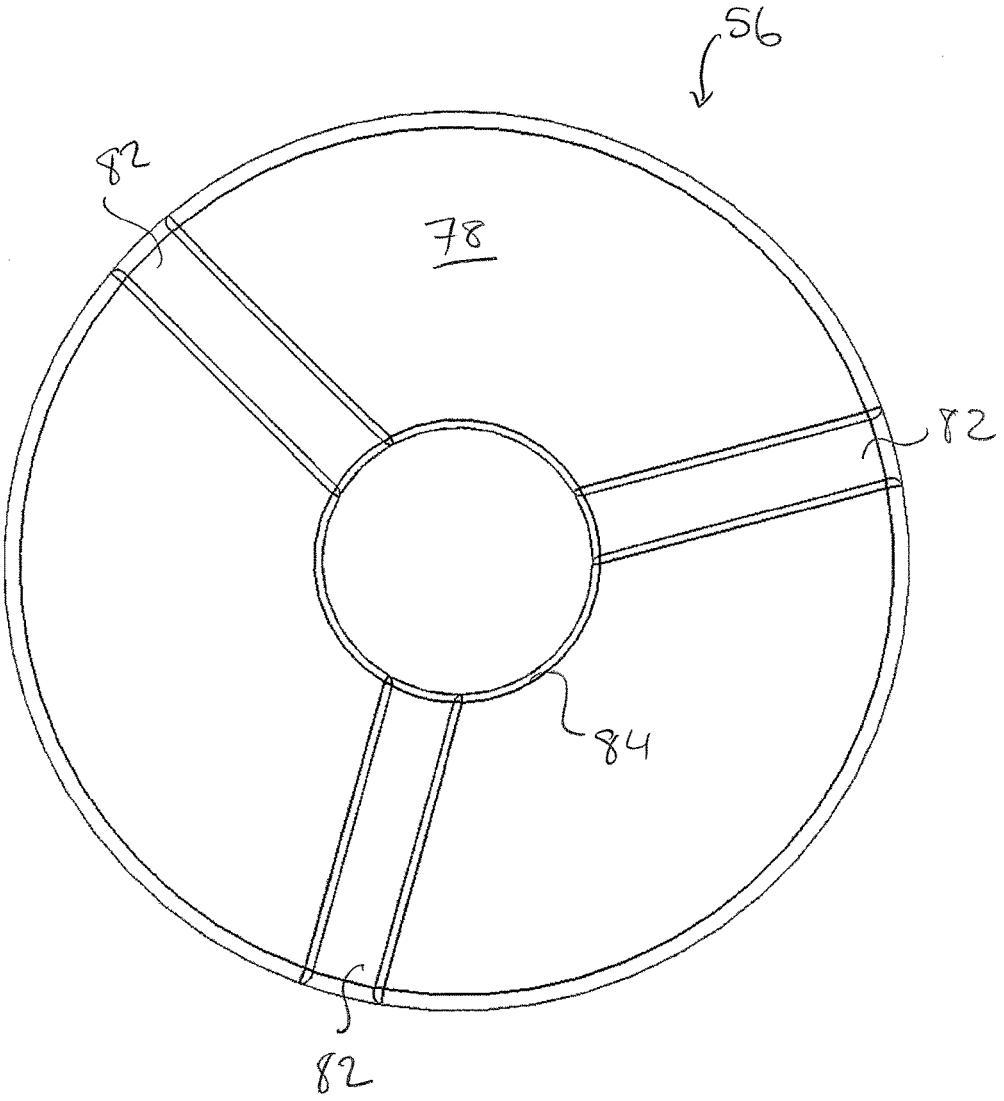
FIG. 9 is a bottom plan view of a brake member of the brake device of FIG. 7.
Figure 10:
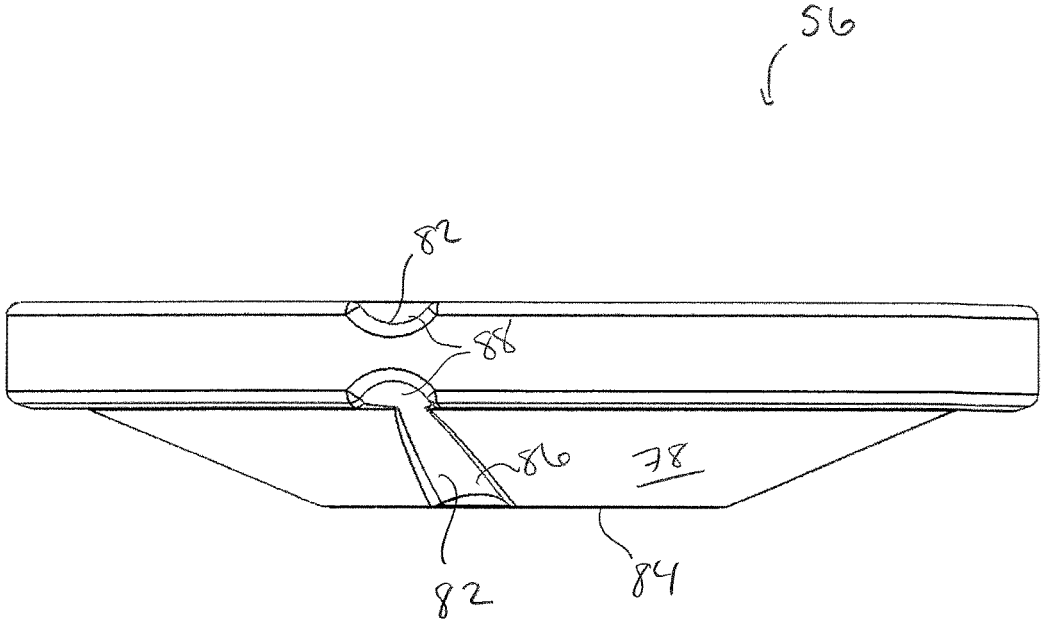
FIG. 10 is a side elevational view of the brake member of FIG. 9.
Figure 11:
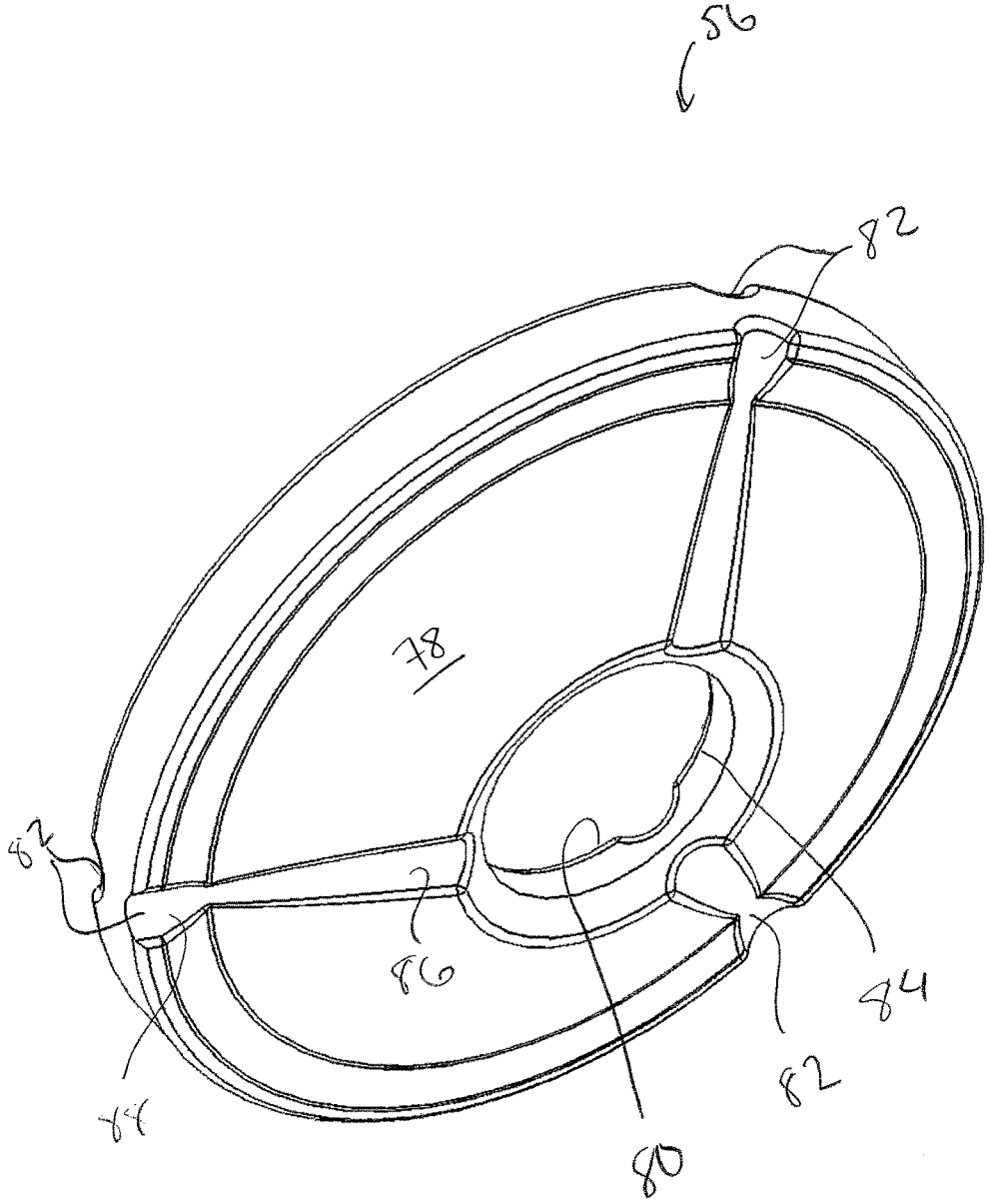
FIG. 11 is a perspective view of the brake member of the FIG. 9.
Figure 12:
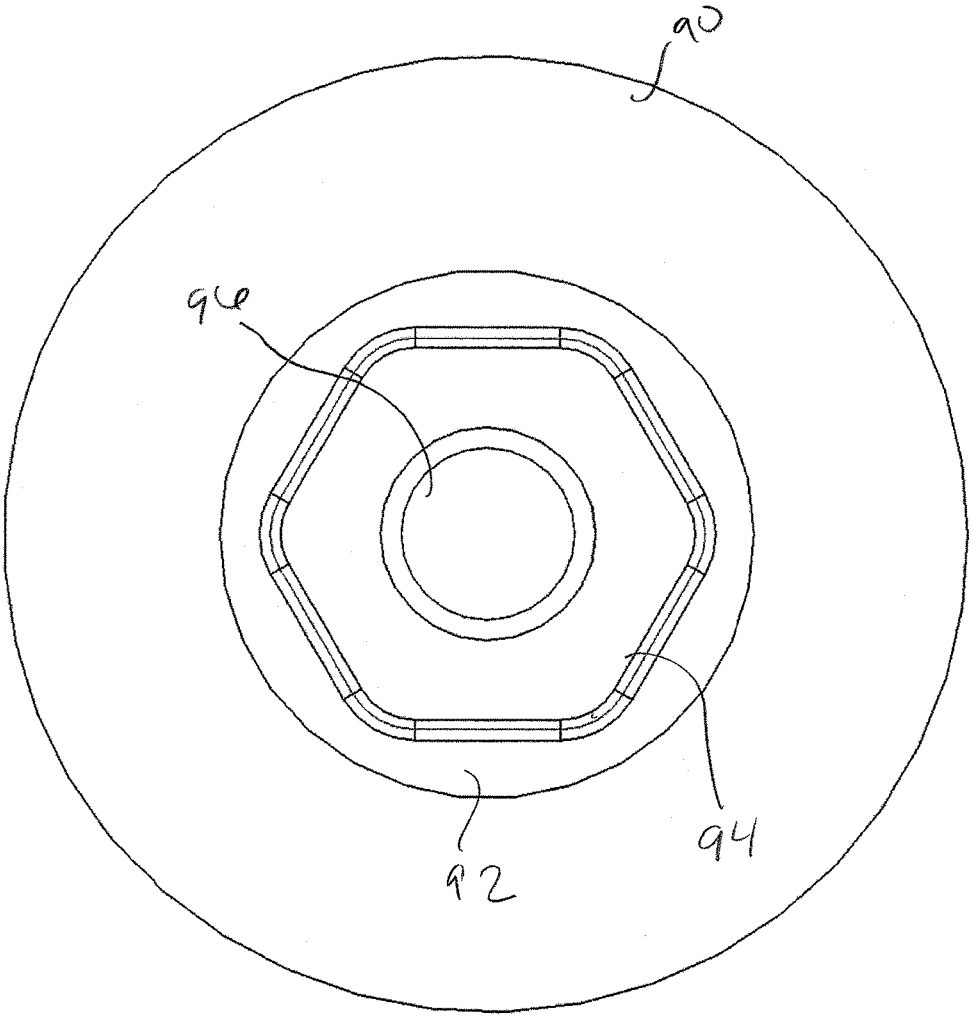
FIG. 12 is a bottom plan view of a brake plate of the brake device of FIG. 7.
Figure 13:
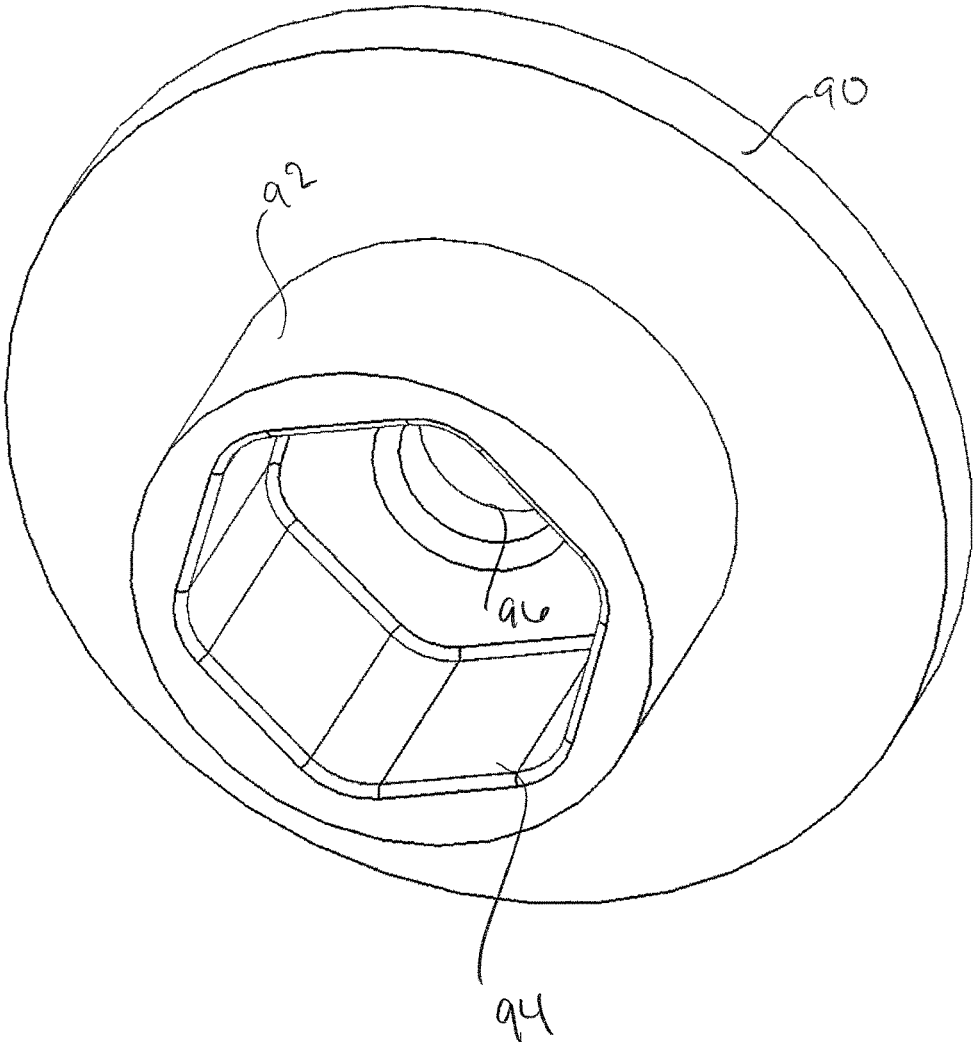
FIG. 13 is a perspective view of the brake plate of FIG. 12.

The brake member 56 may be conically shaped and defined by a lower friction surface 78 and an upper friction surface 80 (see FIGS. 7, 10, 11). The surfaces 78 and 80 each have grooves 82 extending radially outward from a central opening 84 (which receives the shaft 60 therethrough), with each groove 82 having an inner recess 86 and an outer recess 88 as shown in FIGS. 9 and 10. The grooves 82 may function to direct dirt and debris that become lodged between the brake member 56, brake plate 58, and brake surface 67 radially outward and away from the shaft 60. This operation inhibits the dirt and debris from gumming up the rotation of brake plate 58 (and deflector 22 connected thereto). In one approach, a lubricant such as grease may be used within the brake assembly 24 to increase the ease with which the deflector 22 can rotate. In this approach the grooves 82 serve to trap excess grease that could affect the frictional quality of the contact surfaces.

Figure 10A:
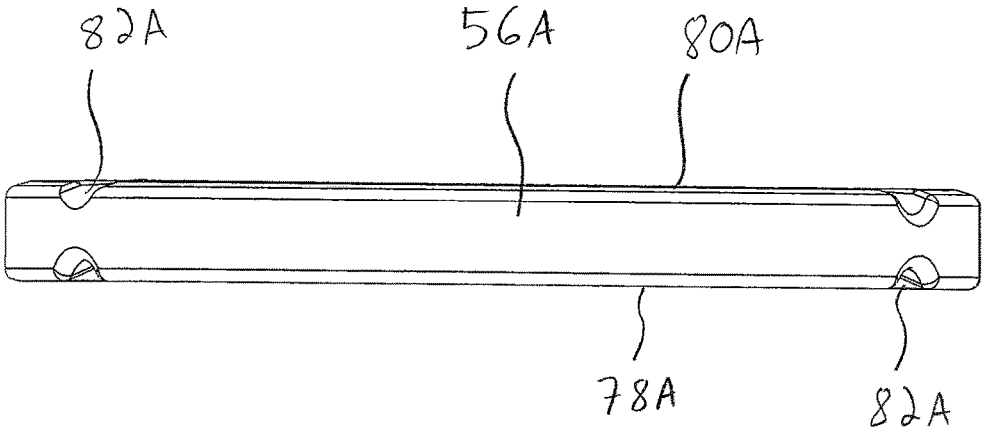
FIG. 10A is a side elevational view of an alternative form of a brake member for the brake device.

With reference to FIG. 10A, another brake member 56A is shown. The brake member 56A is substantially similar to the brake member 56 and includes upper and lower friction surfaces 80A, 78A with grooves 82A thereon. The brake member 56A, however, is flat rather than the conical shape of brake member 56.

With reference to FIGS. 5, 7, 12, and 13, the brake plate 58 has an upper plate portion 90 with a friction surface 91 for engaging the brake member 56 and a socket 92 extending longitudinally downward from the plate portion 90. The socket 92 has a hexagonal shaped opening 94 and a through-opening 96 for receiving the shaft 60 therethrough. Referring to FIGS. 5 and 7, the shaft 60 has an upper portion 98, a lower portion 100, a hexagonal collar 102, and splines 104 of the lower portion 100. The upper portion 60 resides within the openings 84 and 96 of the brake member 56 and the brake plate 58, respectively. The socket 92 has a mating, hexagonal configuration to engage the shaft hexagonal collar 102 and restrict rotary movement therebetween. An upper surface 102A of the collar 102 faces a bottom 92A of the socket 92, so that upward, longitudinal movement of the shaft 60 engages the upper surface 102A of the shaft collar 102 with the socket bottom 92A and shifts the brake plate 58 upward.

The shaft 60 has a lower end portion 100 sized to fit within a recess 105 of the deflector 22. The shaft lower end portion 100 has splines 104 that engage cooperating splines in the recess 105. The interengagement of the splines keeps the deflector 22 mounted on the shaft lower end portion 100 and restricts relative rotary motion of the deflector 22 about the shaft lower end portion 100. In another approach, the recess 105 has a smooth bore and the shaft lower end portion 100 is press-fit therein.

Figure 14:
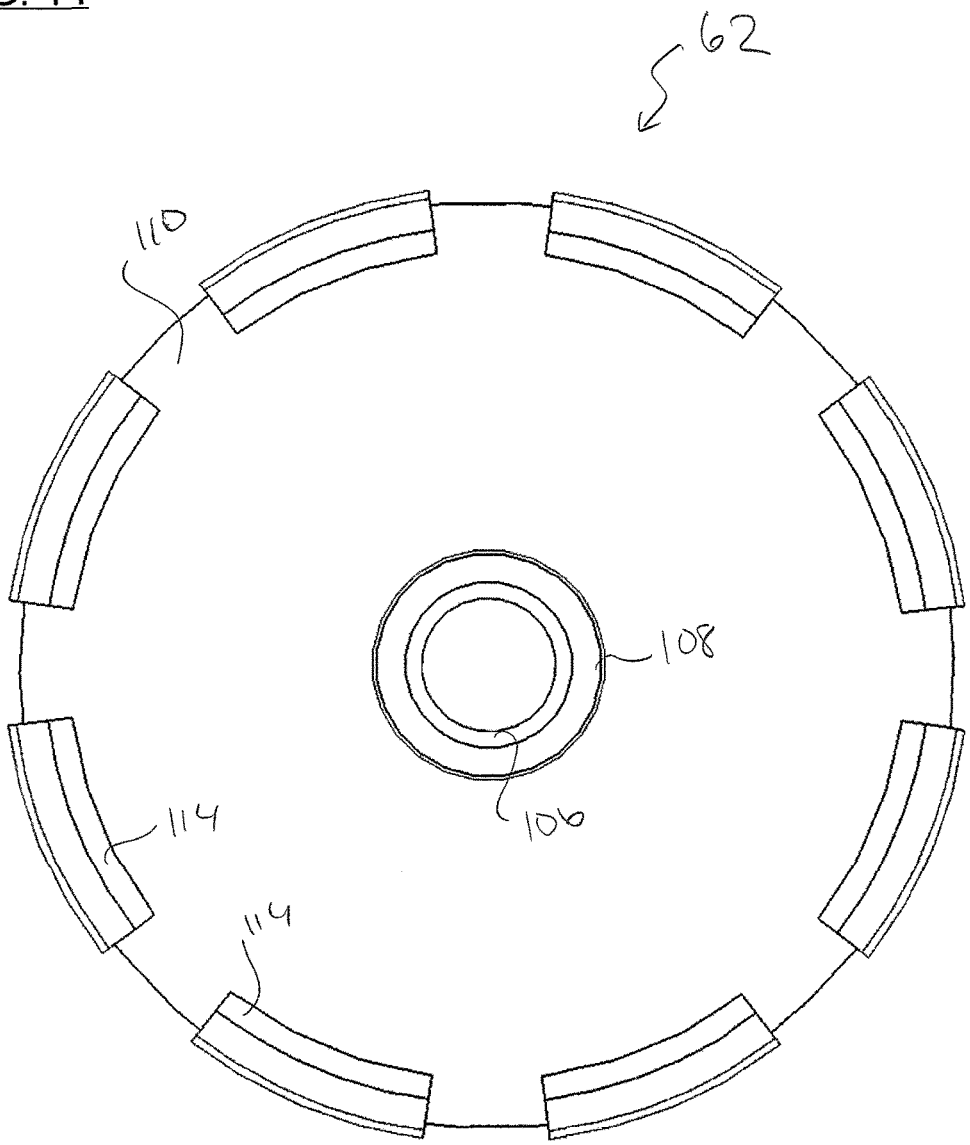
FIG. 14 is a bottom plan view of a brake base member of the brake device of FIG. 7.
Figure 15:
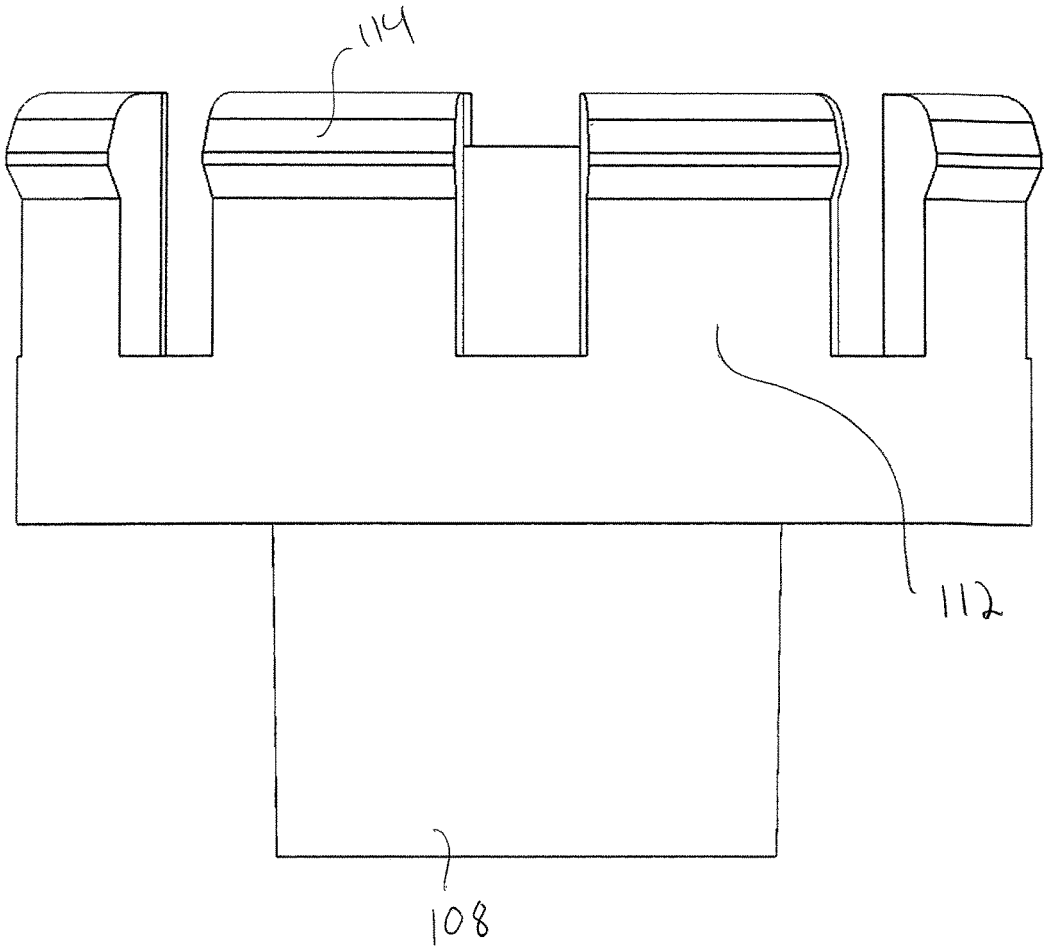
FIG. 15 is a side elevational view of the brake base member of FIG. 14.

Referring now to FIGS. 7, 14, and 15, the brake base 62 has resilient tabs 112 that releasably connect the brake base 62 within the brake cap 54. The resilient tabs 112 are upstanding from a disc 110 and include protuberances 114 which bear against an internal surface 54A of the brake cap 54 (see FIG. 8) and deflect the tabs 112 radially inward as the base 62 is inserted into the cap 54 and the tabs 112 are advanced into the brake cap recess 66. The protuberances 114 snap into the groove 68 of the brake cap 54 to secure the brake base 62 within the brake cap 54.

In another approach, the brake base 62 may be ultrasonically welded or adhered to the brake cap 54 rather than utilizing resilient tabs 112. In yet another approach, the brake base 62 may be permanently connected to the brake cap 54 using structures that make disassembly nearly impossible without damaging the sprinkler 10. For example, the resilient tabs 112 could have protuberances 114 with sharp profiles that permit the tabs 112 to snap into brake cap 54 in an insertion direction but require deformation of the protuberances 114 in a reverse direction.

With the brake base 62 mounted within the brake cap 54, the brake base 62 is secured to the frame 14 during operation of the sprinkler 10. The brake base 62 has a sleeve 108 with a through opening 106 sized to receive the shaft 60, as shown in FIGS. 7, 14, 15. The sleeve 108 permits both rotational and longitudinal movement of the sleeve 108 within the opening 108. Further, the sleeve has an upper end 108A which contacts the bottom of the shaft collar 102 and restricts downward longitudinal movement of the shaft 60 beyond a predetermined position, as shown in FIG. 7. The sleeve upper end 108A functions as a lower stop for the shaft 60.

Figure 16:
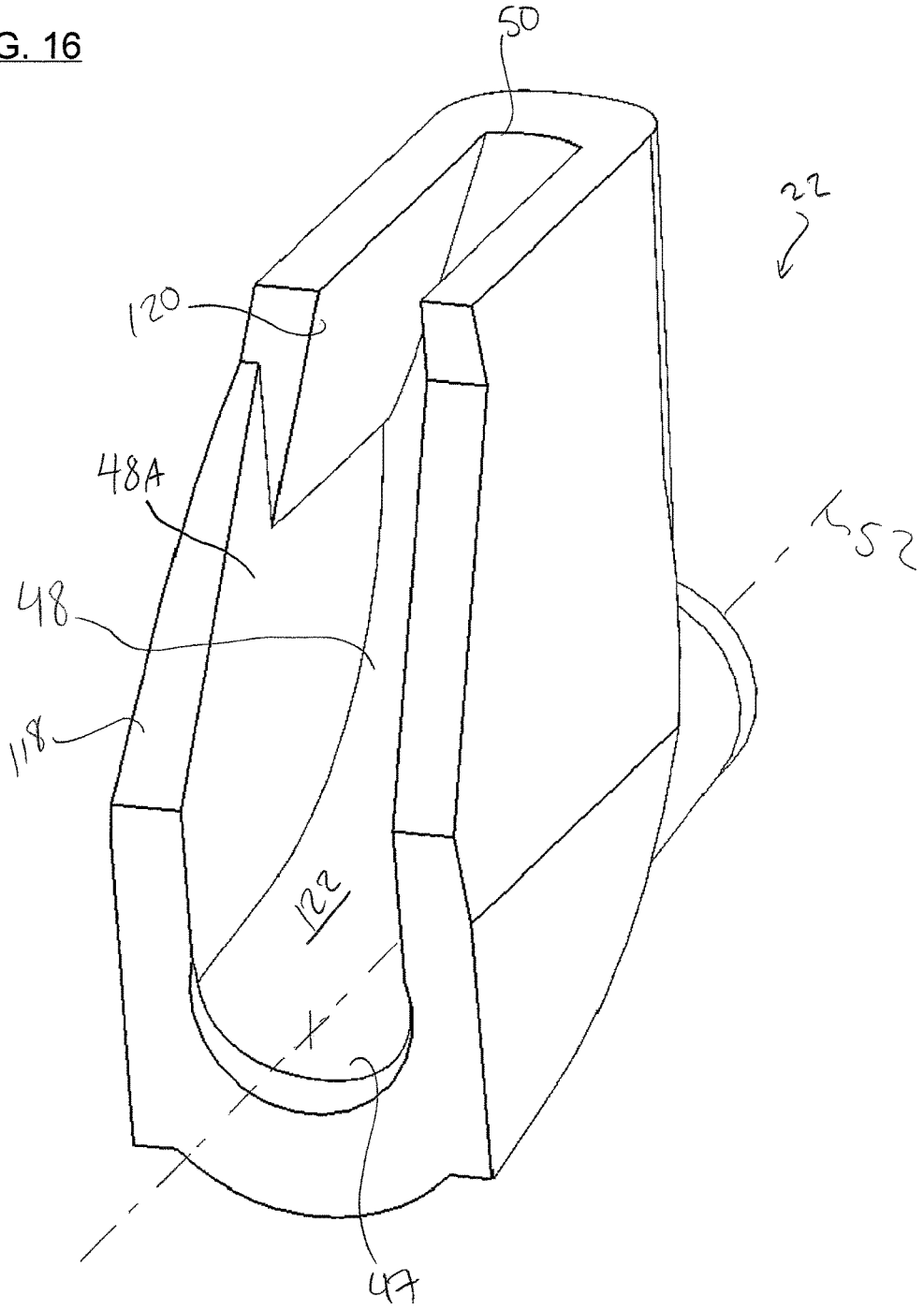
FIG. 16 is a perspective view of a deflector of the rotary sprinkler of FIG. 1.
Figure 17:
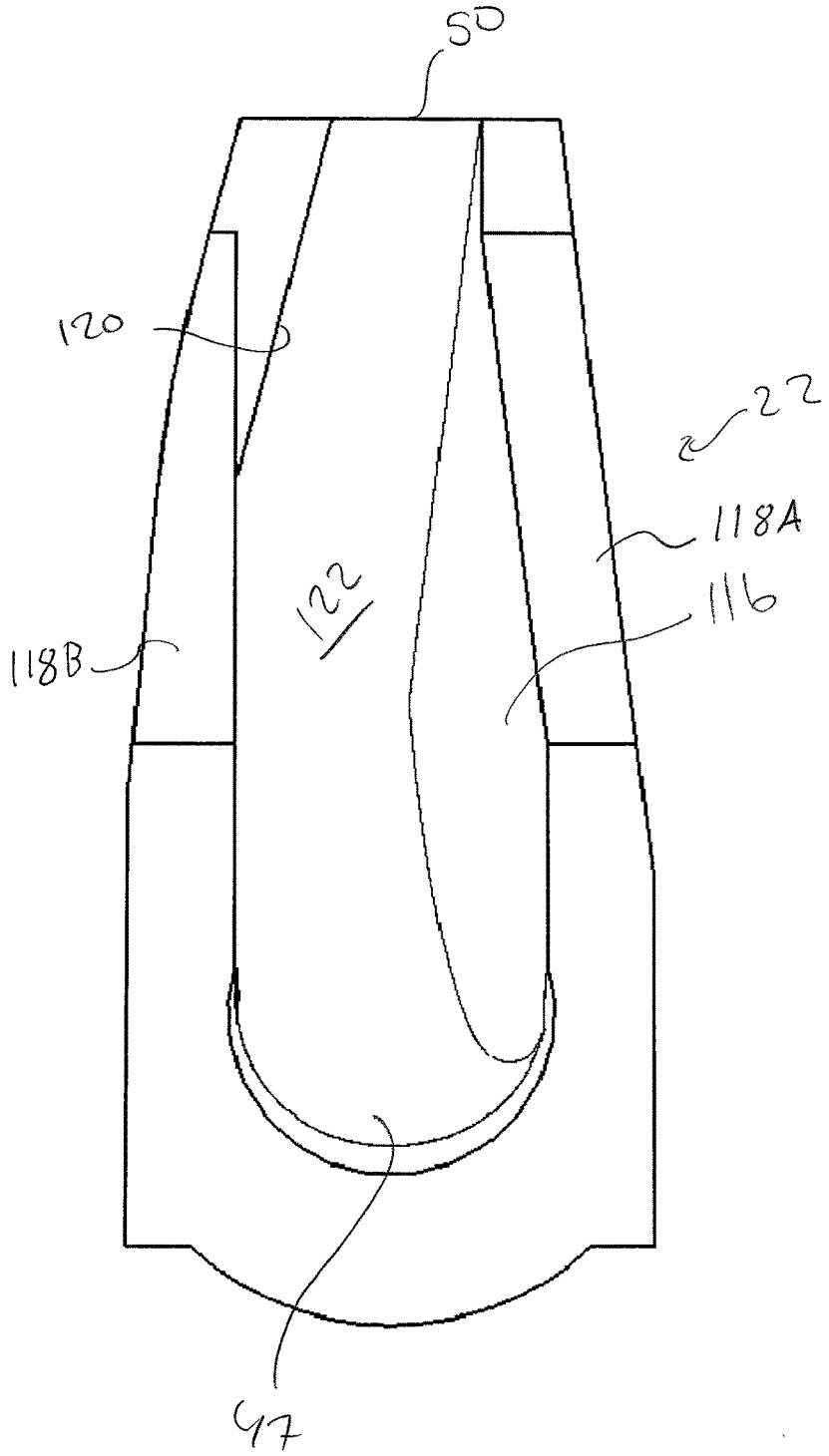
FIG. 17 is a bottom plan view of the deflector of FIG. 16.
Figure 18:
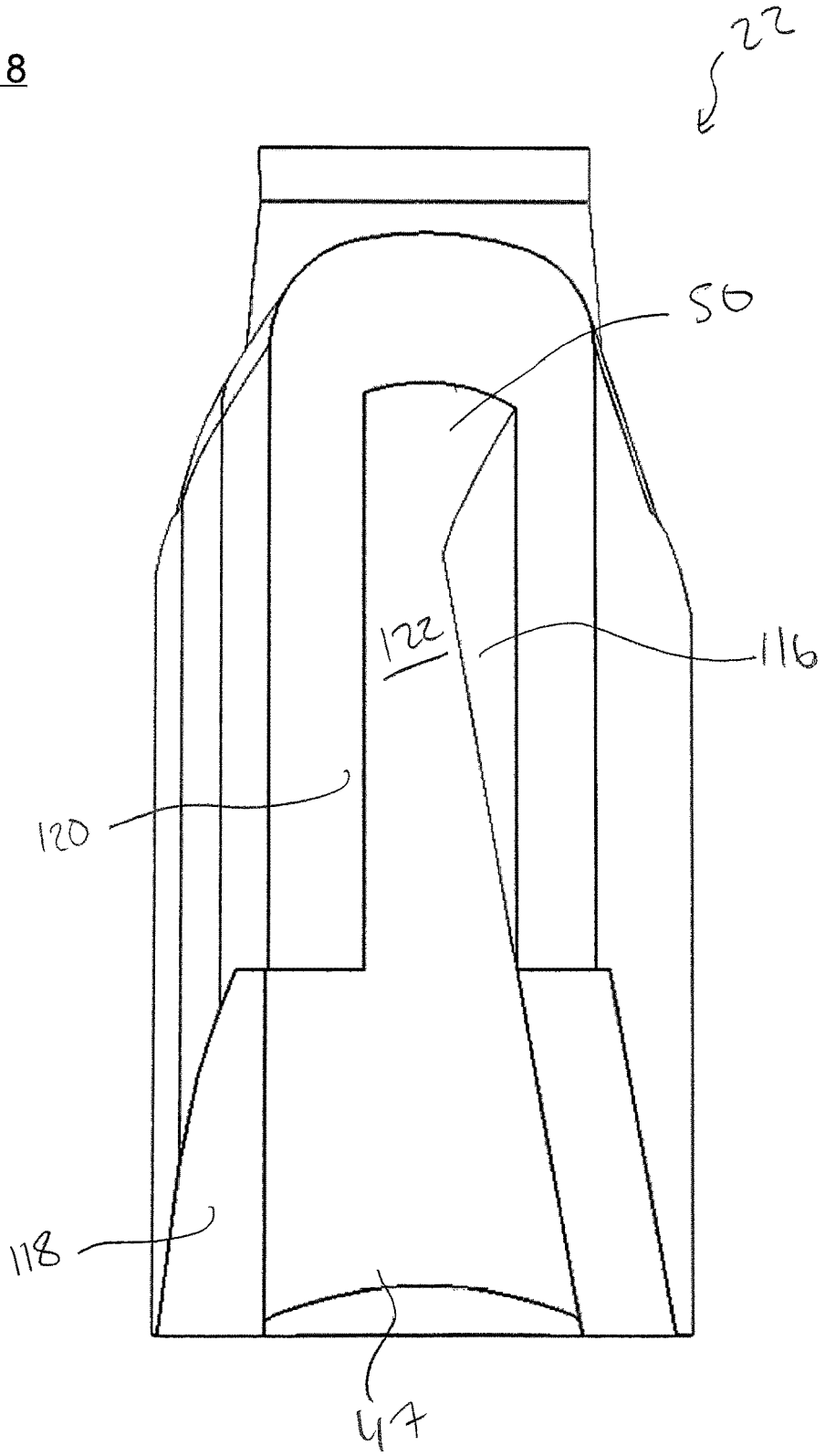
FIG. 18 is a side elevational view of the deflector of FIG. 16.

Referring to FIGS. 16-18, the channel 48 of the deflector 22 may have an open configuration with an opening 48A extending along a side of the channel 48. The channel 48 has walls 118 on opposite sides of the channel 48, with one of the walls 118A having an axially inclined surface 116 to direct the flow of fluid through the deflector 22 and the other wall 118B having a ramp 120 that directs the flow tangentially from the outlet 50 of the deflector 22. As a result of water flow through the channel 48 and against the ramp 120, a reaction force tangent to the axis of rotation 52 of the deflector 22 is created, causing the deflector 22 and the attached shaft 60 to rotate relative to the frame 14 in direction 150 (see FIGS. 1 and 21).

The channel 48 also has a curved surface 122 that redirects an axial flow of fluid from the nozzle 20 into a flow travelling radially outward from the deflector 22. The inclined surface 116 directs the fluid flow towards the wall 118B as the fluid travels along the curved surface 122. The inclined surface 116 and the curved surface 122 operate to direct fluid toward the ramp 120 and cause the fluid to exit the deflector outlet 50 at a predetermined angle sufficient to cause the deflector 22 to turn. The shape of the surfaces of the channel 48, including surfaces 116, 120, and 122, can be modified as desired to provide a desired, uniform fluid stream as it leaves the deflector 22. It will be appreciated that the channel 48 can have one, two, three, or more flat surfaces, as well as other features such as one or more grooves, in order to achieve a desired fluid distribution uniformity from the deflector 22.

Figure 37:
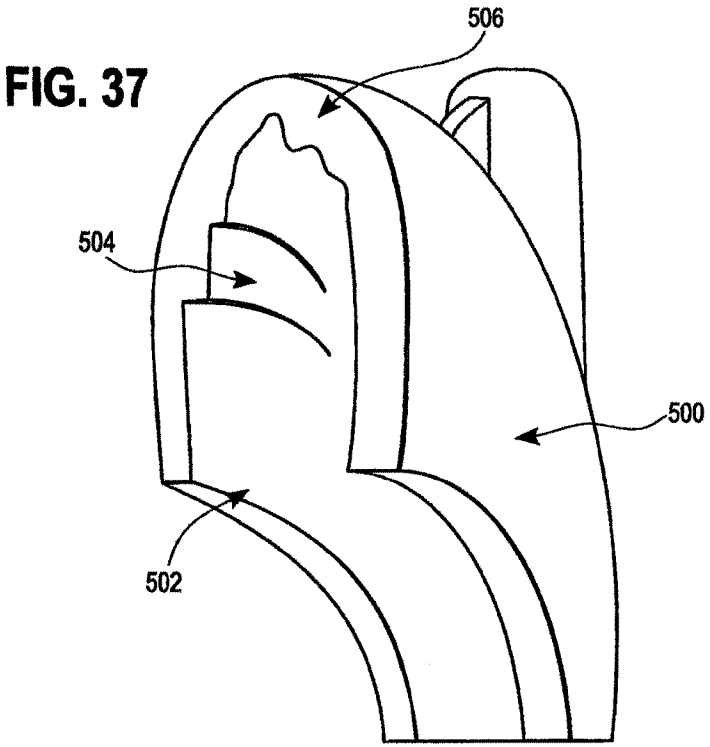
FIG. 37 is a perspective view of another deflector.
Figure 38:
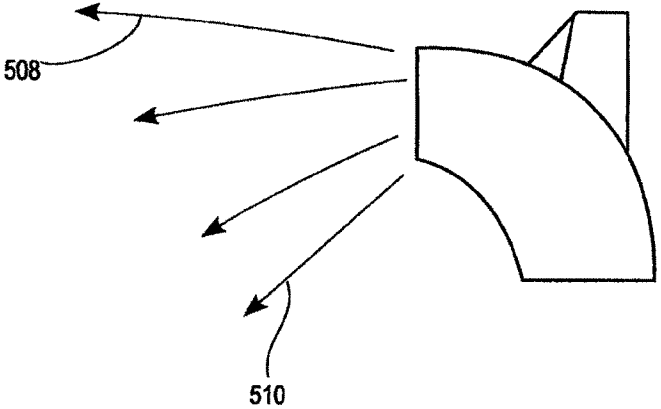
FIG. 38 is a schematic view of fluid being emitted from the deflector of FIG. 37.
Figure 39:
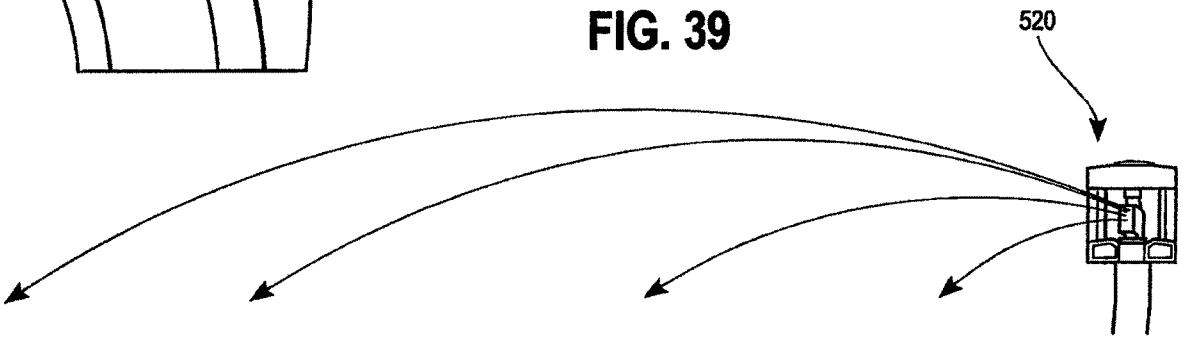
FIG. 39 is a schematic view of a water spray pattern of a sprinkler having the deflector of FIG. 37.

With reference to FIGS. 37-39, a deflector 500 is shown having an inner channel 502, steps 504, and grooves 506 extending along an interior surface of the channel 502. The grooves 506 near the upper end (as viewed in FIG. 37) direct the upper portion of the fluid flow to provide far-field watering 508 while the steps 504 near the lower end direct the lower portion of the fluid flow to provide near-field watering 510. The deflector 500 can be used with the sprinkler 10, and is generally shown in operation in FIG. 39. By directing the upper portion of the flow farther, the deflector 500 restricts the upper portion of the flow from pushing the lower portion of the flow downward. This functions to increase the throw distance and spray uniformity of the sprinkler 520.

When fluid travels into the deflector 22 from the nozzle 20, the fluid strikes the curved surface 122 and shifts the deflector 22 and shaft 60 connected thereto upward through a short stroke. The upward movement of the shaft 60 shifts the upper friction surface 91 (see FIG. 5) of the brake plate 58 into engagement with the lower friction surface 78 of the brake member 56. The brake member 56 is also shifted axially upwardly through a short stroke sufficient to move the upper friction surface 80 of the brake member 56 (see FIG. 7) into engagement with the brake surface 67 of the cap 54. With this arrangement, the brake member 56 is axially sandwiched between the rotatably driven brake plate 58 and the nonrotating brake surface 67. The brake member 56 frictionally resists and slows the rotational speed of the brake plate 58 and the deflector 22 connected to it.

The higher the fluid flow through the nozzle 20, the greater the impact force of the fluid against the curved surface 122 of the deflector 22. This translates into a greater upward force being exerted on the deflector 22 and shaft 60 and brake plate 58 connected thereto. As the fluid flow increases, this upward force causes the brake member 56 to gradually flatten out and bring a larger portion 160 of the brake member friction surface 80 into engagement with the cap brake surface 67, as shown in FIG. 7. Further, flattening out of the brake member 56 also causes a larger portion 162 of the brake member lower friction surface 78 to engage the brake plate 58. Thus, rather than the deflector 22 spinning faster with increased fluid flow from the nozzle 20, the brake device 24 applies an increasing braking force to resist the increased reaction force on the deflector ramp 120 from the increased fluid flow.

The flat brake member 56A provides a similar increase in braking force with increased impact force of the fluid against the curved surface 122 of the deflector 22. More specifically, the frictional engagement between the brake upper frictional surface 80A, the brake surface 67, and the brake member 58 is increased with an increase in fluid flow against the curved surface 122 (see FIG. 7). This increase occurs because frictional force is a function of the force applied in a direction normal to the friction surface 67, with the normal force in this case resulting from the impact of fluid against the curved surface 122 of the deflector 22.

Figure 21:
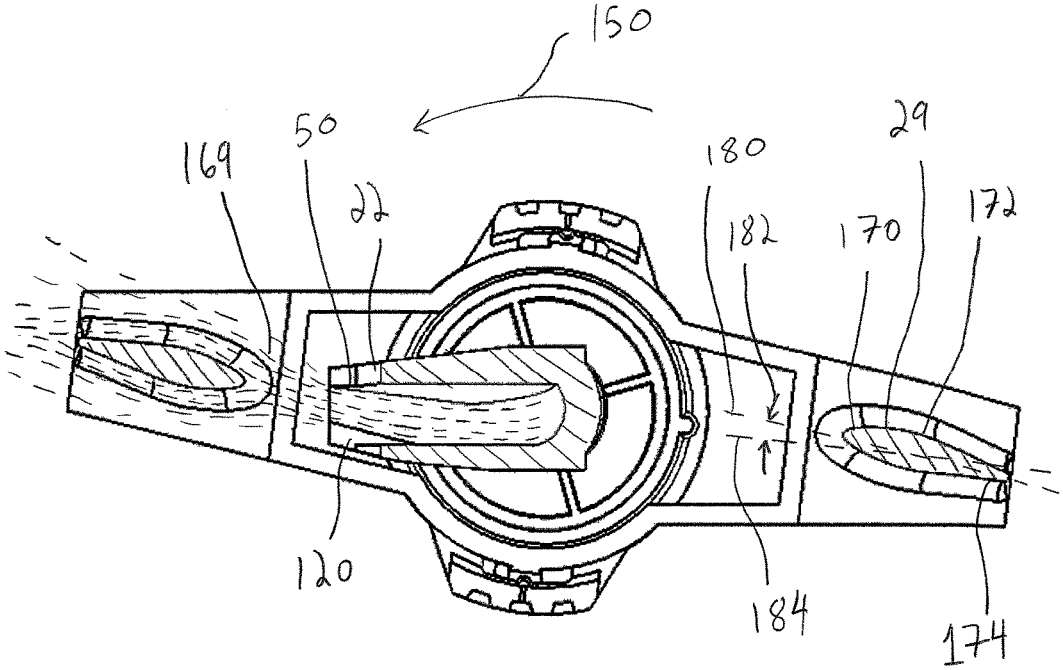
FIG. 21 is a cross-sectional view taken along line 21-21 in FIG. 2 showing the cross-sectional shape of the supports of the rotary sprinkler of FIG. 1.

With reference to FIG. 21, the sprinkler 10 has additional features that improve efficiency of the sprinkler 10. In one form, the sprinkler 10 has supports 29 with an airfoil-shaped cross section that minimizes the shadow created by the supports 29 in the spray pattern of the sprinkler 10. More specifically, the supports 29 have a leading end portion 170, an enlarged intermediate portion 172, and a tapered trailing end portion 174. The leading and trailing end portions 172, 174 gradually divert fluid flow 169 from the deflector 22 around the supports 29 and cause the fluid flow 169 to re-join near the trailing end 174. The fluid flow 169 then continues radially outward from the supports 29 substantially uninterrupted by the presence of the supports 29, which reduces the shadow of the supports 29 over conventional sprinklers.

The supports 29 have cross-sectional midlines 180 that are oriented at an angle 182 relative to a radius 184 of the sprinkler 10. As shown in FIG. 21, fluid 169 travels outwardly from the deflector 22 tangentially to the deflector outlet opening 50 due to the fluid 169 striking the ramp 120. The support midlines 180 are oriented substantially parallel to this tangential direction of fluid travel, which causes the fluid 169 traveling outward from the deflector outlet opening 50 to contact the leading end portion 170 head-on. This maximizes the ability of the support cross-section to redirect flow 169 around the support 29 and rejoin the flow 169 once it reaches the trailing end portion 174.

The components of the sprinkler 10 are generally selected to provide sufficient strength and durability for a particular sprinkler application. For example, the brake shaft 60 may be made of stainless steel, the brake member 56 may be made of an elastomeric material, and the remaining components of the sprinkler 10 may be made out of plastic.

Figure 22:
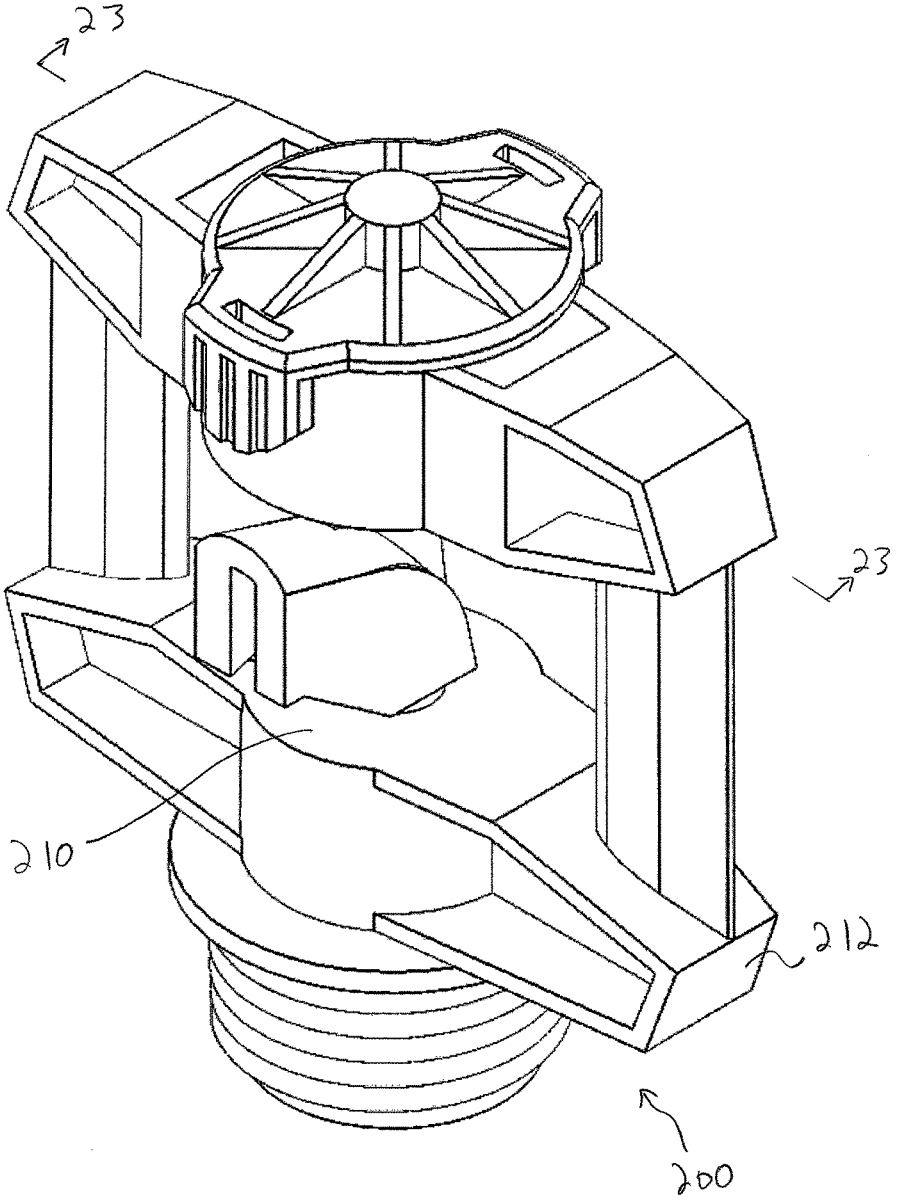
FIG. 22 is a perspective view of another rotary sprinkler.
Figure 23:
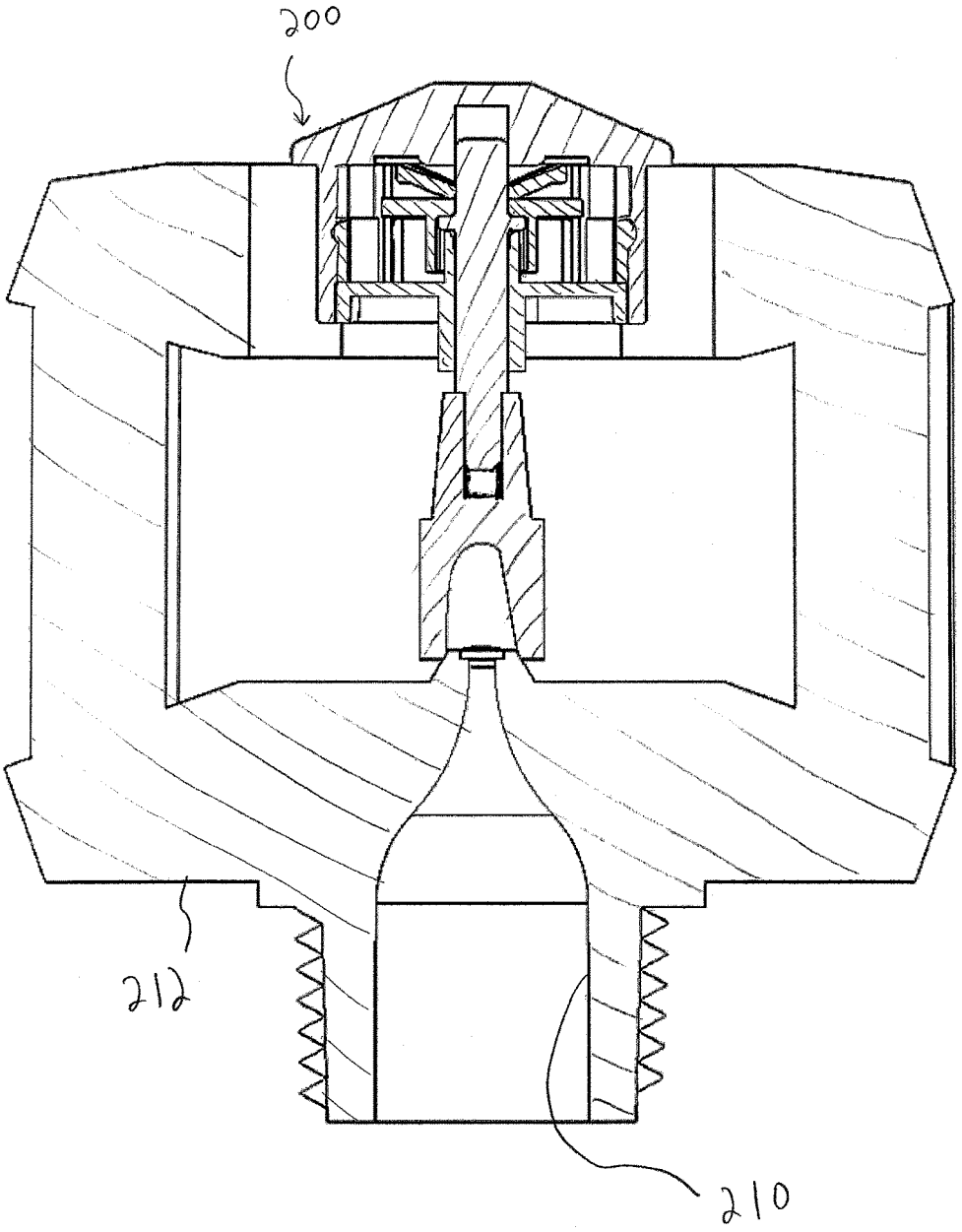
FIG. 23 is a cross-sectional view taken across line 23-23 in FIG. 22.
Figure 24:
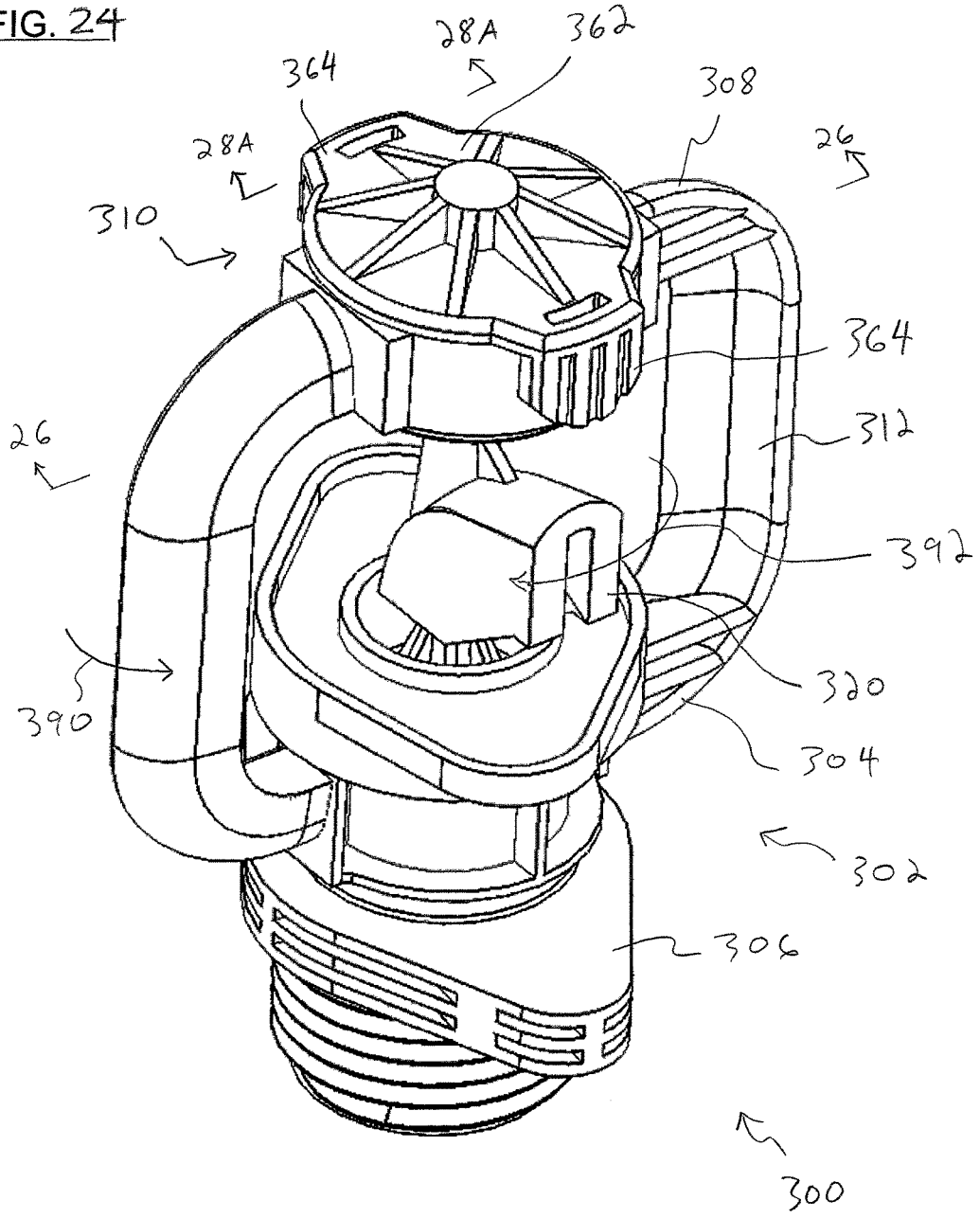
FIG. 24 is a perspective view of another rotary sprinkler.
Figure 25:
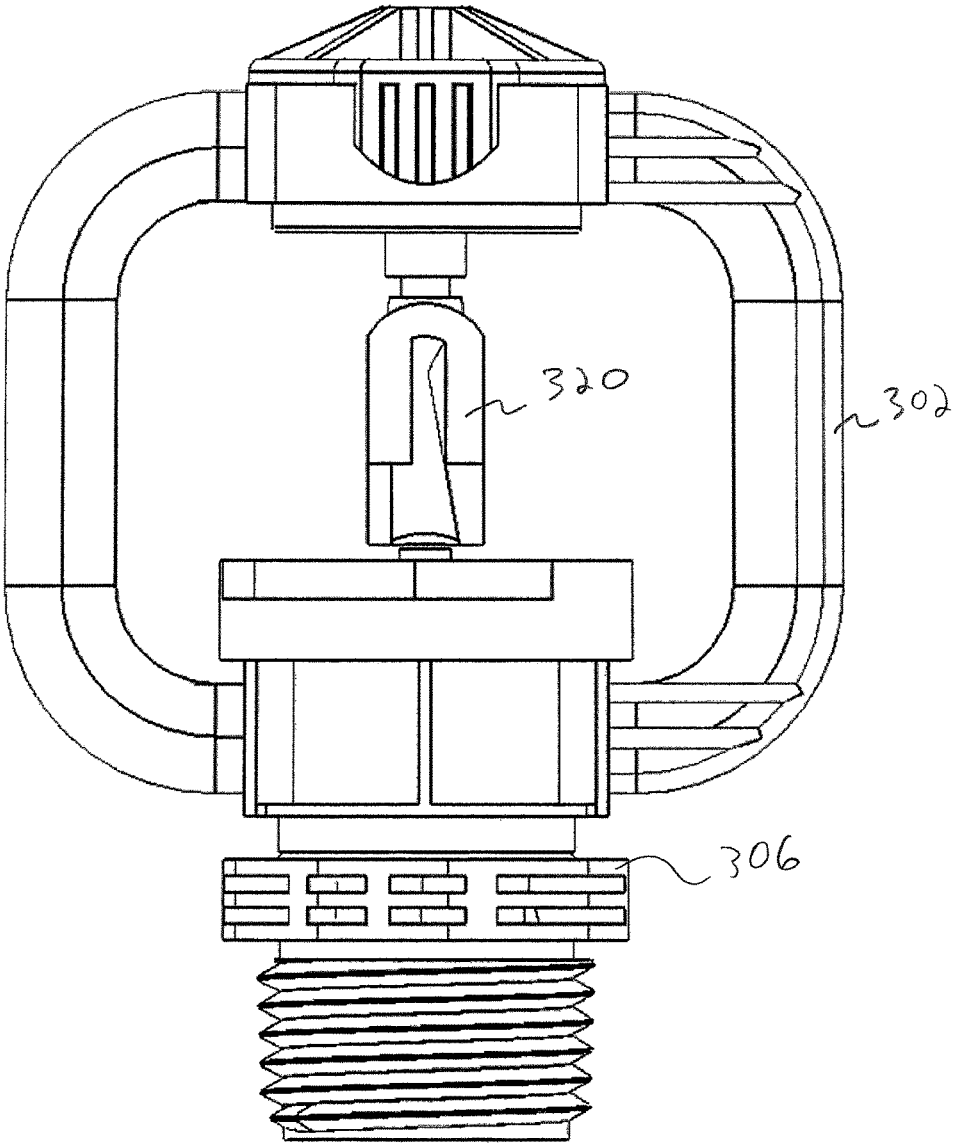
FIG. 25 is a side elevational view of the rotary sprinkler of FIG. 24.
Figure 26:
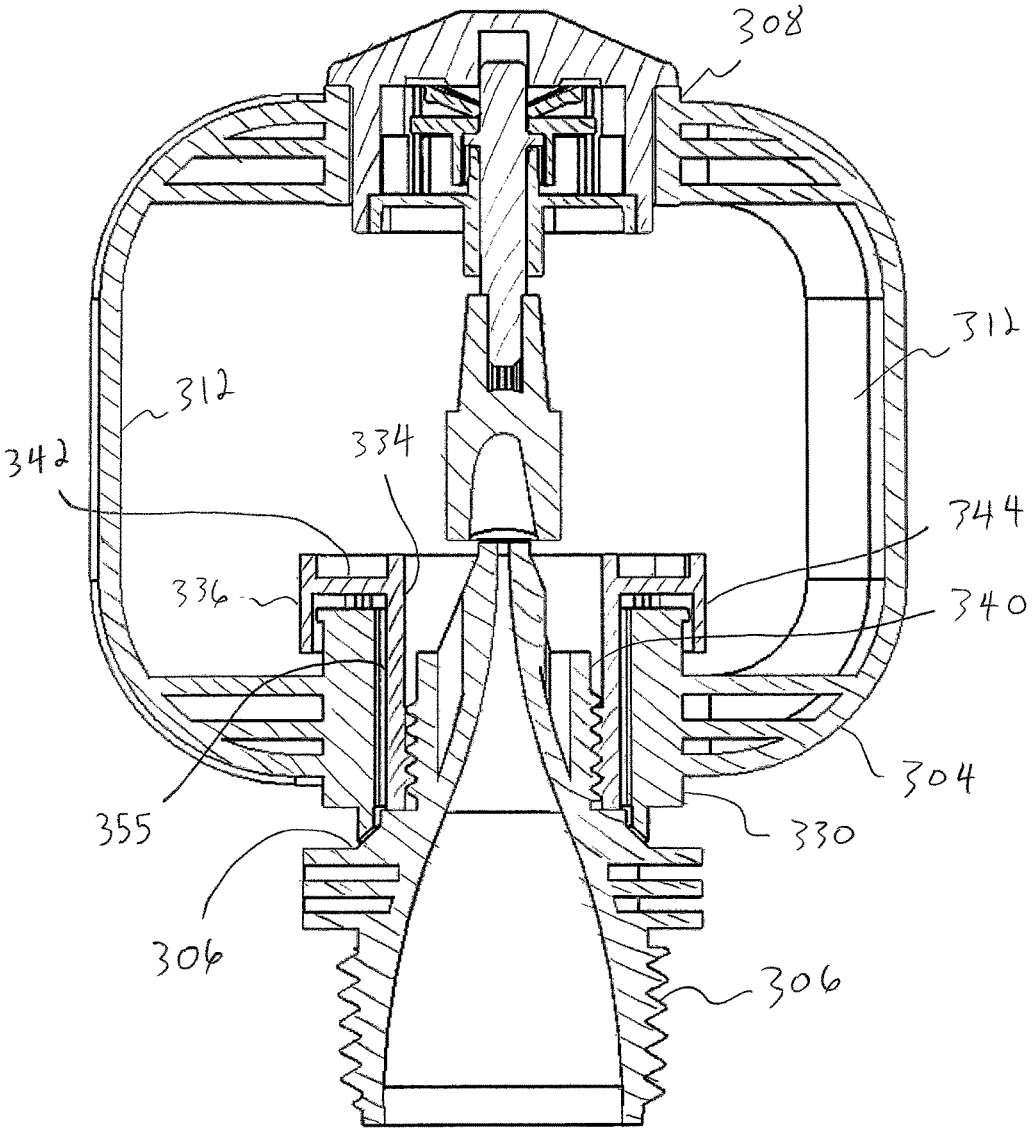
FIG. 26 is a cross-sectional view taken along line 26-26 in FIG. 24.
Figure 27:
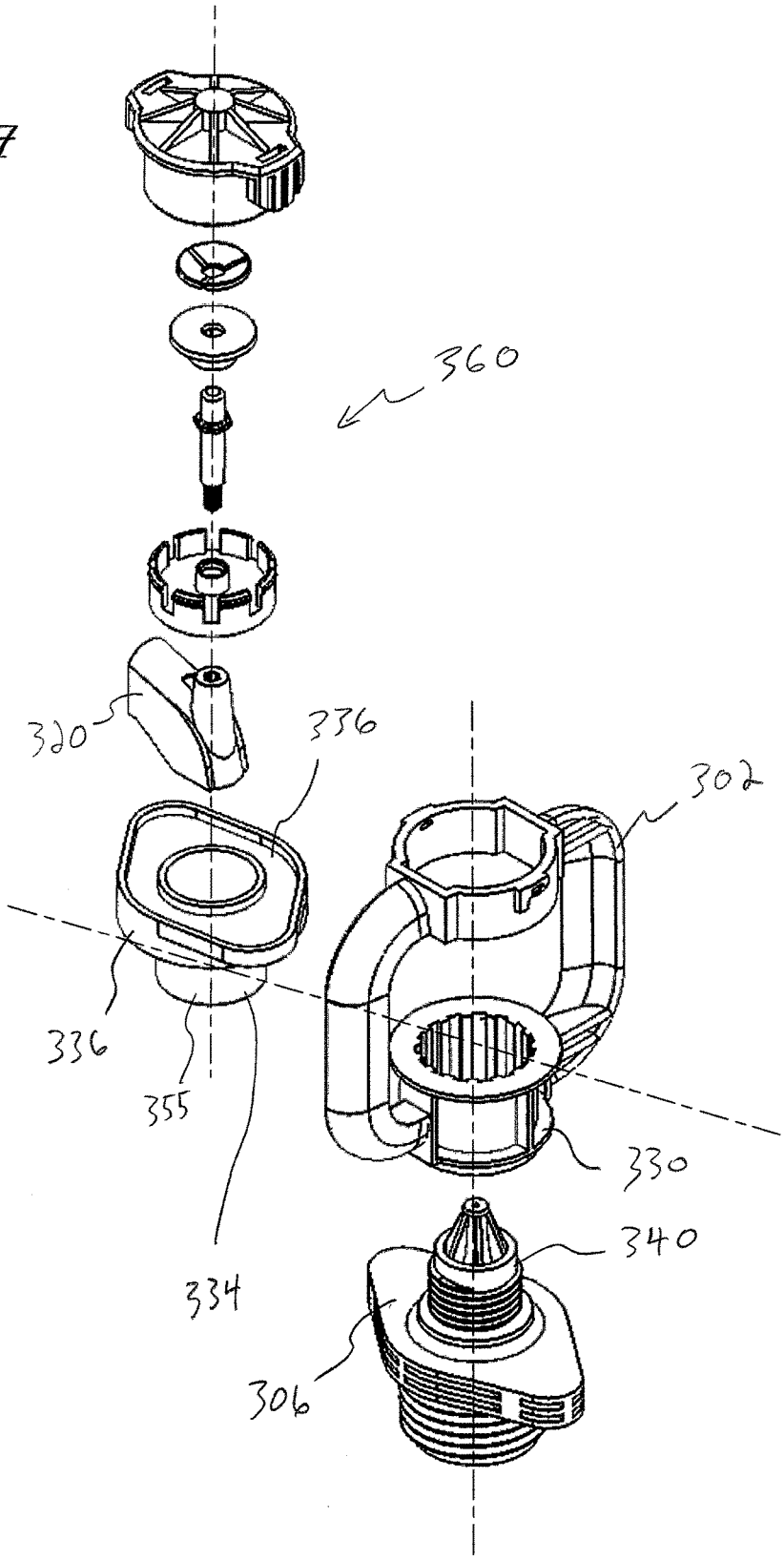
FIG. 27 is an exploded view of the rotary sprinkler of FIG. 24.

With reference to FIGS. 22 and 23, a sprinkler 200 is shown that is similar to the sprinkler 10. The sprinkler 200, however, has a nozzle 210 integrally formed with a frame 212 of the sprinkler 200, rather than the removable nozzle 20 of the sprinkler 10. The sprinkler 200 may cost less to manufacture and be desirable over the sprinkler 10 in certain applications, such as when a removable nozzle 20 is not needed.

With reference to FIGS. 24-29, another sprinkler 300 is shown. The sprinkler 300 is similar in many respects to the sprinkler 10 such that differences between the two will be highlighted. One difference is that the sprinkler 300 includes a body 302 having a base portion 304 rotatably mounted on a nozzle 306, a support portion 308 to which a spinner assembly 310 is connected, and arms 312 connecting the base portion 304 to the support portion 308. The body 302 and spinner assembly 310 can thereby rotate relative to the nozzle 304 during use, whereas the frame 14 and spinner assembly 15 of sprinkler 10 are generally stationary during use. Because the body 300 can rotate about the nozzle 306, fluid flow from a deflector 320 of the spinner assembly 310 strikes the arms 312 and causes the body 302 to rotate incrementally a short distance about the nozzle 306. This incremental rotation of body 302 moves the arms 312 to a different position each time the deflector 320 travels by the arms 312 which continually moves the spray shadow produced by the arms 312. In this manner, the sprinkler 300 has an uninterrupted spray pattern over time.

More specifically, the body base portion 304 includes a collar 330 with an opening 332 sized to fit over a neck 334 of a retention member such as a nut 336. During assembly, the collar 330 is slid onto the neck 334 and the neck 334 is threaded onto an upstanding outer wall 340 of the nozzle 306. The nut 336 has a flange 342 and a sleeve 344 that capture the collar 330 on the nozzle 306 between the flange 342 and a support 350 of the nozzle 306. Further, the nut 336 has wings 354 that may be grasped and used to tighten the nut 336 onto the nozzle 306.

The collar 330 has internal teeth 351 with grooves 353 therebetween and the neck 334 of the nut 336 has a smooth outer surface 355. When the body 302 rotates relative to the nut 336 and the nozzle 306, the teeth 351 slide about the outer surface 355. The grooves 353 direct dirt and debris caught between the body 302 and the nut 336 downward and outward from the connection between the body 302 and the nut 336. This keeps dirt and debris from gumming up the connection and keeps the body 302 rotatable on the nut 336.

Figure 28:
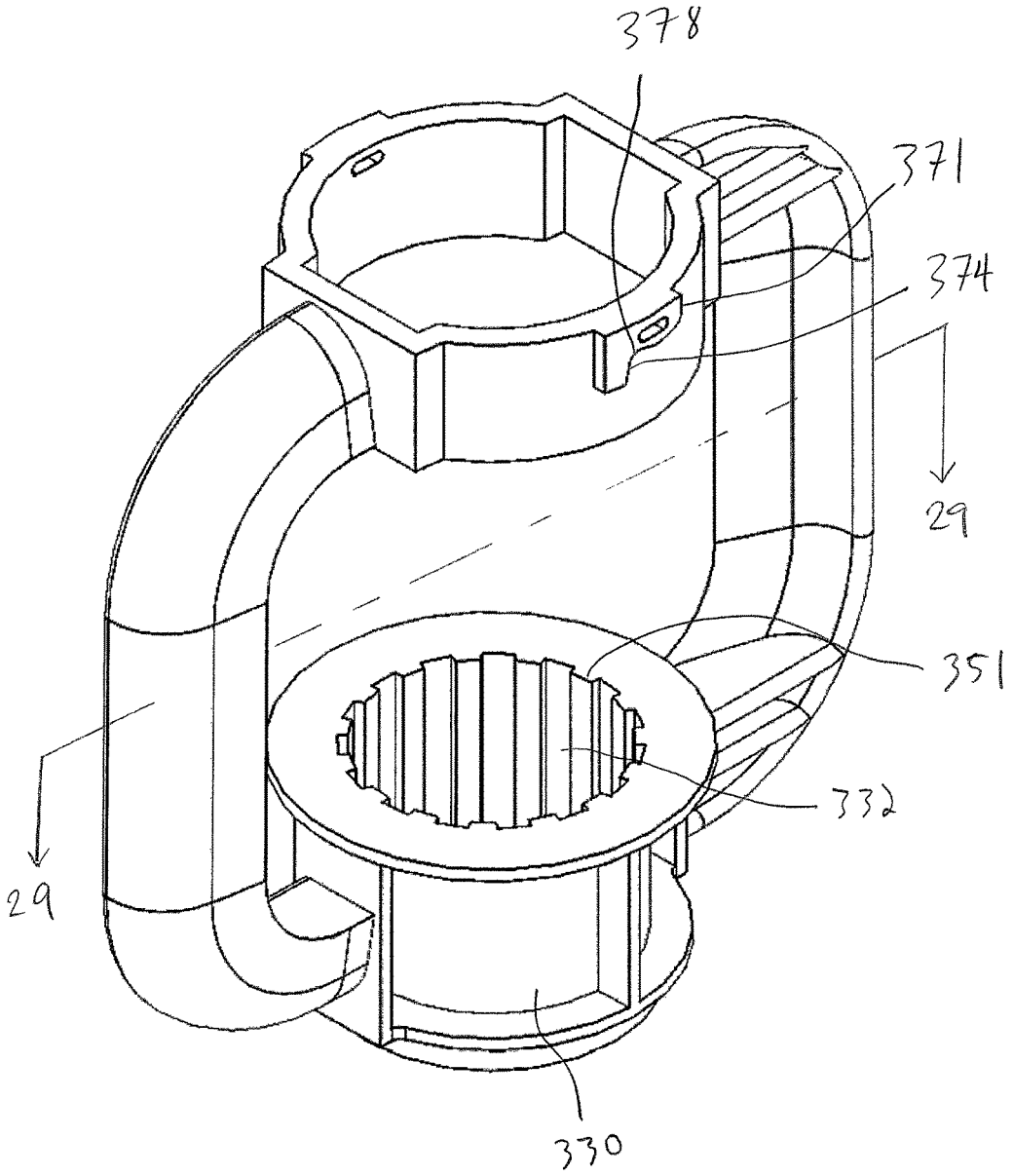
FIG. 28 is a perspective view of a frame of the rotary sprinkler of FIG. 24.
Figure 28A:
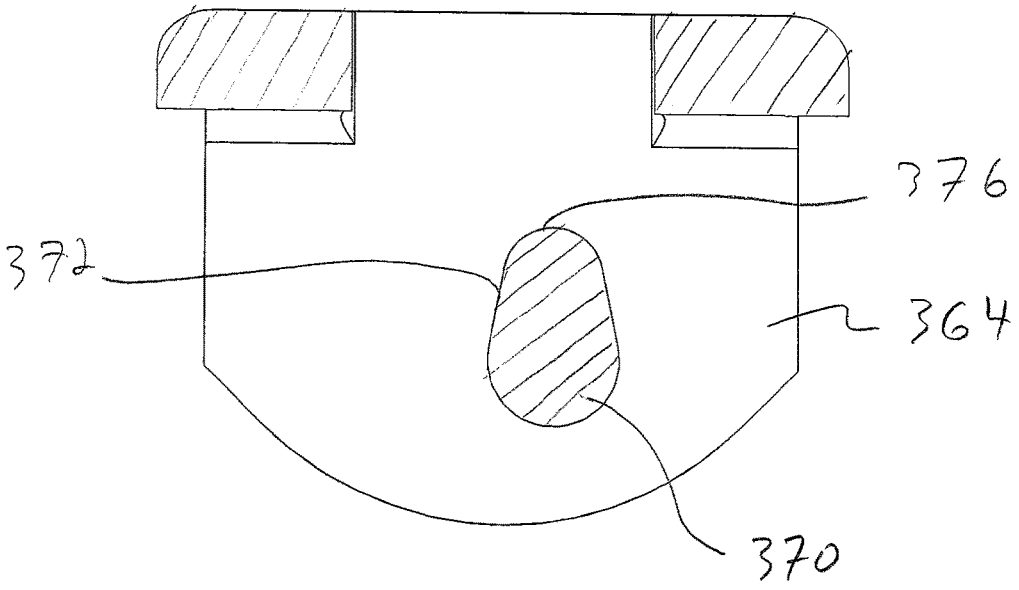
FIG. 28A is a cross-sectional view taken across line 28A-28A in FIG. 24.

With reference to FIGS. 28 and 28A, the spinner assembly 310 includes a brake device 360 releasably connected to the body support portion 308 in a manner similar to the brake device 24 and frame upper portion 16. However, the brake device 360 includes a cap 362 with depending tabs 364 having different coupling features than the tabs 72. The tabs 364 have rounded members 370 that engage coupling members 371 of the body support portion 308 and restrict longitudinal and rotational movement of the brake device cap 362. More specifically, the tab rounded member 370 has an inclined outer surface 372 that is rotated into engagement with inclined surface 374 of the coupling member 371, in a manner similar to turning the brake cap 54 to lock the cap 54 to the frame upper portion 16. The tab rounded member 370 also has a convex surface 376 which engages a concave surface 378 of the coupling member 371. The engagement of the surfaces 372, 374 and 376, 378 restricts rotary and longitudinal movement of the cap 362 away from its locked position. However, it will be appreciated that the sprinkler 300 could alternatively utilize the locking mechanisms of sprinkler 10.

Figure 29:
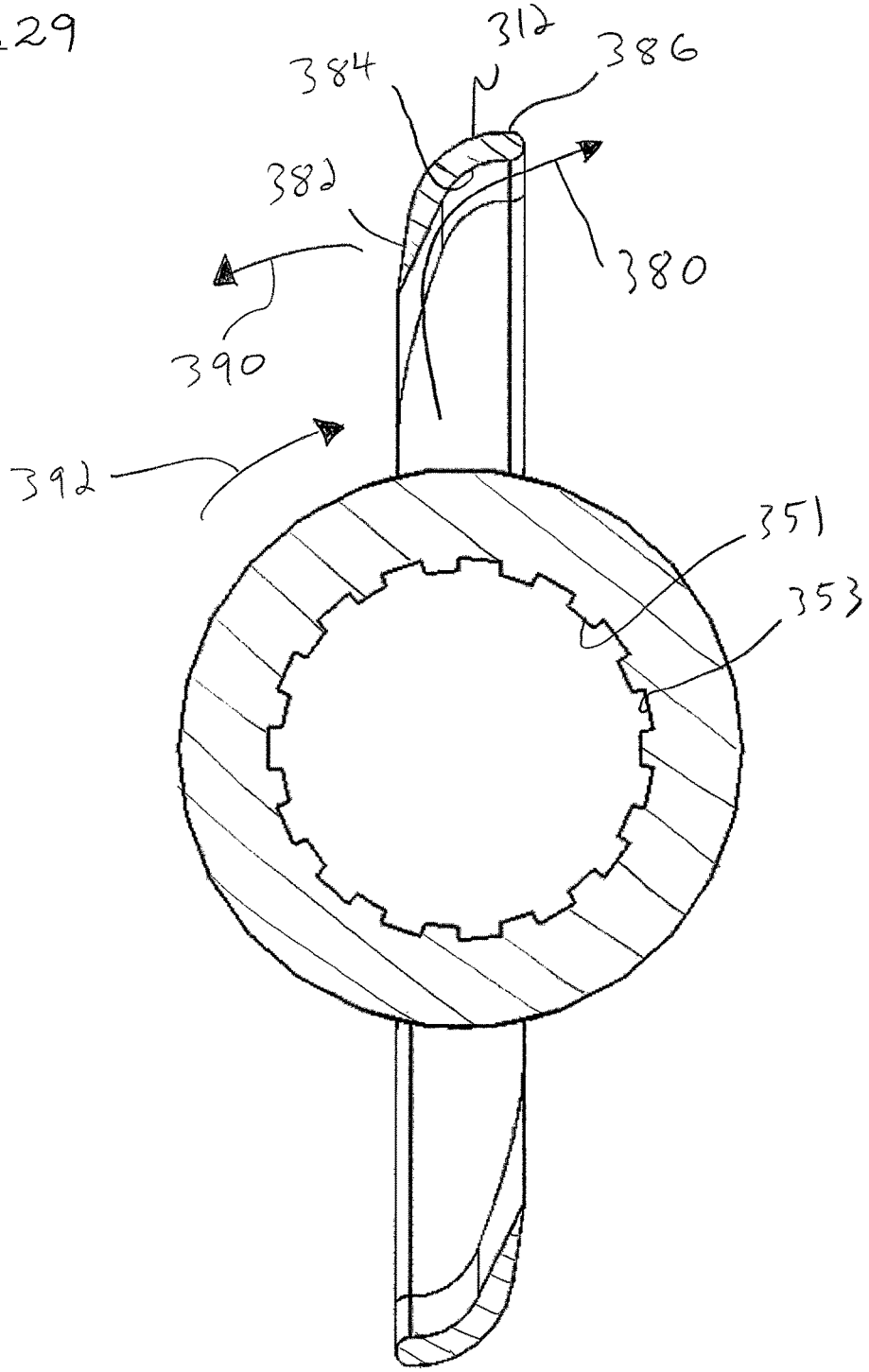
FIG. 29 is a cross-sectional view taken along line 29-29 of FIG. 28 showing the cross-sectional shape of arms of the frame.
Figure 30:
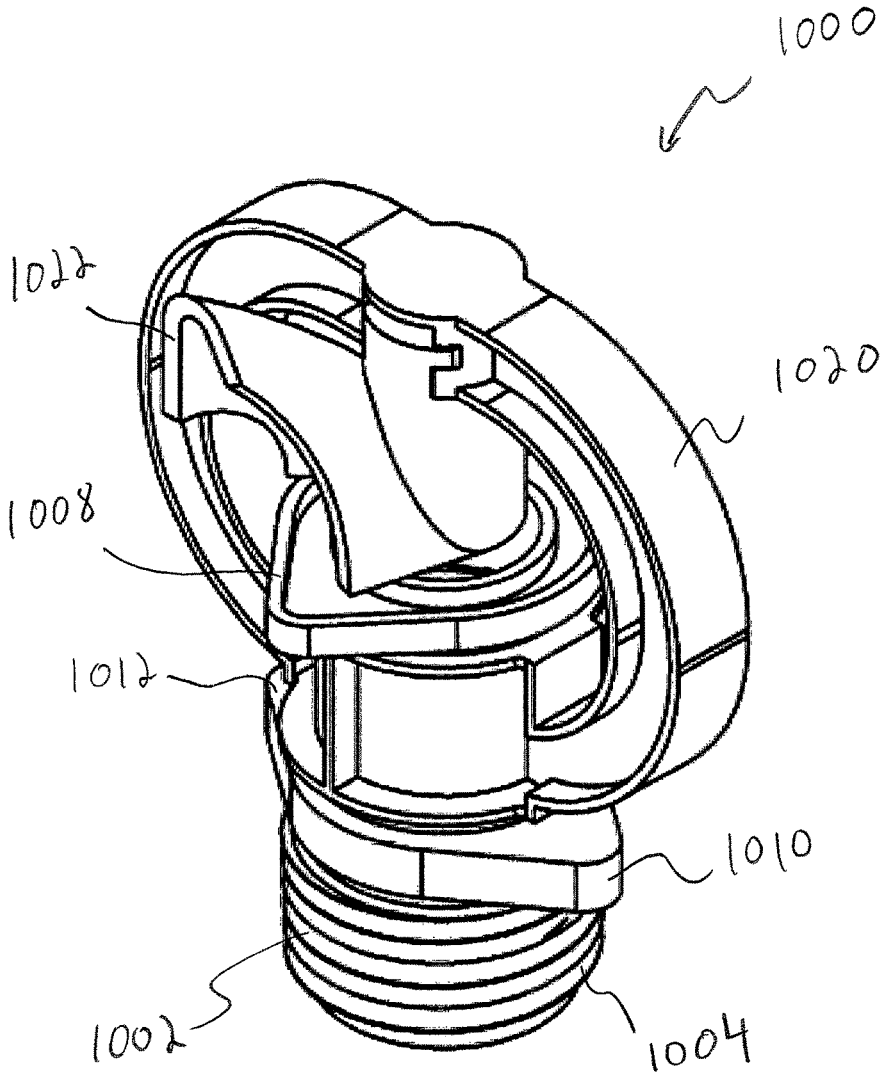
FIG. 30 is a perspective view of another rotary sprinkler.
Figure 31:
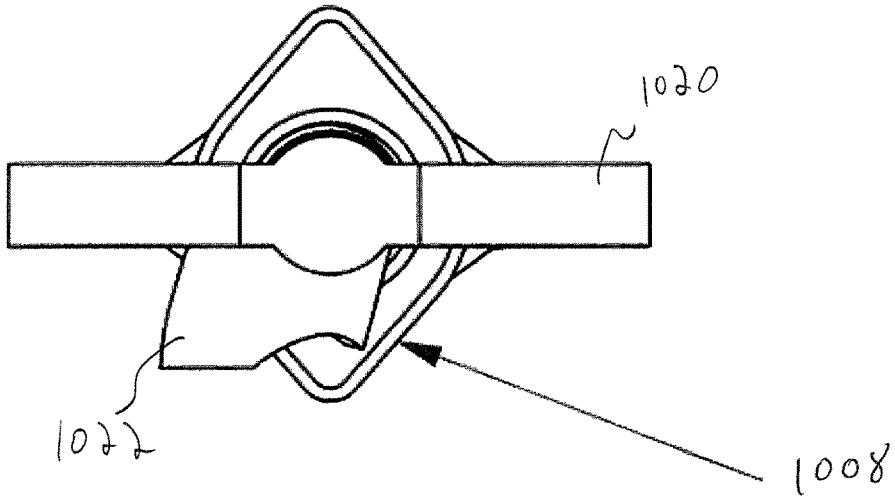
FIG. 31 is a top plan view of the rotary sprinkler of FIG. 30.
Figure 32:
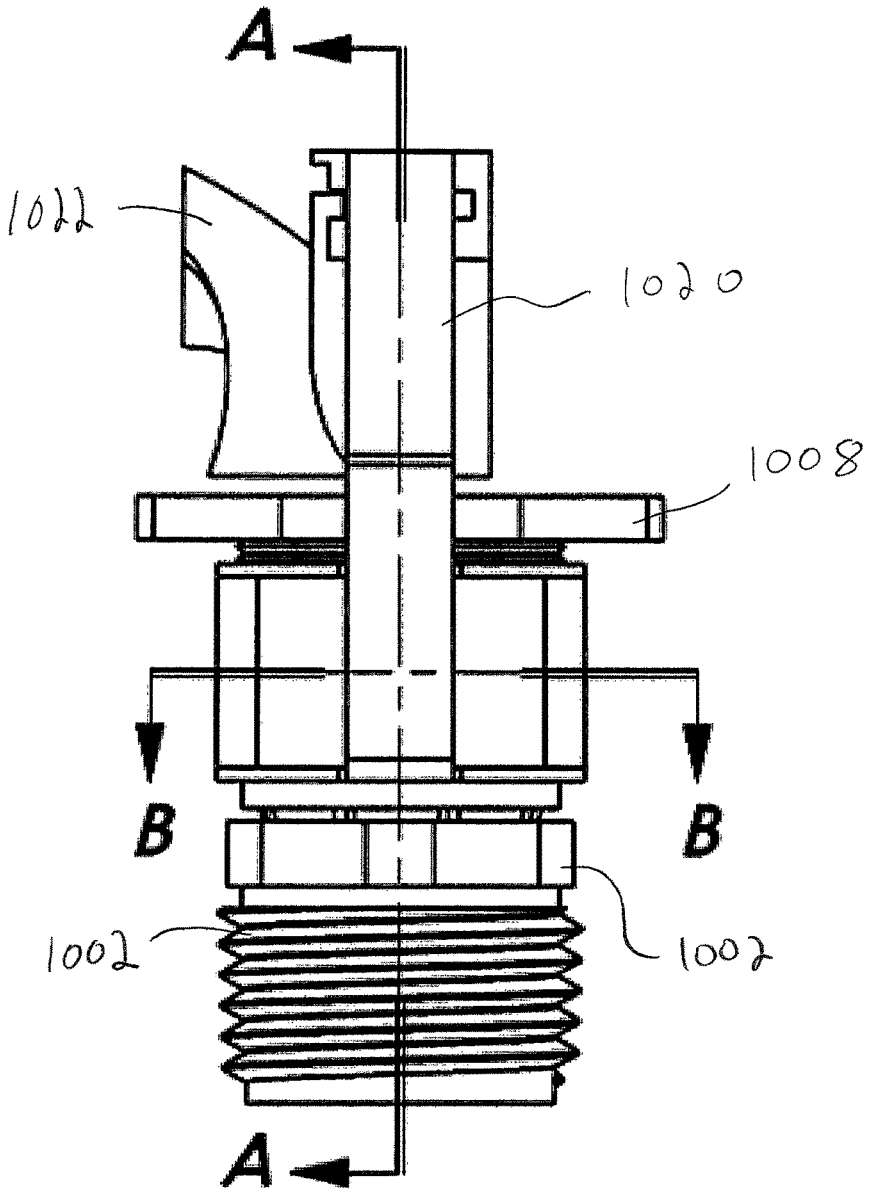
FIG. 32 is a side elevational view of the of the rotary sprinkler of FIG. 30.
Figure 33:
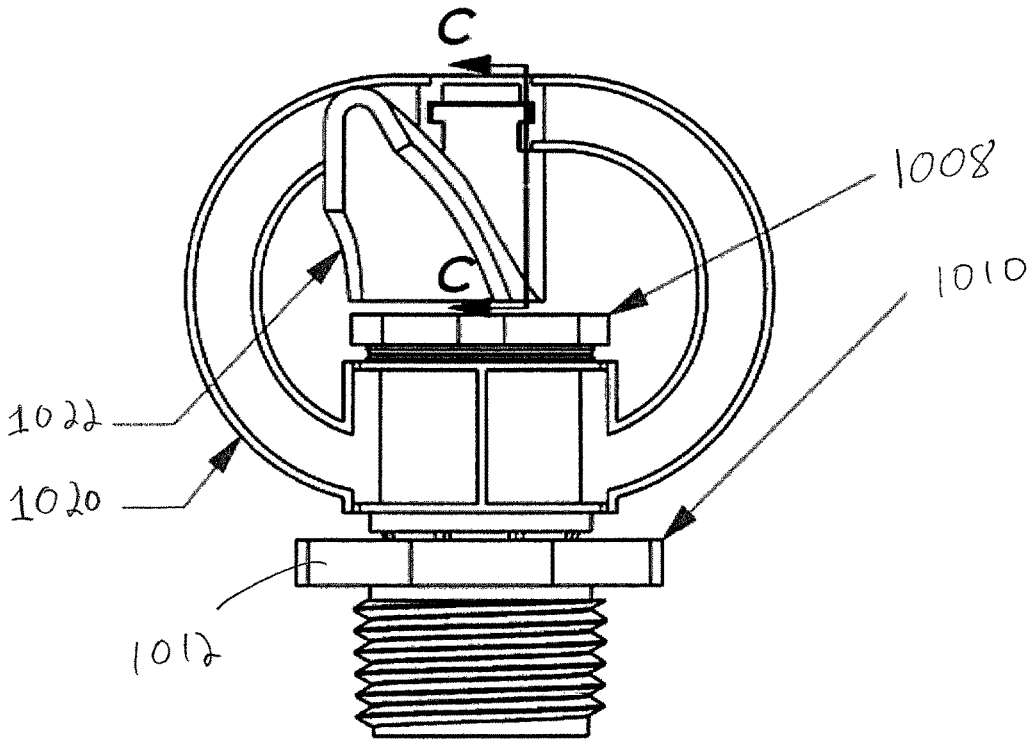
FIG. 33 is a is a front elevational view of the of the rotary sprinkler of FIG. 30.
Figure 34:
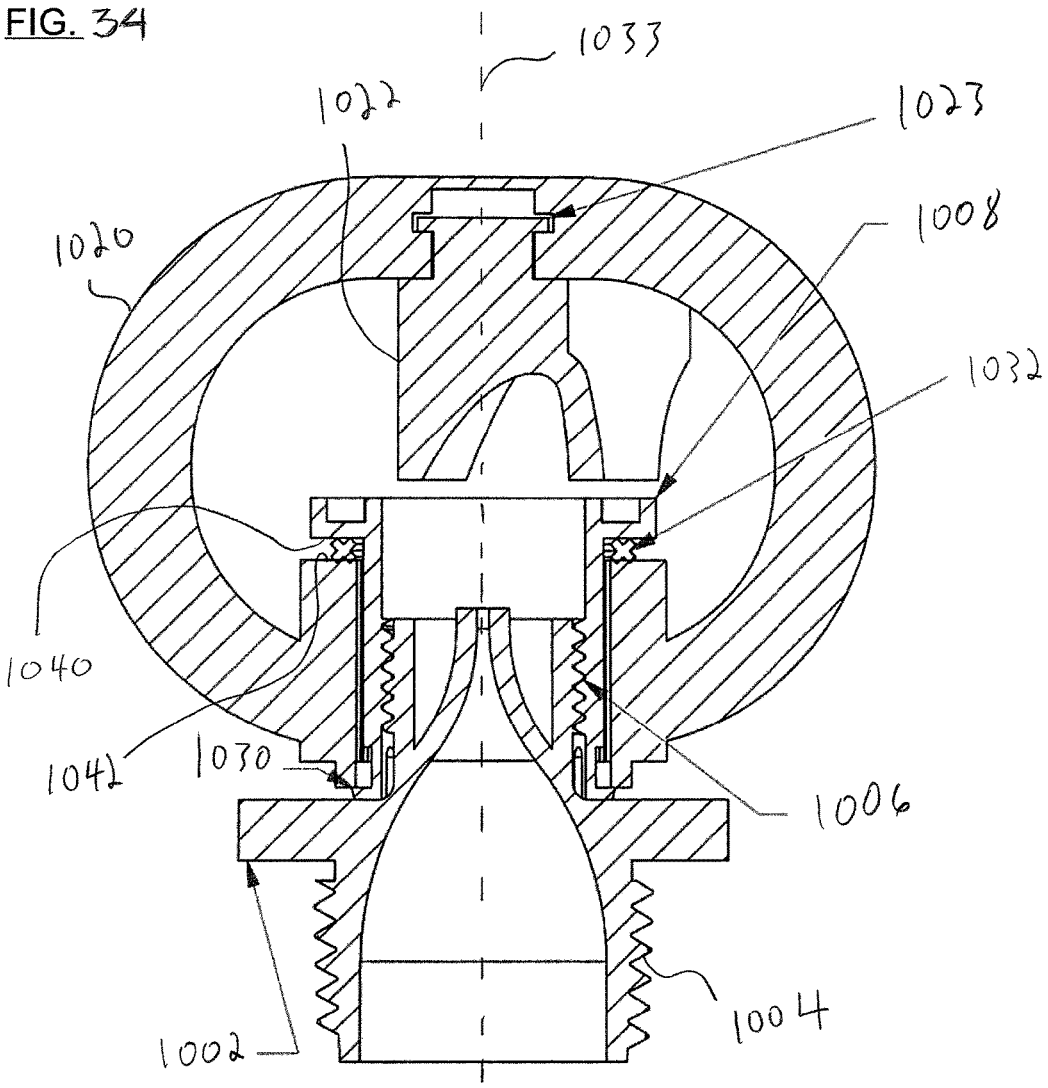
FIG. 34 is a cross-sectional view taken along line A-A in FIG. 32.
Figure 35:
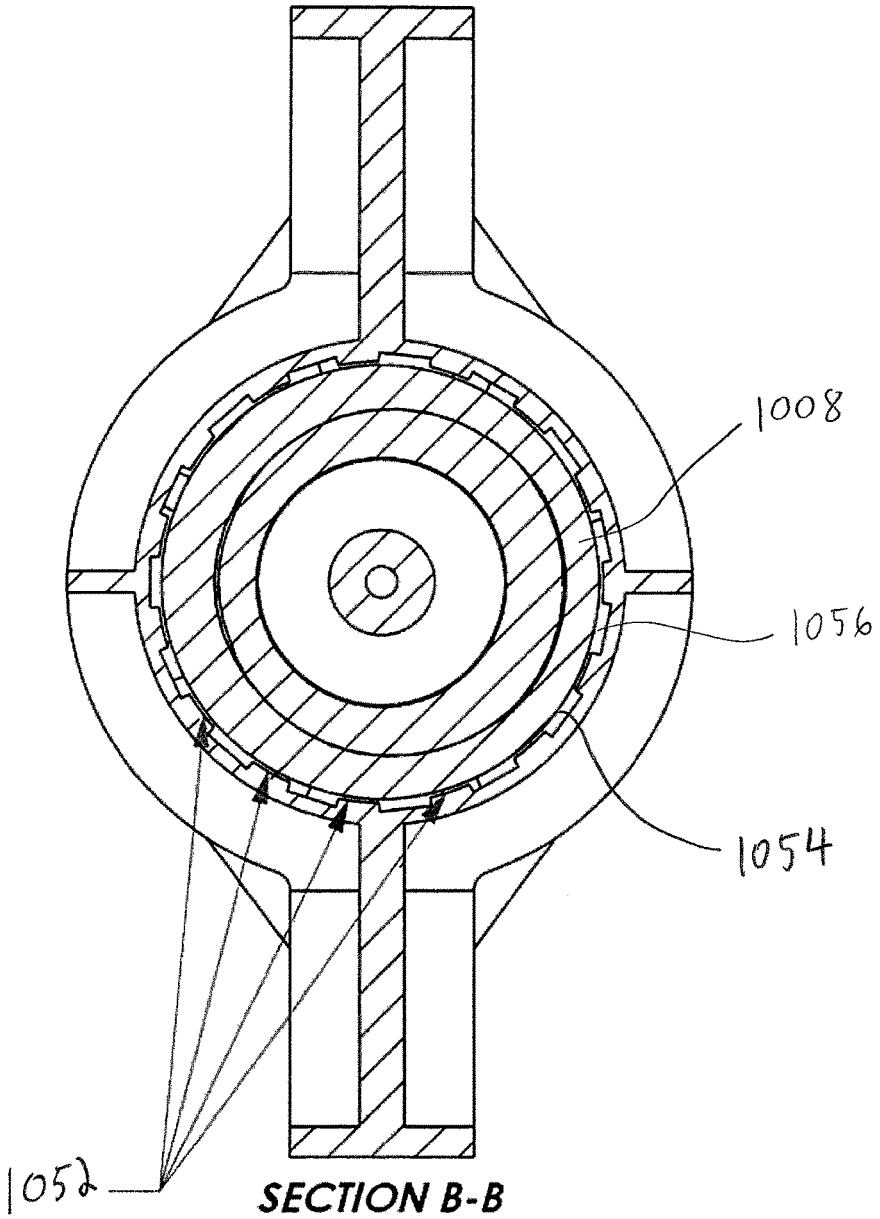
FIG. 35 is a cross-sectional view taken along line B-B in FIG. 32.
Figure 36:
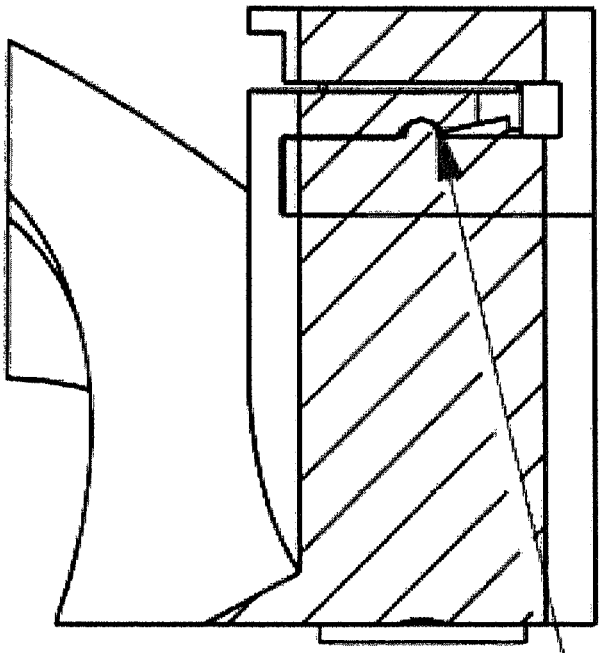
FIG. 36 is a cross-sectional view taken along line C-C in FIG. 33.

Another difference between the sprinklers 10, 300 is that the sprinkler 300 has arms 312 with cross-sections shaped to produce rotary movement of the arms 312 in response to fluid striking the arms 312. With reference to FIG. 29, water flow 380 from the deflector 320 travels toward an inner portion of the arm 312, strikes a curved intermediate surface 384, and is redirected outward from an outer portion 386 of the arm 312. The impact of the water flow 380 against the curved surface 384 imparts a force offset from the radial direction which creates a torque on the arm 312 and the body 302. This torque advances the body 312 in direction 390, which is generally opposite the direction of rotation of the deflector 320.

It will be appreciated that the fluid stream 380 strikes the arm 312 only momentarily before the rotation of the deflector 320 moves the fluid stream 380 out of alignment with the arm 312. Eventually, the fluid stream 380 strikes the other arm and a similar torque is applied to further incrementally rotate the body 302 and arms 312. Thus, the deflector 320 moves at a generally constant speed (due at least in part to brake assembly 360) in direction 392 while the body 302 and arms 312 rotate intermittently and incrementally in direction 390 when the fluid stream 380 contacts either one of the arms 312.

With reference to FIGS. 30-36, a sprinkler 1000 is shown that is similar in a number of ways to the sprinkler 300 of FIGS. 24-29. The sprinkler 1000 has a nozzle 1002 with a lower threaded portion 1004 for mounting to a water supply line and an upper threaded portion 1006 for engaging a retention member such as a nipple 1008. The nozzle 1002 has two protuberances 1010, 1012 that can be used to hand tighten/loosen the sprinkler 1000.

The sprinkler 1000 is different from the sprinkler 300 in that the sprinkler 1000 has a rotator 1020 with a stationary deflector 1022 mounted thereon. The sprinkler includes a snap-in feature 1023 that releasably connects the deflector 1022 to the rotator 1020. The deflector 1022 diverts a jet of water from the nozzle 1002 and redirects it at two angles. One angle turns the stream from vertical to horizontal and spreads the jet for even watering. As discussed below, redirecting the stream imparts a vertical force to the deflector 1022 which causes the rotator 1020 to compress a brake 1032 and slow rotation of the rotator 1020. The deflector 1022 imparts a second angle channels the jet of water sideways creating a moment arm about an axis of rotation 1033 causing the rotator 1020 to turn clockwise (as viewed from above the sprinkler 1000). The shapes and configurations of the nozzle 1002 and deflector 1022 can be varied to produce different throw distances and volumes.

The nipple 1008 has clips 1030 that are configured to permit the brake 1032 and the rotator 1020 to be pressed onto the nipple 1008. However, once the brake 1032 and the rotator 1020 are mounted on the nipple 1008, the clips 1030 restrict the brake 1032 and the rotator 1020 from sliding off of the nipple 1008 even if the nozzle 1002 has been removed from the nipple 1008.

The brake 1032 is a compactable rubber dual-contact O-ring which when compressed will result in an increased frictional force which keeps the rotator 1020 from rotating ever faster. When water from the nozzle 1002 strikes the deflector 1022, the impact force from the water shifts the rotator 1020 away from the nozzle 1002 and causes the rotator 1020 to compress the brake 1032 between brake surfaces 1040, 1042 of the rotator 1020 and nipple 1008.

The rotator 1020 has a collar 1050 with internal teeth 1052 that slide along a smooth outer surface 1054 of the nipple 1008. The teeth 1052 direct dirt and other debris along grooves 1056 between teeth 1052 and outward from the connection between the rotator 1020 and the nipple 1008. This reduces the likelihood of the sprinkler 1000 stalling due to debris gumming up the connection between the rotator 1020 and the nipple 1008.

Figure 46:
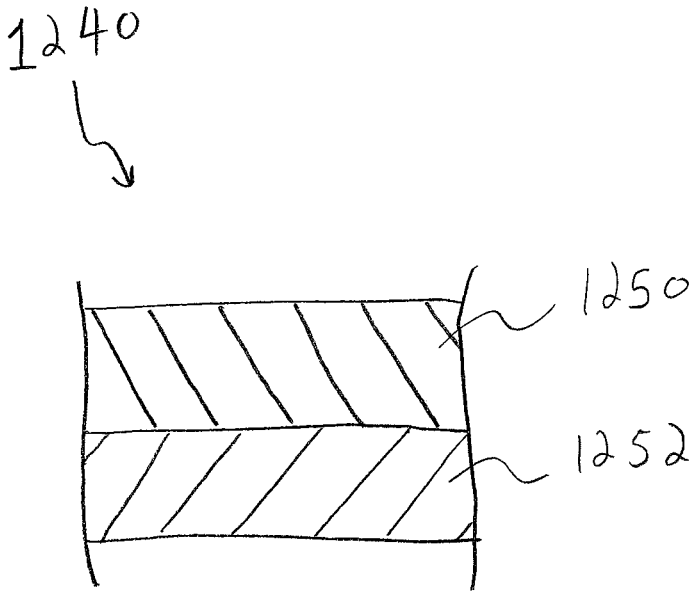
FIG. 46 is a cross-sectional view of the coil.
Figure 47:
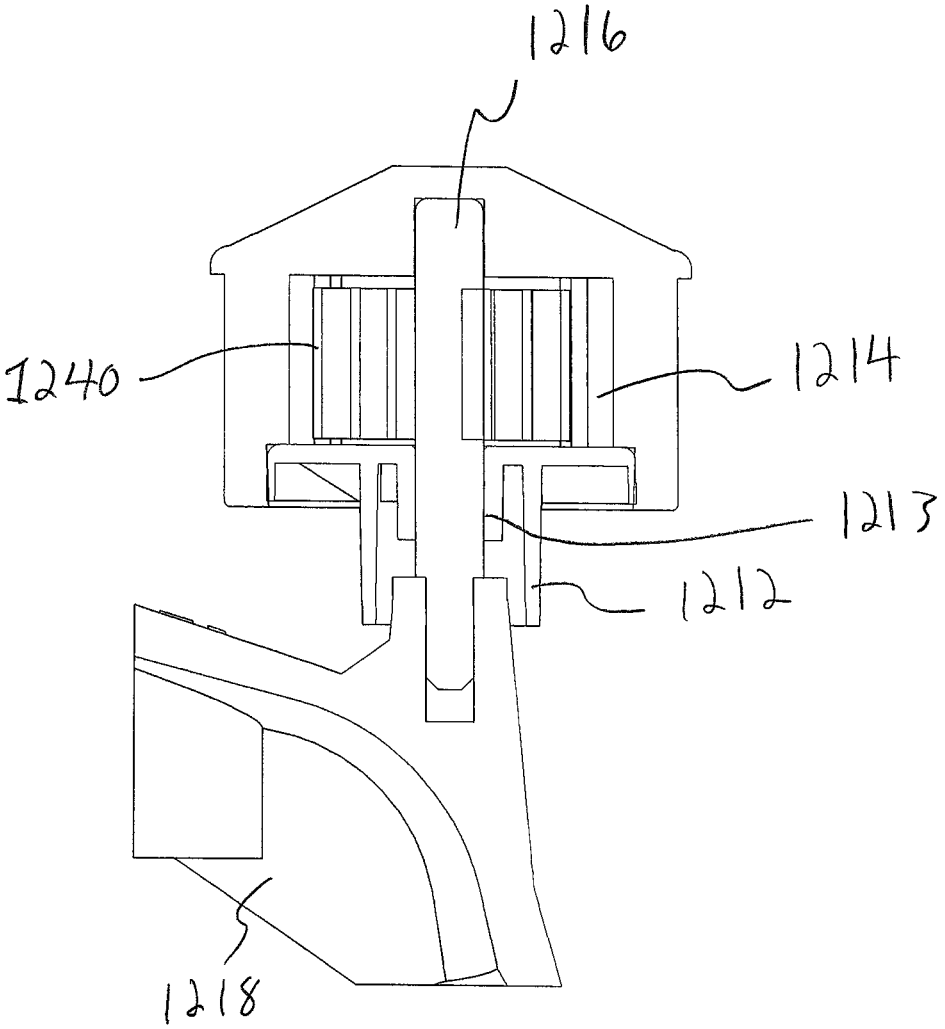
FIG. 47 is a partial cross-sectional view taken across line 47-47 in FIG. 40.

With reference to FIGS. 40-47, a sprinkler 1200 having a brake assembly 1202 that is responsive to environmental conditions is shown. The sprinkler 1200 is substantially similar to the sprinkler 10 discussed above such that differences between the two will be highlighted. The brake assembly 1202 has a cap 1204 that forms a sealed chamber 1210 in conjunction with a brake base member 1212, as shown in FIG. 47. The chamber 1210 houses a fluid 1214 and a brake shaft 1216 connected to a deflector 1218 of the sprinkler 1200. The chamber 1210 can include a seal between the brake shaft 1216 and a shaft bearing surface 1213 of the brake base member 1212 to seal the fluid 1214 within the chamber 1210, as shown in FIG. 47.

Figure 41:
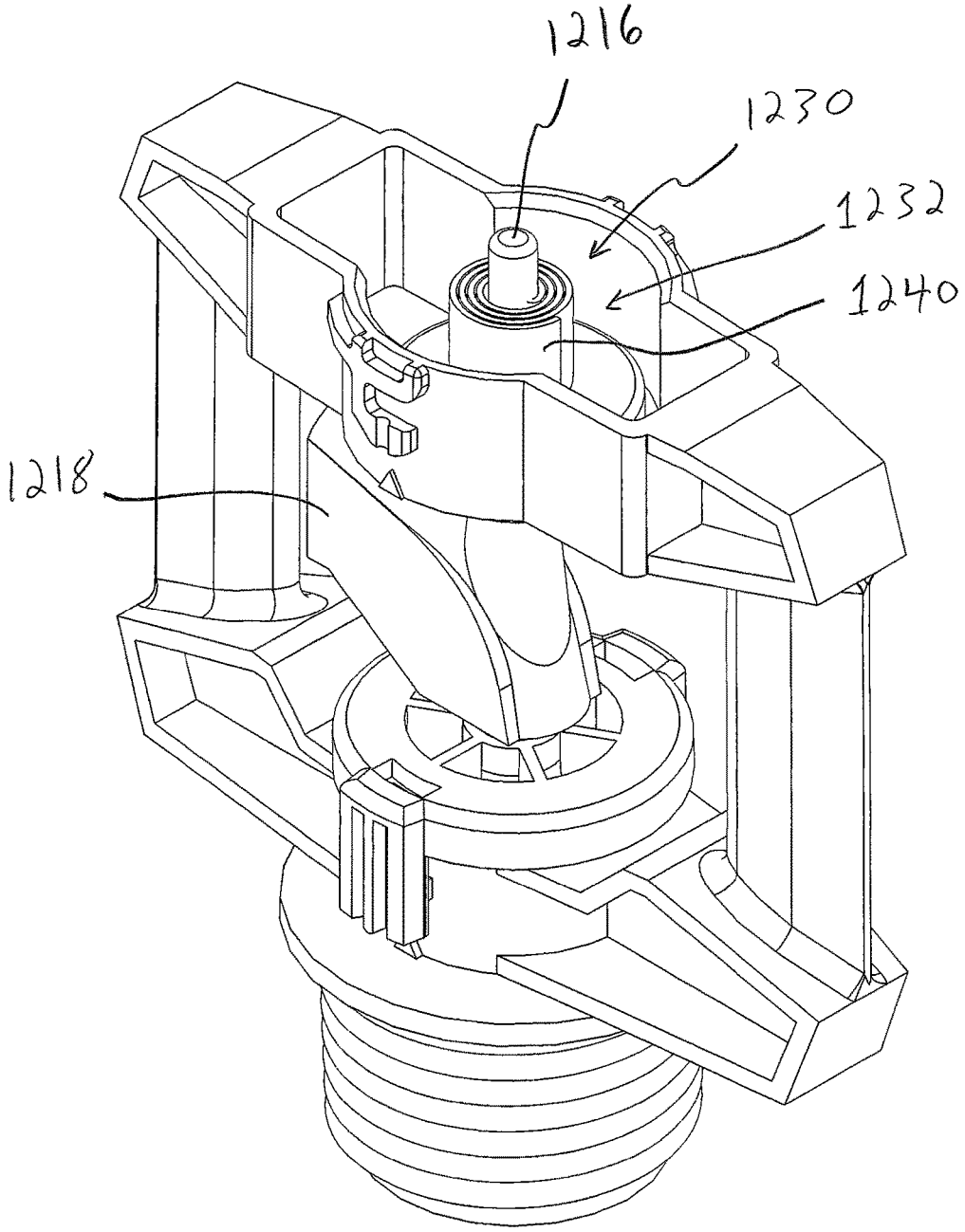
FIG. 41 is a perspective view of the sprinkler of FIG. 40 with a cap of a brake assembly of the sprinkler removed.

With reference to FIG. 41, the cap 1204 is removed to show a brake rotor 1230 of the brake assembly 1202. The brake rotor 1230 includes a reactive brake device 1232 that is configured to change the braking force applied to the deflector brake shaft 1216 in response to changes to the environment in which the sprinkler 1200 is located. For example, the reactive brake device 1232 may include a bi-material coil 1240 that has two sheets of material laminated together. With reference to FIG. 46, a cross-section of the coil 1240 is shown. The coil 1240 includes an active component 1250 having a higher coefficient of thermal expansion and a passive component 1252 having a lower coefficient of thermal expansion. As the environmental temperature increases, the active component 1250 expands more than the passive component 1252 such that the coil 1240 expands.

Figure 42:
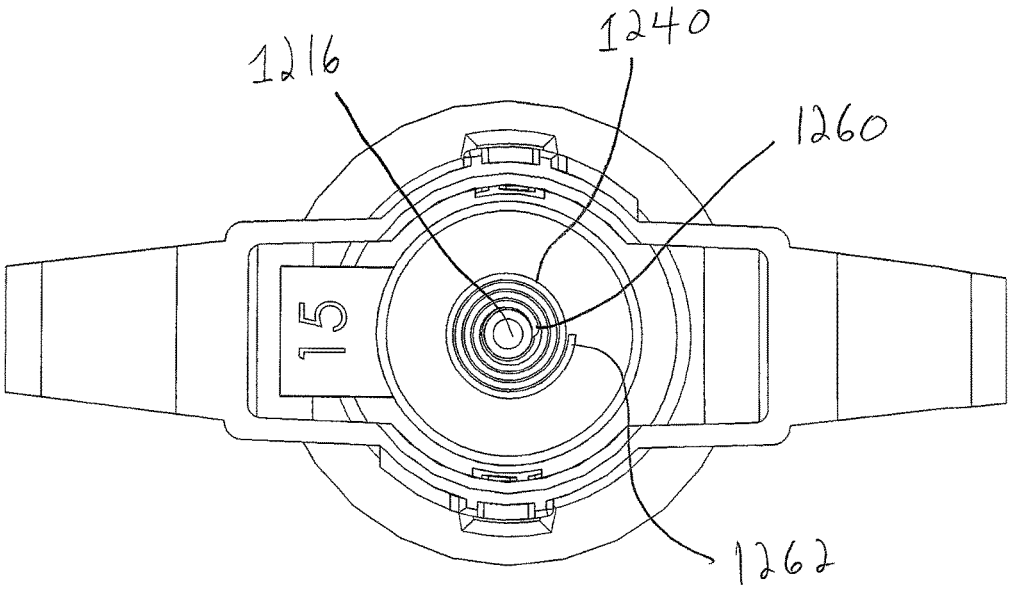
FIG. 42 is a top plan view of the sprinkler of FIG. 41 showing a coil of the brake assembly.
Figure 43:
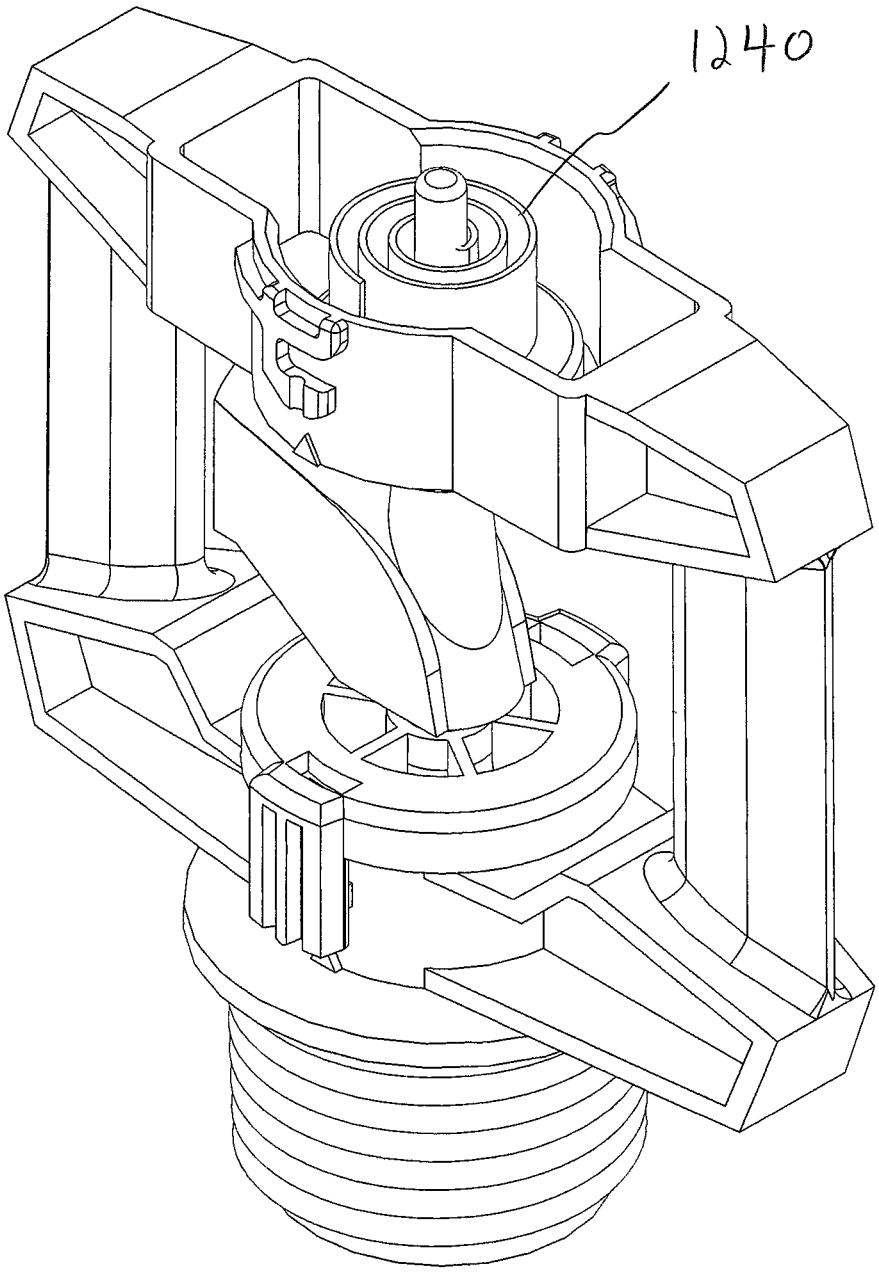
FIG. 43 is a perspective view similar to FIG. 41 showing the coil in an expanded configuration.
Figure 44:
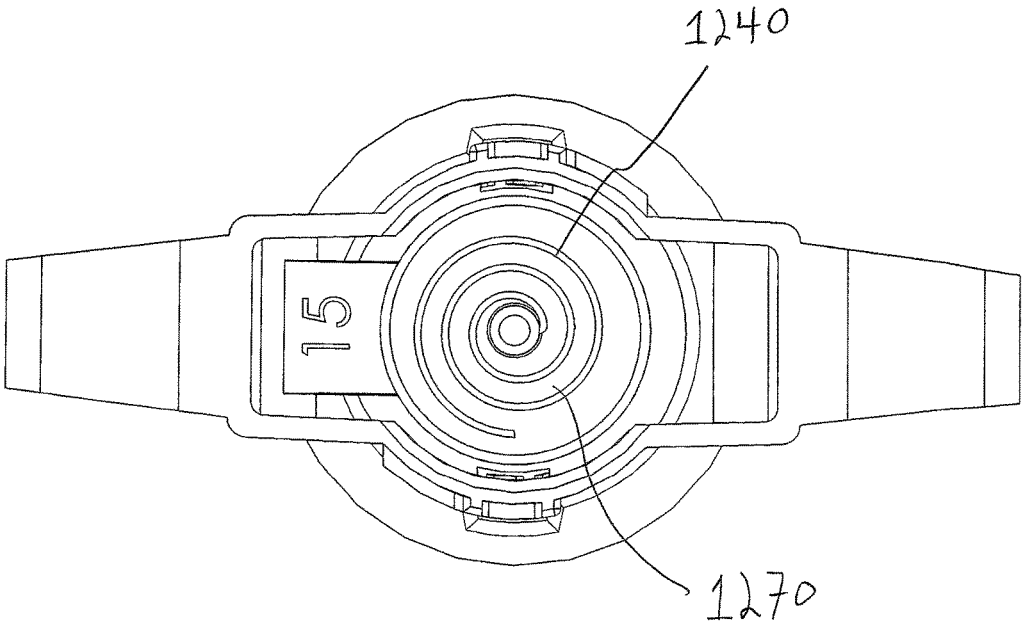
FIG. 44 is a top plan view of the sprinkler of FIG. 43.
Figure 45:
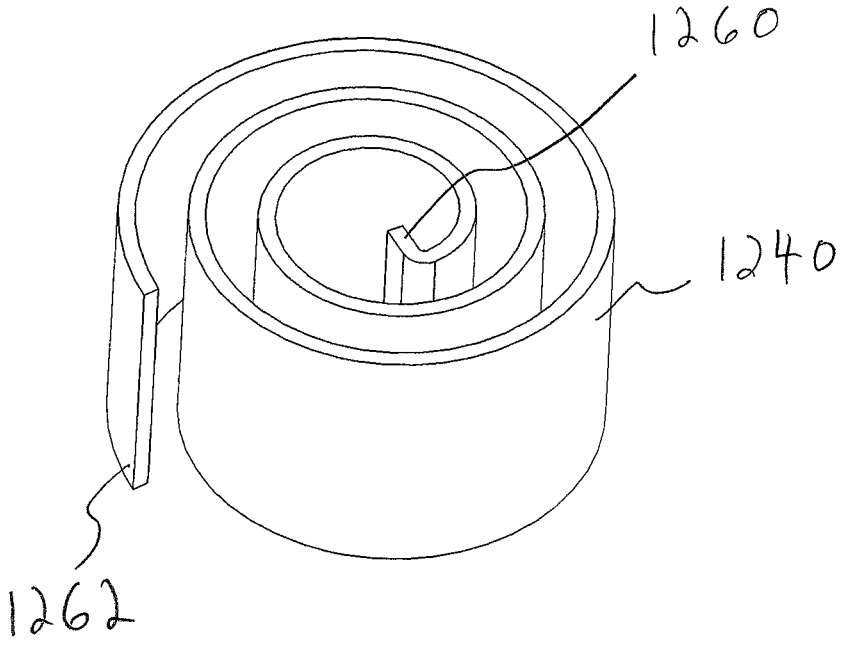
FIG. 45 is a perspective view of the coil of the brake assembly.

With reference to FIGS. 41 and 42, the coil 1240 has a fixed end 1260 engaged in a slot of the brake shaft 1216, such as by welding, and a free end 1262 disposed radially outward from the fixed end 1260. With reference to FIGS. 41 and 42, the coil 1240 is shown in a fully contracted position at a low environmental temperature where the sections of the coil 1240 are in a tightly wrapped orientation around each other. With reference to FIGS. 43 and 44, the coil 1240 is shown in a fully expanded configuration at an elevated temperature. When the coil 1240 is in the expanded configuration, the winds of the coil 1240 are spaced apart by larger gaps 1270 than when the coil 1240 is at the low temperature.

The change in the coil 1240 from the fully contracted to the fully expanded configuration increases the resistant torque generated by the coil 1240 as the coil 1240 rotates within the fluid 1214. More specifically, the resistant torque generated by the expanded coil 1240 is higher than the torque generated by the contracted coil. This increase in torque tends to offset the decrease in the viscosity of the fluid 1214 due to the increase in environmental temperature. Thus, the coil 1240 can provide a more consistent torque and resulting speed of rotation of the deflector 1218 despite changes in the temperature of the surrounding environment.

Another impact of the change in the shape of the coil 1240 from the contracted expanded configuration is that the fully expanded coil has a larger moment of inertia than the contracted coil 1240. Stated differently, the coil 1240 is more difficult to turn when it is fully expanded than when it is fully contracted. This increase in the moment of inertia also helps to offset the decrease in viscosity of the fluid 1214 due to elevated environmental temperatures.

With reference to FIGS. 46 and 47, the fluid 1214 may be a silicone-based grease of a desired viscosity. For the active component 1250, metals or metal alloys with a high coefficient of thermal expansion may be used including non-ferrous metals such a copper, brass, aluminum, or nickel. For the passive component 1252, ferrous alloy such as stainless steel may be used.

Figure 48:
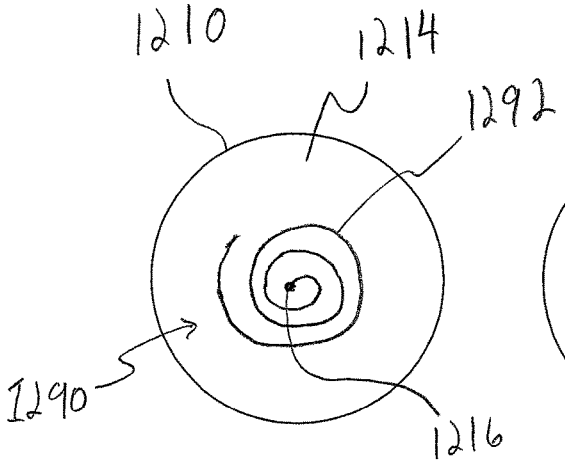
FIG. 48 is a schematic view of another coil showing the coil in a relaxed configuration.
Figure 49:
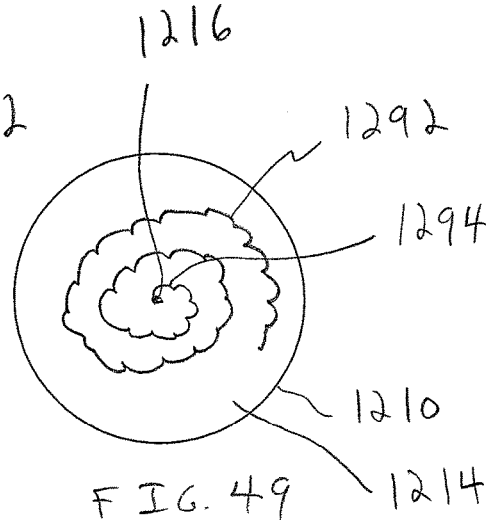
FIG. 49 is a schematic view of the coil of FIG. 48 showing the coil in a stressed configuration.

With reference to FIG. 48, another reactive brake device 1290 is shown including a coil 1292 having a fixed end 1294 connected to the brake shaft 1216. The coil 1292 is similar to the coil 1240, except that the coil 1292 has a relaxed configuration (see FIG. 48) and a stressed configuration (see FIG. 49) where the coil 1292 has an undulating shape. The undulating profile of the coil 1292 when the coil 1292 is in the stressed configuration increases the drag of the coil 1292 through the fluid 1214 in the brake chamber 1210.

Figure 50:
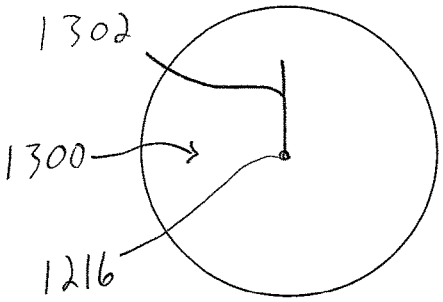
FIG. 50 is a schematic view of a beam extending outwardly from a brake shaft.
Figure 51:
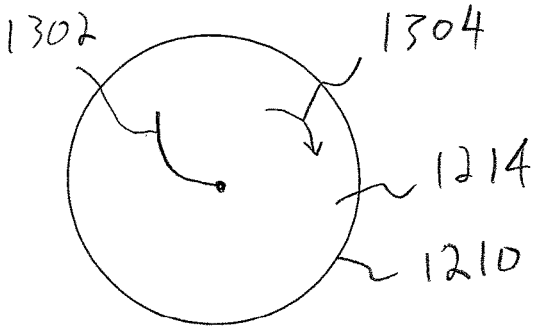
FIG. 51 is a schematic view similar to FIG. 50 showing the beam in a bent configuration.

With reference to FIGS. 50 and 51, another reactive brake device 1300 is shown. The reactive brake device 1300 includes a beam 1302 extending radially outward from the brake shaft 1216 when the reactive brake device 1300 is at a low environmental temperature. Increasing the temperature, however, causes the beam 1302 to bend, as shown in FIG. 51. The bent beam 1302 produces a higher amount of drag as the beam 1302 travels in direction 1304 within the fluid 1214 in the chamber 1210. Thus, the reactive brake device 1300 provides another approach for compensating for the decrease in viscosity of the fluid 1214 as the environmental temperature changes. Although only one beam 1302 is shown, the reactive brake device 1300 could include one, two, three, or more beams 1302 depending on the amount of resistance needed for a particular application.

Figure 52:
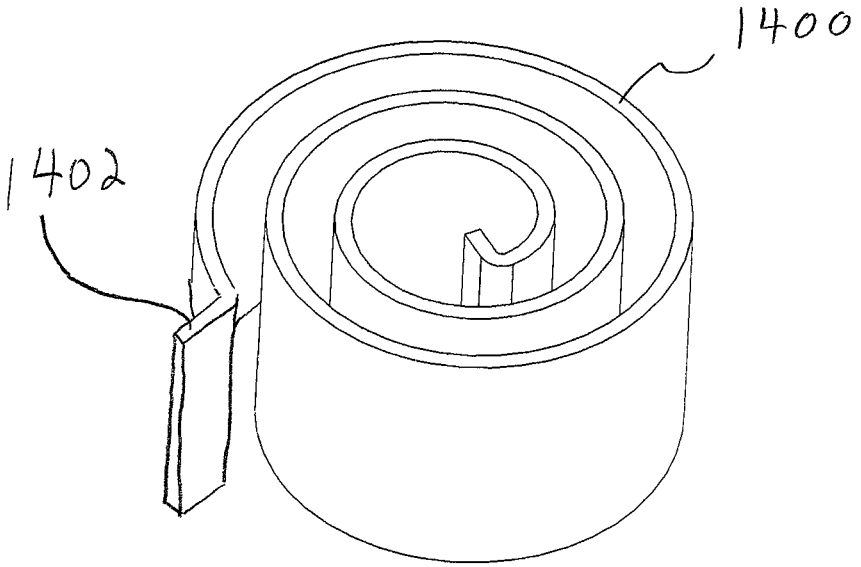
FIG. 52 is a perspective view of another coil having an outwardly projecting lip.

With reference to FIG. 52, another coil 1400 is shown. The coil 1400 is similar to the coil 1240 except that the coil 1400 has an outwardly projecting lip 1402 that can magnify the resistant torque generated by the expanded coil 1400.

Figure 53:
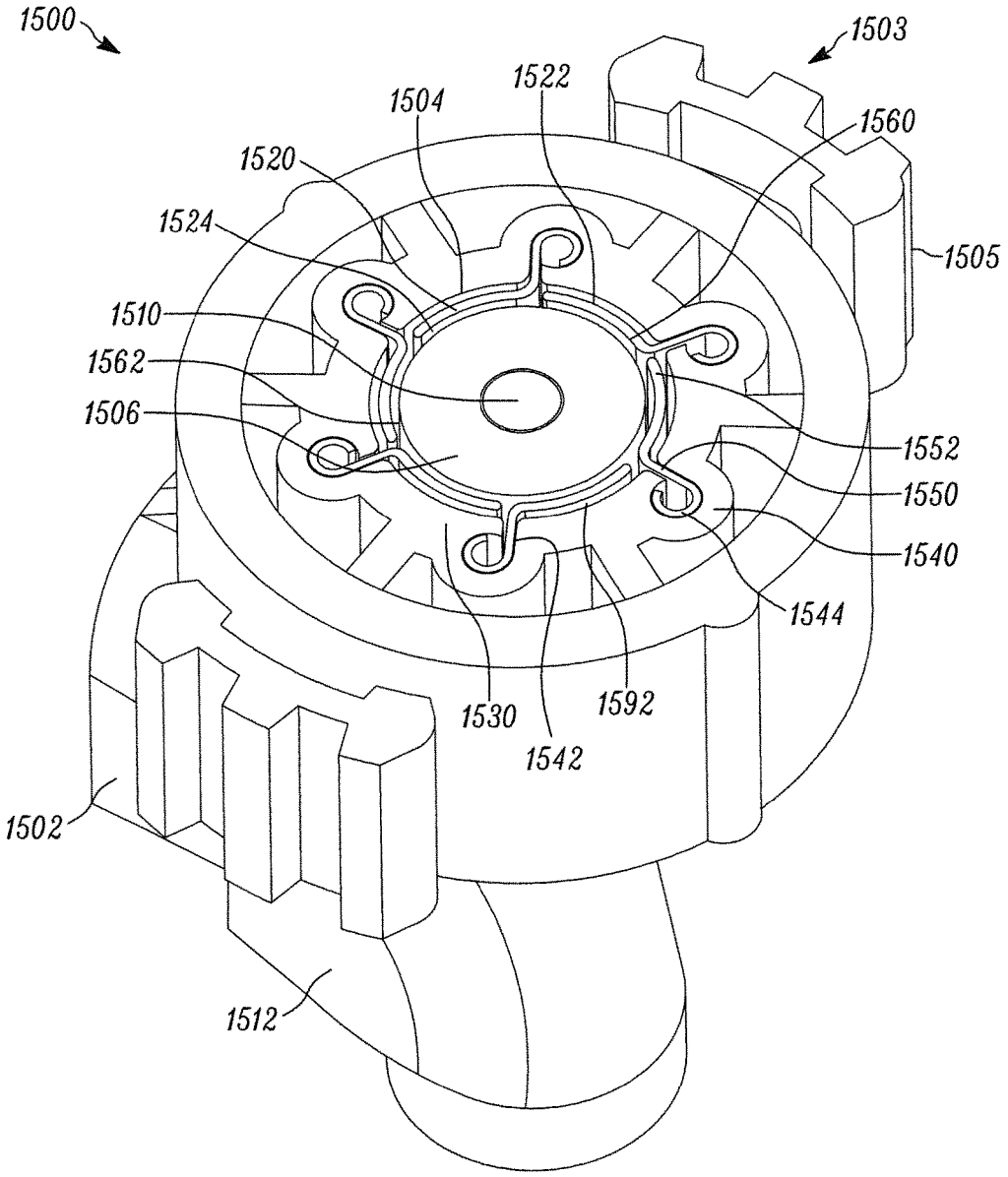
FIG. 53 is a perspective view of another brake assembly for a rotary sprinkler.
Figure 54:
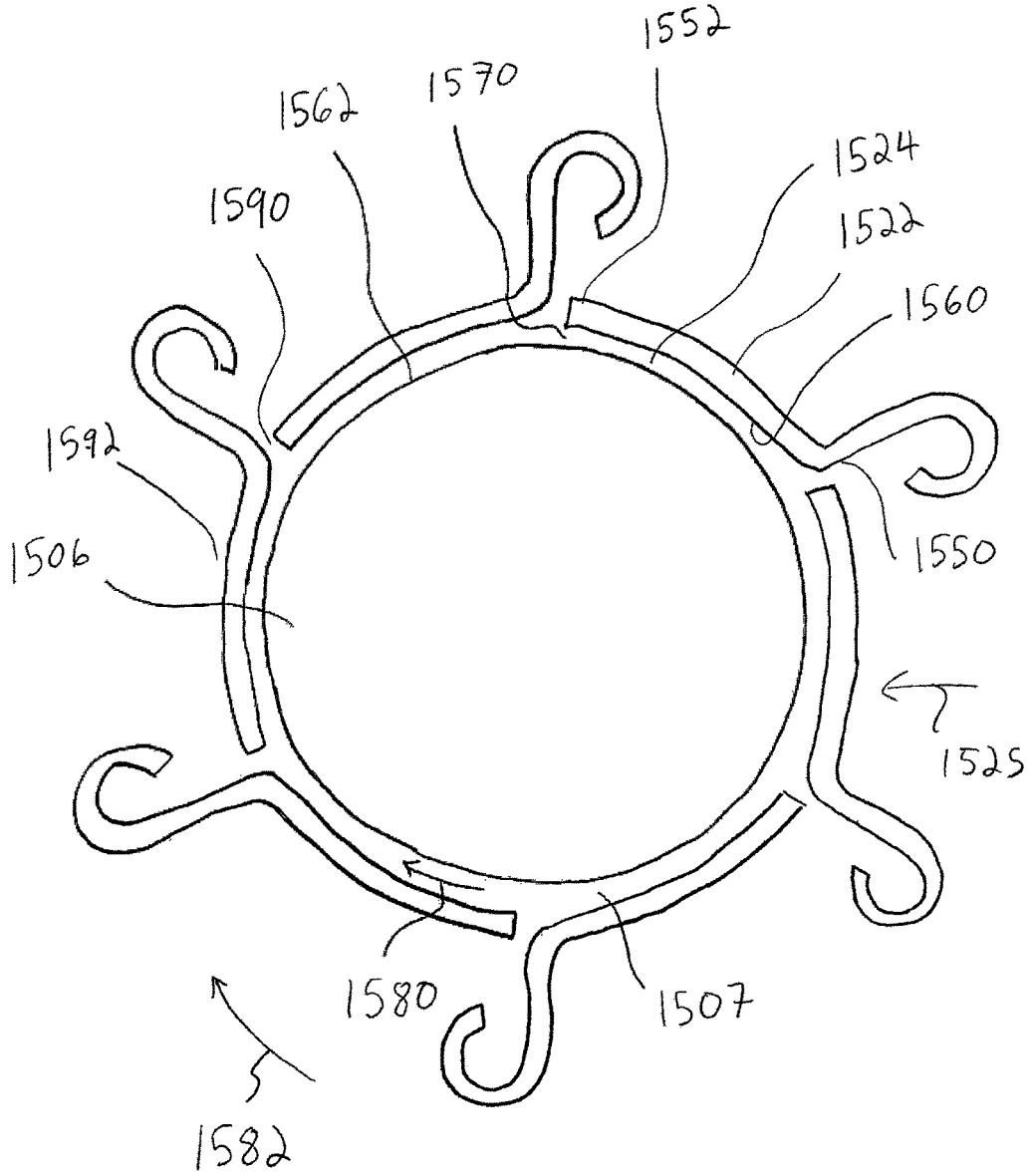
FIG. 54 is a schematic view of fins of the brake assembly in a first configuration about a rotor of the brake assembly.
Figure 55:
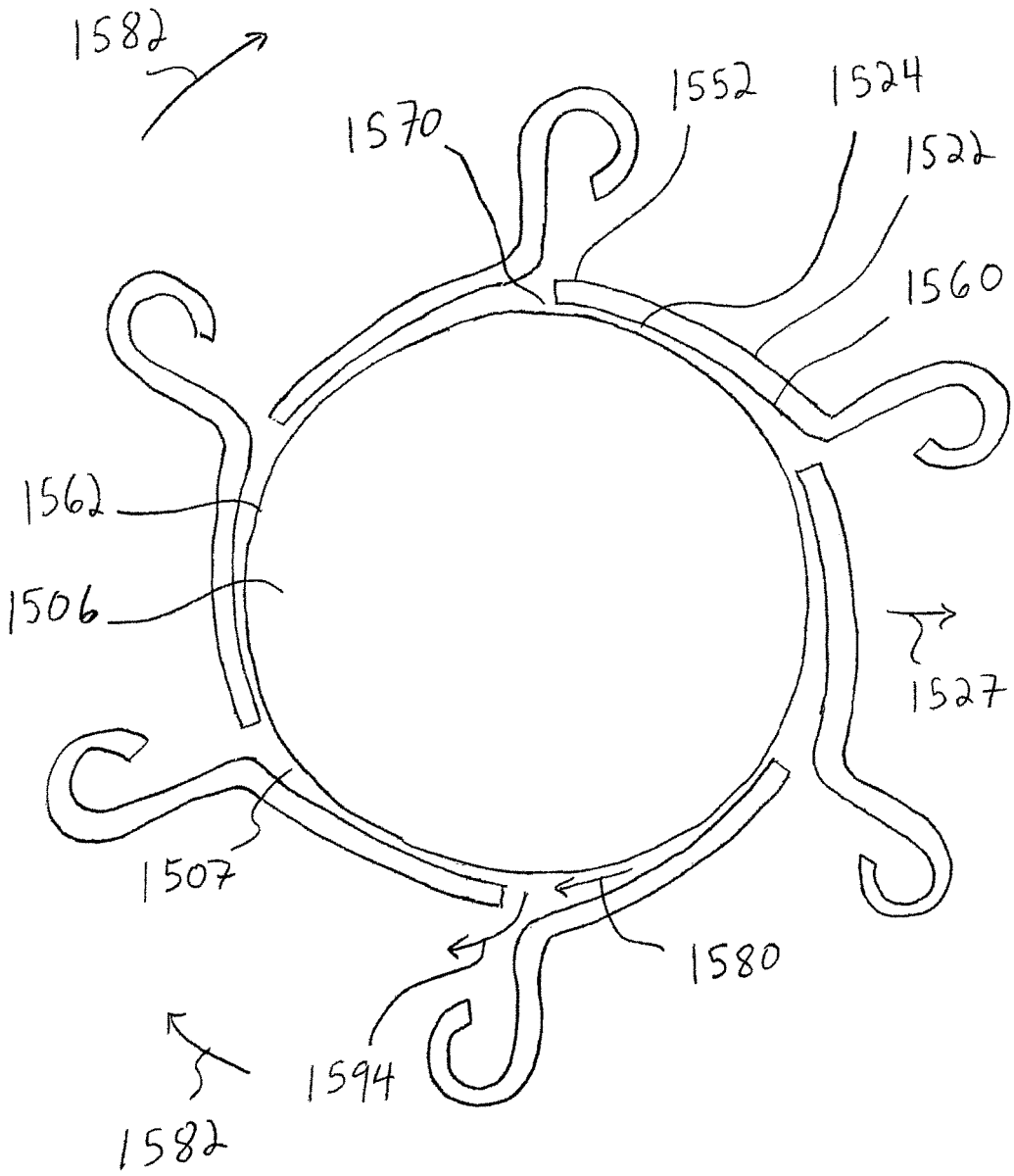
FIG. 55 is a schematic view similar to FIG. 54 showing the fins shifted to a second configuration about the rotor.

With reference to FIGS. 53-55, another brake assembly 1500 is shown. The brake assembly 1500 may be releasably connected to a sprinkler frame, such as a frame 1203 (see FIG. 40) in place of the brake assembly 1202. The brake assembly 1500 includes a housing 1502 having a chamber 1504 filled at least partially with a viscous fluid 1507 (see FIG. 54) and a rotor 1506 disposed in the chamber 1504. In one form, the rotor 1506 has a drum shape, the chamber 1504 is filled with the viscous fluid, and the drum-shaped rotor 1506 is completely submerged in the viscous fluid within the chamber 1504. The viscous fluid 1507 may be grease or another fluid having a viscosity in the range of approximately 450,000 cP to approximately 970,000 cP. For example, the viscous fluid 1507 may be dampening grease having a viscosity in the range of approximately 450,000 cP to approximately 550,000 cP. Companies like Nusil and Shin-Etsu sell grease that may be used as viscous fluid 1507.

Figure 40:
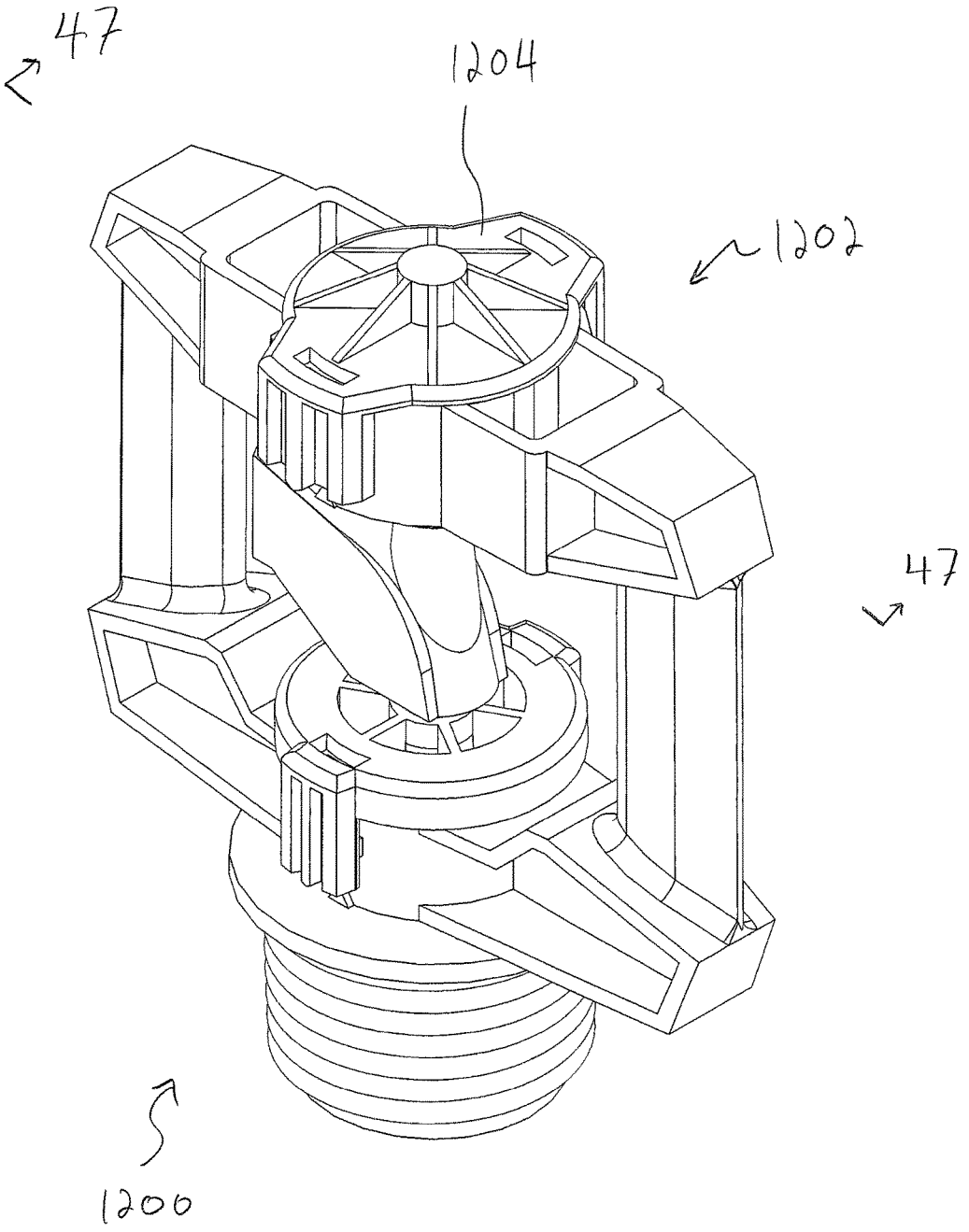
FIG. 40 is a perspective view of another rotary sprinkler.

With reference to FIG. 53, the housing 1502 has a cap 1503 similar to the cap 1204 (see FIG. 40), which encloses the chamber 1504 and includes depending tabs 1505 for connecting to a sprinkler frame. However, an upper portion of the cap 1503 is not shown in FIG. 53 in order to show the internal components of the brake assembly 1500. The cap 1204 in FIG. 40 illustrates the upper portion of the cap 1503. More specifically, the rotor 1506 is connected to a shaft 1510 at one end of the shaft 1510, and a deflector 1512 is connected to an opposite end of the shaft 1510. In response to the deflector 1512 receiving fluid, the deflector 1512 and shaft 1510 rotate which rotates the rotor 1506 in the chamber 1504. The viscous fluid 1507 in the chamber 1504 produces drag on the rotor 1506, slowing the rotation of the rotor 1506 to produce a rotational velocity of the rotor 1506 generally within a predetermined range as the fluid strikes the deflector 1512.

The brake assembly 1500 further includes a reactive brake device 1520 that, in one form, includes bimetallic fins 1522 submerged at least partially in the viscous fluid 1507 of the chamber 1504. The fins 1522 have free ends 1552 separated from the rotor 1506 by openings or gaps 1524, as shown in FIG. 54. As the rotor 1506 turns in direction 1582 due to turning of the deflector 1512, the viscous fluid 1507 in the chamber 1504 travels through the gaps 1524 in direction 1580.

The fin free ends 1552 change position within the chamber 1504 in response to changes in temperature of the bimetallic fins 1522, which changes the size of the gaps 1524 through which the viscous fluid 1507 travels. The changes in the temperature of the bimetallic fins 1522 may be due to changes in ambient temperature in the environment about the brake assembly 1500. The changes in ambient temperature may change the temperature of the viscous fluid 1507 in which the bimetallic fins 1522 are at least partially submerged, which changes the temperature of the fins 1522. Alternatively or in addition to the ambient temperature changes, the temperature of the viscous fluid 1507 may change in response to rotation of the rotor 1506 in the viscous fluid 1507 (e.g., the friction of the rotor 1506 rotating in the fluid 1507 at a high speed for a long period of time may increase the temperature of the fluid 1507). In some approaches, changes in ambient temperature (and the associated changes in the temperature of the fluid 1507) is the primary driver of temperature change in the bimetallic fins 1522 while changes in the temperature of the fluid 1507 in response to rotation of the rotor 1506 in the fluid 1507 contributes only slightly to temperature change of the fins 1522. In yet another approach, a portion of the bimetallic fins 1522 may be exposed to the surrounding environment such that changes in the ambient temperature directly change the temperature of the fins 1522 and the positions of the fin free ends 1552.

With reference to FIG. 54, the viscous fluid 1507 in the chamber 1504 generally travels in direction 1580 through the gaps 1524 along a path 1584 as the rotor 1506 rotates. When the temperature of the bimetallic fins 1522 increases such as due to increased ambient temperature, the free ends 1552 shift toward the rotor 1506 in direction 1525 which narrows the gaps 1524 (as shown in the movement of the fins 1522 from their positions in FIG. 54 to their positions in FIG. 55). This causes the viscous drag produced by the fluid 1507 in the narrowed gaps 1524 to increase which compensates for the decreased viscosity of the viscous fluid 1507 due to the higher ambient temperature. When the temperature of the bimetallic fins 1522 decreases such as due to decreased ambient temperature, the free ends 1552 shift away from the rotor 1506 in direction 1527 and toward a stator 1530 (see FIG. 53) of the brake housing 1502 which widens the gaps 1524 (as shown in the movement of the fins 1522 from their positions in FIG. 55 to their positions in FIG. 54). This causes the viscous drag produced by the fluid 1507 to decrease which compensates for the increased viscosity of the fluid 1507 due to the lower ambient temperature. The temperature-dependent movement of the bimetallic fins 1522 therefore functions to maintain a more consistent rotational velocity of the rotor 1506 and deflector 1512 connected thereto despite changes in ambient temperature.

With respect to FIG. 53, the brake housing 1502 includes pockets 1540 and openings 1542 in the stator 1530 that open into the pockets 1540. Each fin 1522 has a curved end 1544 rigidly mounted in a respective cylindrical pocket 1540. In one form, the fin curved end 1544 is held tightly in the housing pocket 1540 by frictional engagement between the curved end 1544 and the pocket 1540. In other approaches, the fin curved end 1544 may be secured in the pocket 1540 using welds, fasteners, or adhesives, for example. In yet another approach, the fin curved ends 1544 may be molded into the stator 1530 during molding of the housing 1502.

Each fin 1522 extends outward from its respective pockets 1540 through the opening 1542 and into the chamber 1504. Each fin 1522 has a base portion 1550 engaged with the pocket 1540 and the fin free end portion 1552 is positioned in the brake housing chamber 1504. The fins 1522 have a shape complimentary to the rotor 1506 such that the fins 1522 avoid interfering with the rotor throughout the operating range of ambient temperatures experienced by the sprinkler 1500. For example, the fins 1522 may have concave inner surfaces 1560 with curvatures similar to a convex outer surface 1562 of the rotor 1506, as shown in FIGS. 54 and 55.

The reactive brake device 1520 may have a variety of forms. For example, the fins 1522 may be configured to move between a first position where the fin free end portions 1552 are spaced from the rotor 1506 when the sprinkler 1500 is at a low ambient temperature (similar to the position in FIG. 54) and a second position where the free end portions 1522 come in close proximity or even directly contact the rotor 1506 to slow rotation of the rotor 1506 when the sprinkler 1500 is at a high ambient temperature.

The brake housing stator 1530 positions the fins 1522 about the housing 1502 so that there are openings 1590 between adjacent fins 1522 which open into slots 1592 between the fins 1522 and the brake housing stator 1530, as shown in FIGS. 53 and 54. When the fin free end portions 1552 shift toward the rotor 1506, the fins 1522 shift away from the housing stator 1530 which draws fluid 1507 into the slots 1592 in direction 1594. When the fin free end portions 1552 shift away from the rotor 1506, the fins 1522 shift toward the housing stator 1530 which squeezes fluid 1507 outward from the slots 1592.

Figure 56:
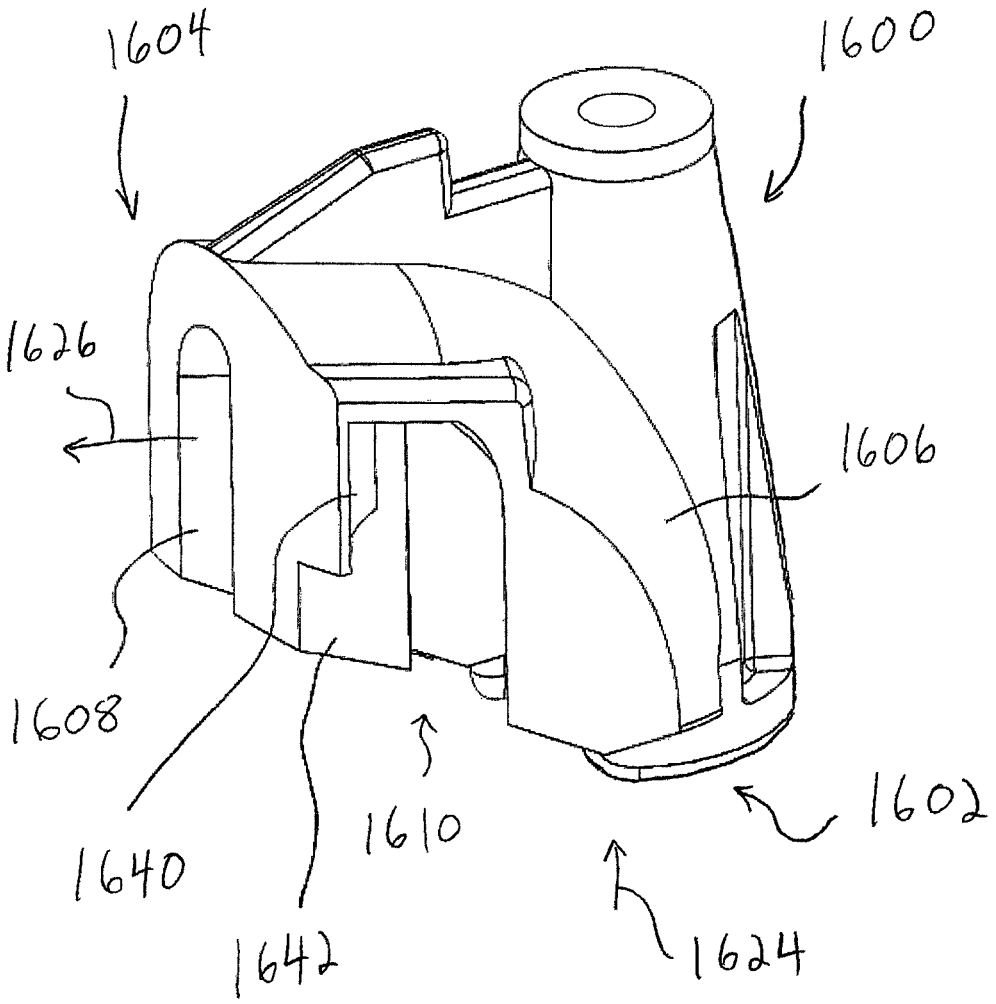
FIG. 56 is a perspective view of another deflector for a rotary sprinkler.
Figure 57:
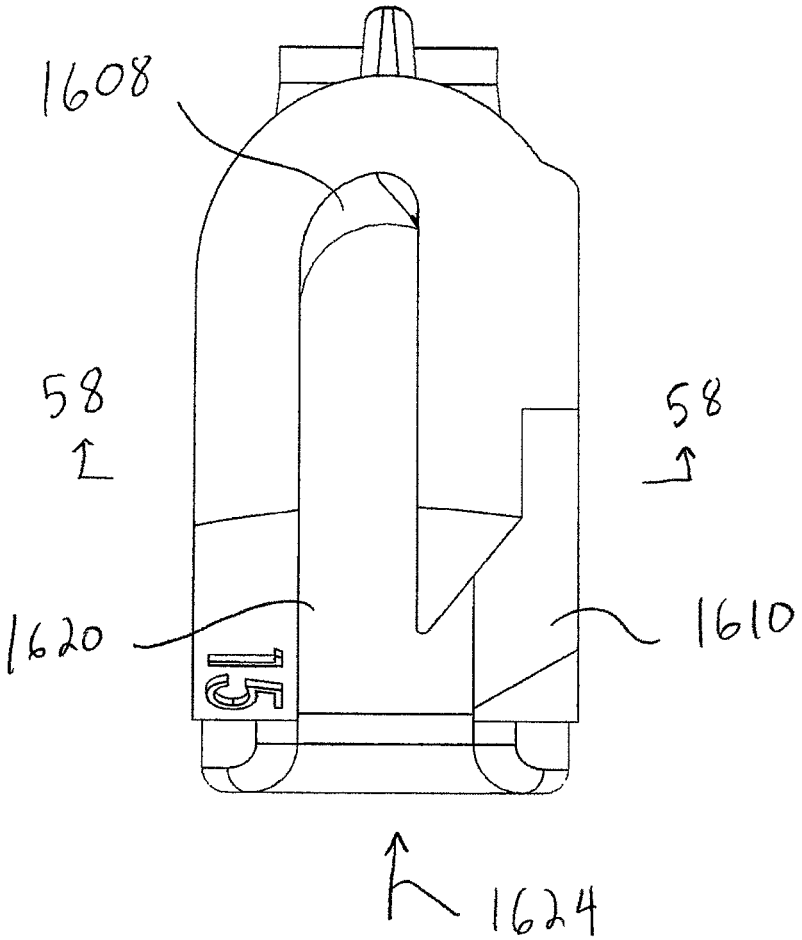
FIG. 57 is an end elevational view of the deflector of FIG. 56.
Figure 58:
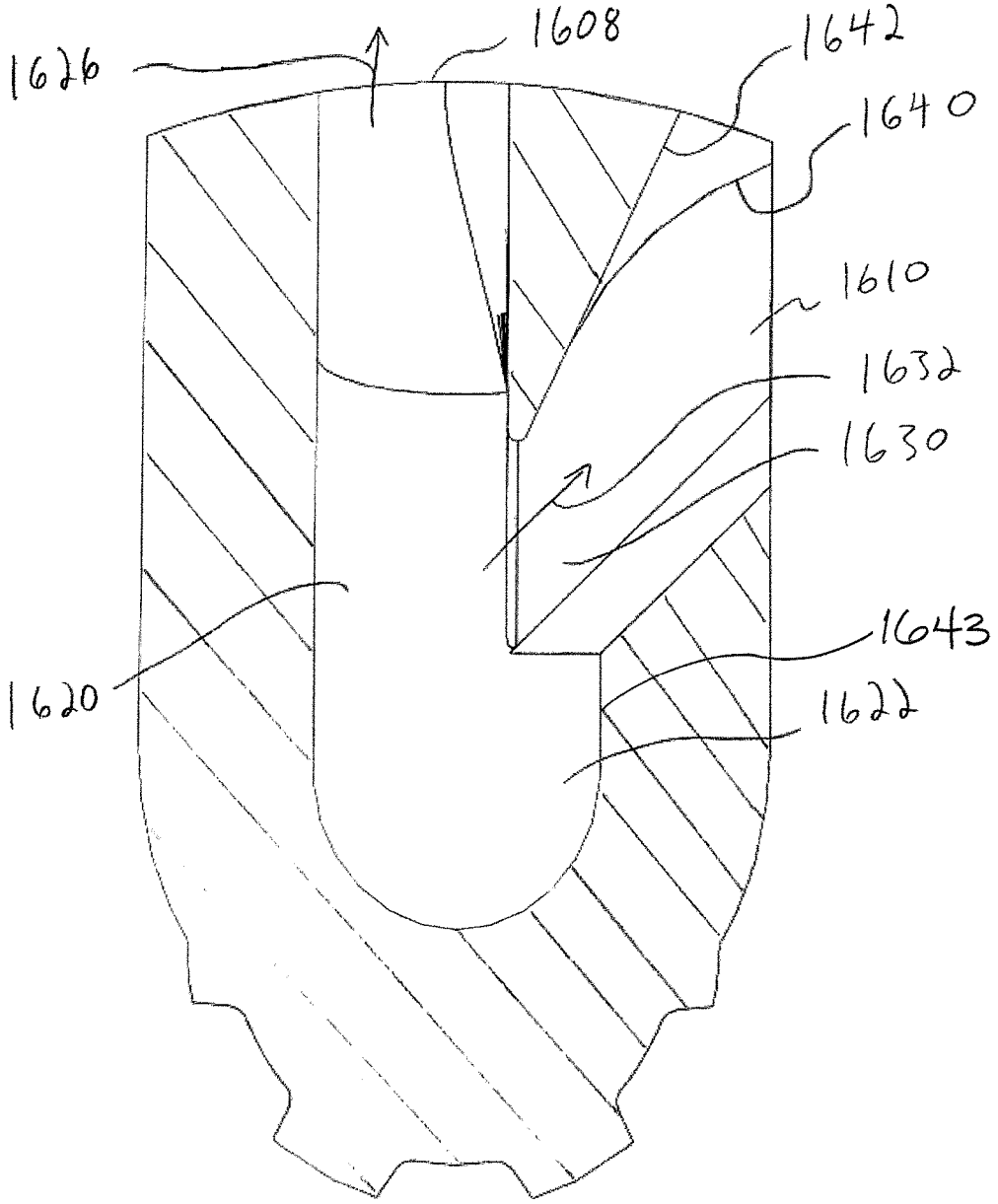
FIG. 58 is a cross-sectional view taken along line 58-58 in FIG. 57.

With reference to FIGS. 56-58, another sprinkler deflector 1600 is shown. The deflector 1600 may be used with the brake assembly 1200 and the brake assembly 1500, for example. The deflector 1600 includes an inlet 1602 for receiving fluid from a sprinkler nozzle and an outlet 1604 for discharging the fluid outwardly from the sprinkler as the deflector 1600 rotates. The deflector 1600 includes a body 1606 having an outlet opening 1608 and a channel 1620 that includes a duct 1610. The duct 1610 redirects a portion of the fluid received at the inlet 1602 laterally from the deflector 1600 to cause rotation of the deflector 1600. The fluid discharged from the duct 1610 additionally provides close-in and intermediate watering of the surrounding terrain, as discussed in greater detail below. The deflector 1600 discharges the remaining fluid outward from the outlet opening 1608 with a spray pattern defined by the channel 1620 and the outlet opening 1608. The fluid discharged from the outlet opening 1608 provides far-away watering of the surrounding terrain as defined by the configuration of the channel 1620 and the outlet opening 1608.

With reference to FIGS. 57 and 58, the deflector channel 1620 has an inner surface 1622 that redirects fluid received in a first direction 1624 toward a transverse second direction 1626. The deflector channel 1620 maximizes the throw of the fluid outward from the outlet opening 1608 by providing a smooth redirection of fluid flow within the deflector 1600. Specifically, the channel inner surface 1622 is configured to minimize turbulence imparted to the fluid stream as it travels from the inlet 1602 to the outlet opening 1608. The reduced turbulence provided by the channel 1620 increases the efficiency of the re-redirection of the stream from direction 1624 to direction 1626 and provides the maximized throw distance because less energy in the fluid stream is lost to turbulence. This improved efficiency permits the sprinkler 1600 to water a larger area of surrounding landscape with a smaller volume of fluid supplied to the sprinkler than in some prior approaches.

With reference to FIG. 58, the duct 1610 includes an opening 1630 that permits fluid to travel in direction 1632 into the duct 1610. With reference to FIGS. 56 and 58, the duct 1610 further includes a close-in watering ramp 1640 and an intermediate watering ramp 1642. The duct 1610 siphons a portion of the fluid stream traveling between the inlet 1602 and the outlet opening 1608 and the ramps 1640, 1642 redirect the portion of the fluid stream laterally which widens the spray pattern of the deflector 1600 and permits the deflector 1600 to water a greater range of locations about the sprinkler. More specifically, the ramps 1640, 1642 redirect the fluid laterally which causes the fluid traveling along the ramps 1640, 1642 to travel outwardly a shorter distance than fluid exiting the outlet opening 1608 and provides intermediate and close-in watering from the deflector 1600. As shown in FIG. 58, the close-in watering ramp 1640 curves laterally a greater amount than the intermediate watering ramp 1642. The greater lateral curvature of the close-in watering ramp 1640 imparts a greater lateral redirection to the fluid traveling along the ramp 1640 than the lateral redirection imparted by the ramp 1642. Thus, the water exiting the duct 1610 along the ramp 1640 does not travel as far outward from the deflector 1600 as does the water traveling along the intermediate watering ramp 1642. The deflector 1600 thereby provides close-in and intermediate watering by directing fluid along the ramps 1640, 1642. In this manner, the ramps 1640, 1642 and outlet opening 1608 provide varying throw distances for the fluid exiting the deflector 1600.

Further, the portion of the fluid stream siphoned by the duct 1610 has a lower velocity compared to the remainder of the fluid stream because the fluid stream portion was traveling near a wall 1643 of the deflector 1600 before entering the duct 1610. Due to the viscosity of the fluid (which may be water), the fluid stream has a lower velocity near the wall 1643 and a higher velocity away from the wall 1643. The lower initial velocity of fluid entering the duct 1610 contributes to lower fluid velocities as the fluid exits the ramps 1640, 1642 than the fluid exiting the outlet 1608 and reduces the throw distance of fluid exiting the ramps 1640, 1642.

Figure 59:
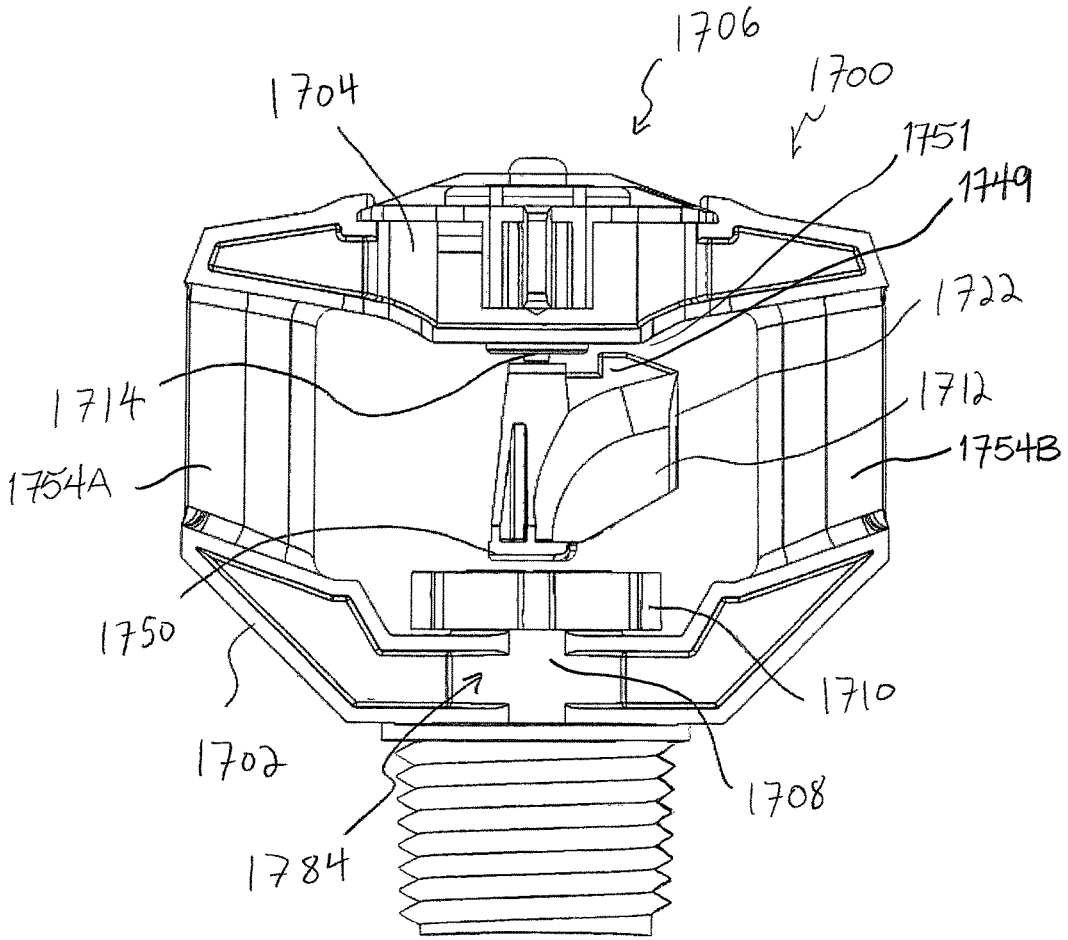
FIG. 59 is an elevational view of another rotary sprinkler.
Figure 60:
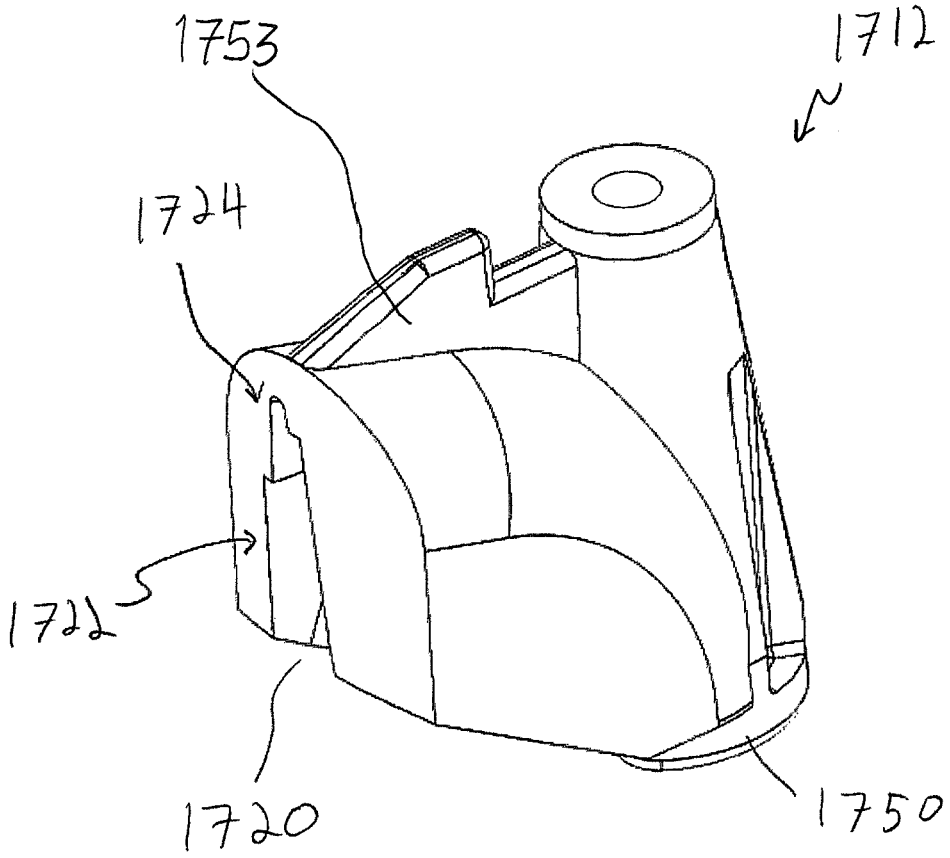
FIG. 60 is a perspective view of a deflector of the rotary sprinkler of FIG. 59.
Figure 62:
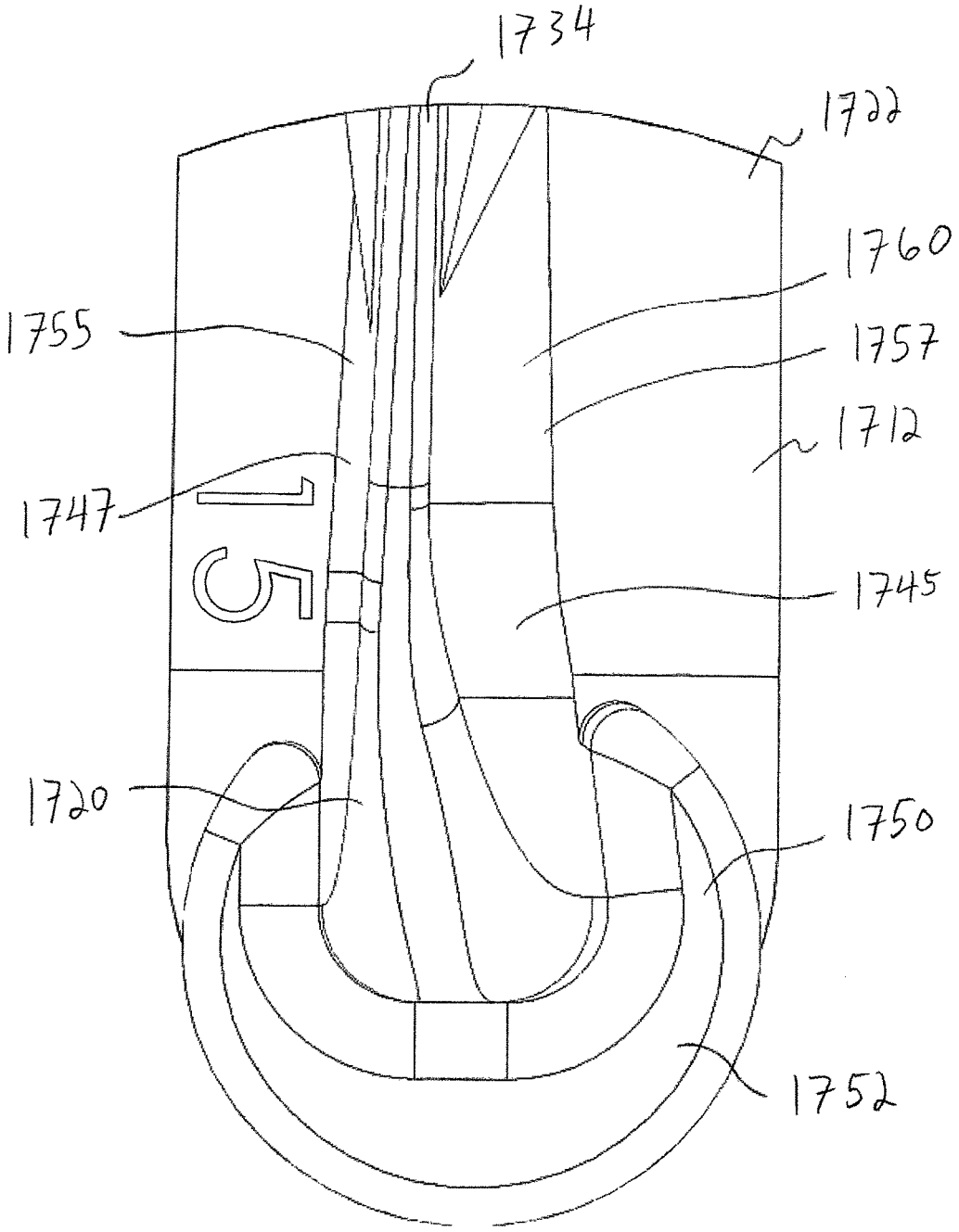
FIG. 62 is a bottom plan view of the deflector of FIG. 60.
Figure 63:
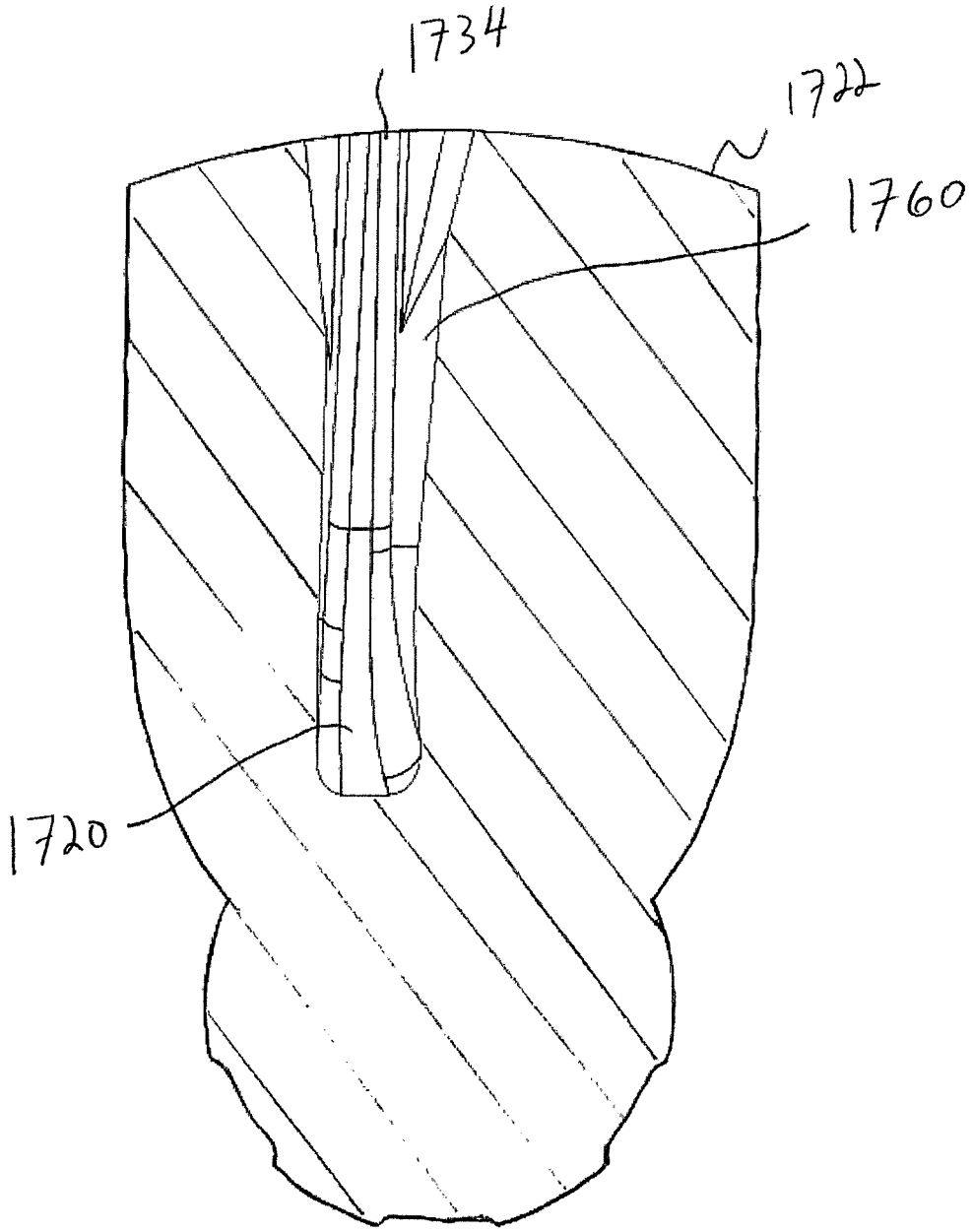
FIG. 63 is a cross-sectional view taken across line 63-63 in FIG. 61.

With reference to FIG. 59, another sprinkler 1700 is shown. The sprinkler 1700 includes a frame 1702 having an upper socket 1704 that receives a brake assembly 1706 and a lower socket 1708 that receives a nozzle 1710. The sprinkler 1700 further includes a deflector 1712 mounted on a shaft 1714 of the brake assembly 1706. With reference to FIG. 60, the deflector 1712 has an inlet 1750 for receiving fluid from the nozzle 1710, an outlet opening 1724 for discharging the fluid outward from the deflector 1712, and a channel 1720 connecting the inlet 1750 to the outlet opening 1724. With reference to FIG. 62, the deflector 1712 includes a funnel 1752 that functions to direct fluid from the nozzle 1710 into the channel 1720 of the deflector 1712 and eventually outward from the outlet opening 1724.

Figure 61:
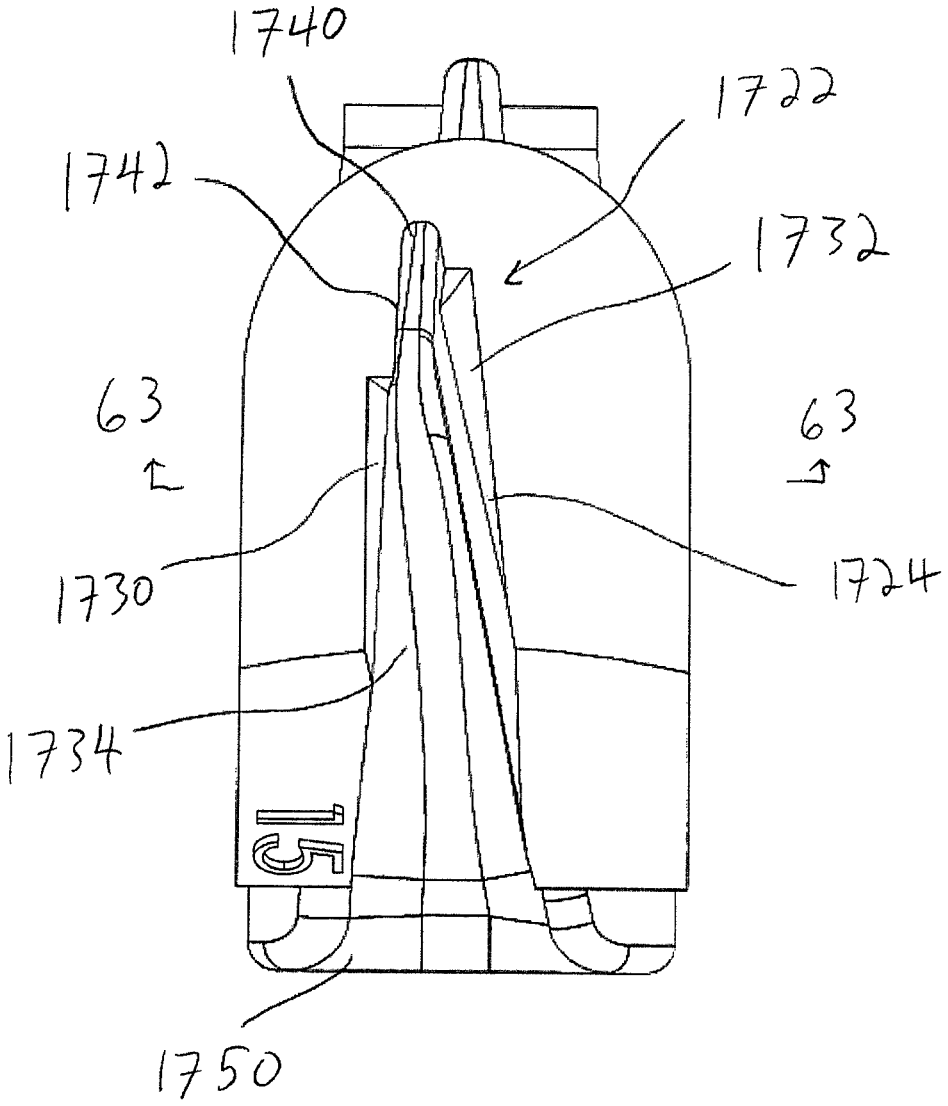
FIG. 61 is an end elevational view of the deflector of FIG. 60.

The channel 1720 has steps or ramps 1722 that function to impart different throw distances and patterns to different portions of the water exiting the outlet opening 1724, as shown in FIG. 61. The ramps 1722 provide a more even distribution of water from the outlet opening 1724 to the surrounding landscape which improves efficiency by reducing overwatering or underwatering of the surrounding landscape. The ramps 1722 include fan watering ramps 1730, 1732 on opposite sides of the outlet opening 1734. The close-in watering ramps 1730, 1732 cause the fluid exiting the opposite sides of the deflector opening 1734 to fan laterally outward and provide even watering of the surrounding landscape. The ramps 1722 also include a primary flow channel 1740 that directs fluid generally straight outward with a relatively small component of tangential motion. Further, the ramps 1722 include an intermediate watering ramp 1742 that causes fluid to fan slightly laterally (but less laterally than the ramps 1730, 1732) and contribute to even watering from the deflector 1712. In this manner, the deflector 1700 provides an even distribution of fluid to regions of the surrounding environment which improves efficiency by reducing overwatering and underwatering.

The primary flow channel 1740 is configured to provide a partially vertical trajectory to the fluid stream traveling along the channel 1740 and outward from the outlet opening 1724. In one form, the fluid traveling along the channel 1740 has a trajectory in the range of approximately 5 to approximately 24 degrees relative to the horizon upon installation of the sprinkler 1700 (with the fluid flow out of the nozzle 1710 being vertical).

As shown in FIG. 59, the deflector 1700 redirects a vertical fluid stream from the nozzle 1710 to a more horizontal stream traveling outward from the deflector 1712. To achieve this redirection, the channel 1720 of the deflector 1712 curves generally along an arc between the inlet 1750 and the outlet 1722. With respect to FIG. 62, this forced change in the direction of the fluid stream causes portions of the fluid stream to disperse toward walls 1755, 1757 of the channel 1720 (which include the ramps 1722). The ramps 1730, 1732, 1742 capture the dispersed fluid and redirect the fluid laterally outward relative to the deflector outlet opening 1724, as shown in FIG. 61.

With reference to FIG. 62, the ramps 1722 include an initial ramp 1745 and a drive ramp 1747 that produce rotation of the deflector 1712 as fluid travels through the channel 1720. More specifically, the initial ramp 1745 receives at least a portion of the fluid from the inlet 1750 and directs the fluid against the drive ramp 1747. The drive ramp 1747 is oriented so as to generate a reaction torque as the fluid impacts the drive ramp 1747. This impact causes the deflector 1712 to rotate.

With reference to FIGS. 59 and 60, the deflector 1712 has a fin 1749 configured to limit objects in the surrounding environment, such as long grass, from becoming lodged in a gap 1751 between the frame 1702 and the deflector 1712 and inhibiting rotation of the deflector 1712. In one aspect, the fin 1749 has a height (as shown in FIG. 59) that narrows the gap 1751 which reduces the potential items that can fit into the gap 1751. Further, the fin 1749 has an angled nose 1753 that may push away objects such as long grass trapped between struts 1754A, 1754B of the frame 1702.

Figure 64:
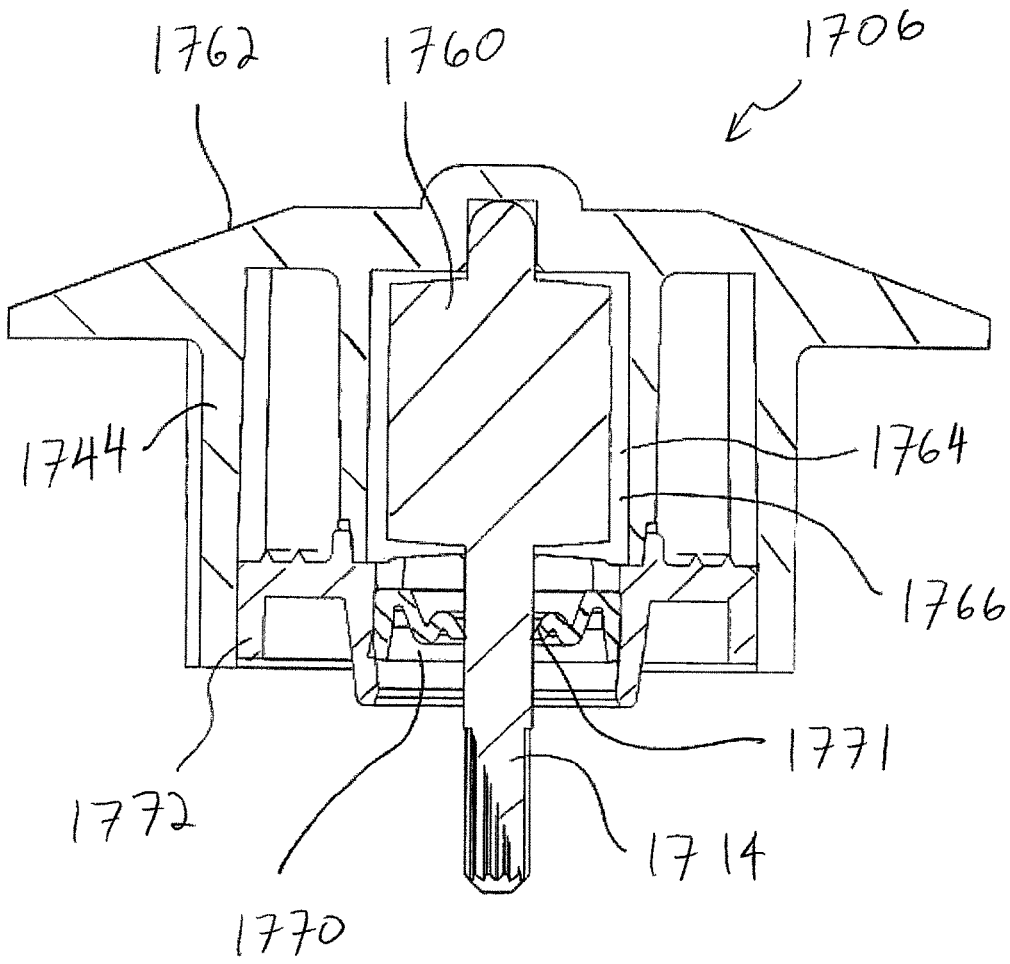
FIG. 64 is a cross-sectional view of a brake assembly of the rotary sprinkler of FIG. 59.

The rotational speed of the deflector 1712 relative to the sprinkler frame 1702 is controlled by the brake assembly 1706. With reference to FIG. 64, the brake assembly 1706 includes a rotor 1760 connected to or even integral with the shaft 1714 and a housing 1762 to which the rotor 1760 is mounted. The rotor 1760 rotates inside of a chamber 1764 defined by the housing 1762 filled with a viscous fluid 1766. The viscous fluid 1766 inside the chamber 1764 imparts a drag force on the rotor 1760 to establish a predetermined rotational speed of the rotor 1706 (and connected deflector 1712) within a particular range of supply line pressures for the sprinkler 1700.

The brake assembly 1706 has a seal 1770 that seals the viscous fluid in the chamber 1766 and provides protection from debris entering a bearing surface between the bearing plate 1772 and the shaft 1714 while permitting rotation of the shaft 1714. The seal 1770 is mounted to the bearing plate 1772, which is in turn secured to a wall 1774 of the housing 1762. The seal 1770 may be made of silicone rubber, and the housing 1762, may be made of plastic. To assemble the brake assembly 1706, the viscous fluid 1766 is positioned in the chamber 1764, the rotor 1760 advanced into the chamber 1764, an opening 1771 of the seal 1770 (which is mounted on the bearing plate 1772) passed along the shaft 1714, and the bearing plate 1772 secured to the wall 1744. The bearing plate 1772 may be secured to the wall 1744 using, for example, adhesive, fasteners, snap-on or ultrasonic welding techniques.

Figure 65:
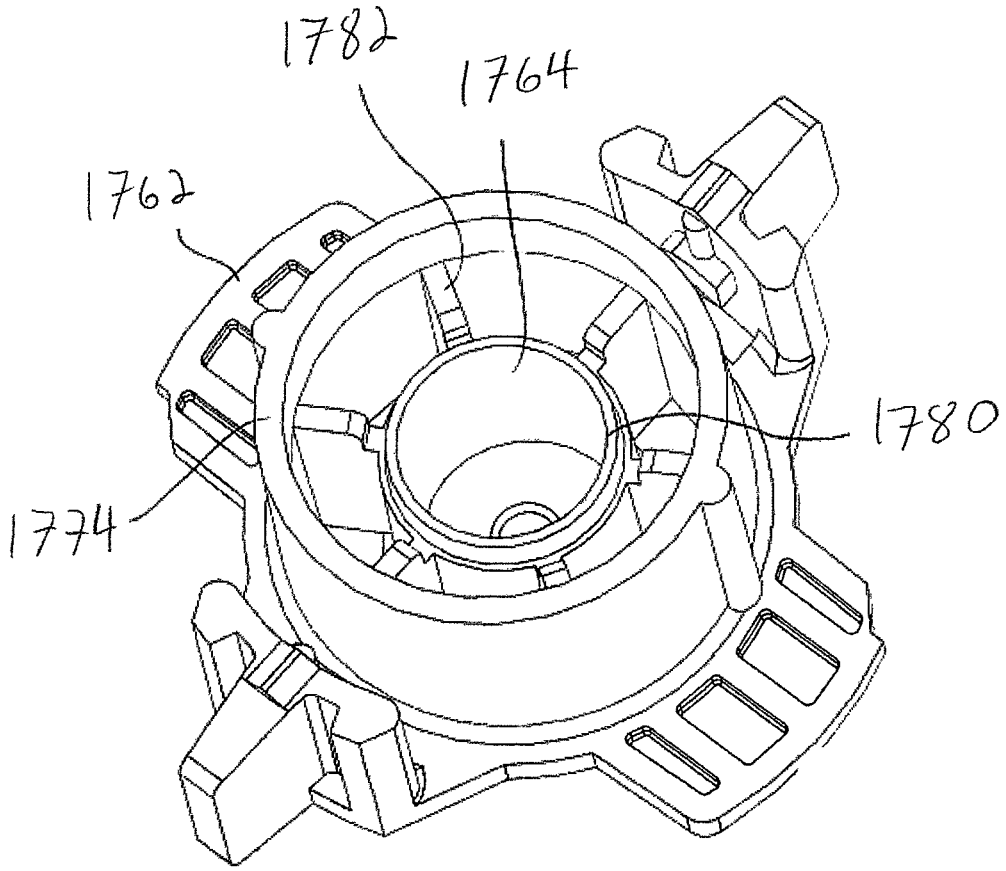
FIG. 65 is a bottom perspective view of a brake housing of the brake assembly of FIG. 64.

With reference to FIG. 65, the brake housing 1762 includes a cylindrical wall 1780 defining in part the chamber 1764 and supports 1782 extending outwardly that connect the wall 1780 to the housing wall 1774. In this manner, the brake housing 1762 provides a rigid and durable environment for the rotor 1760 and the viscous fluid 1766, while facilitating an efficient assembly process.

Figure 66:
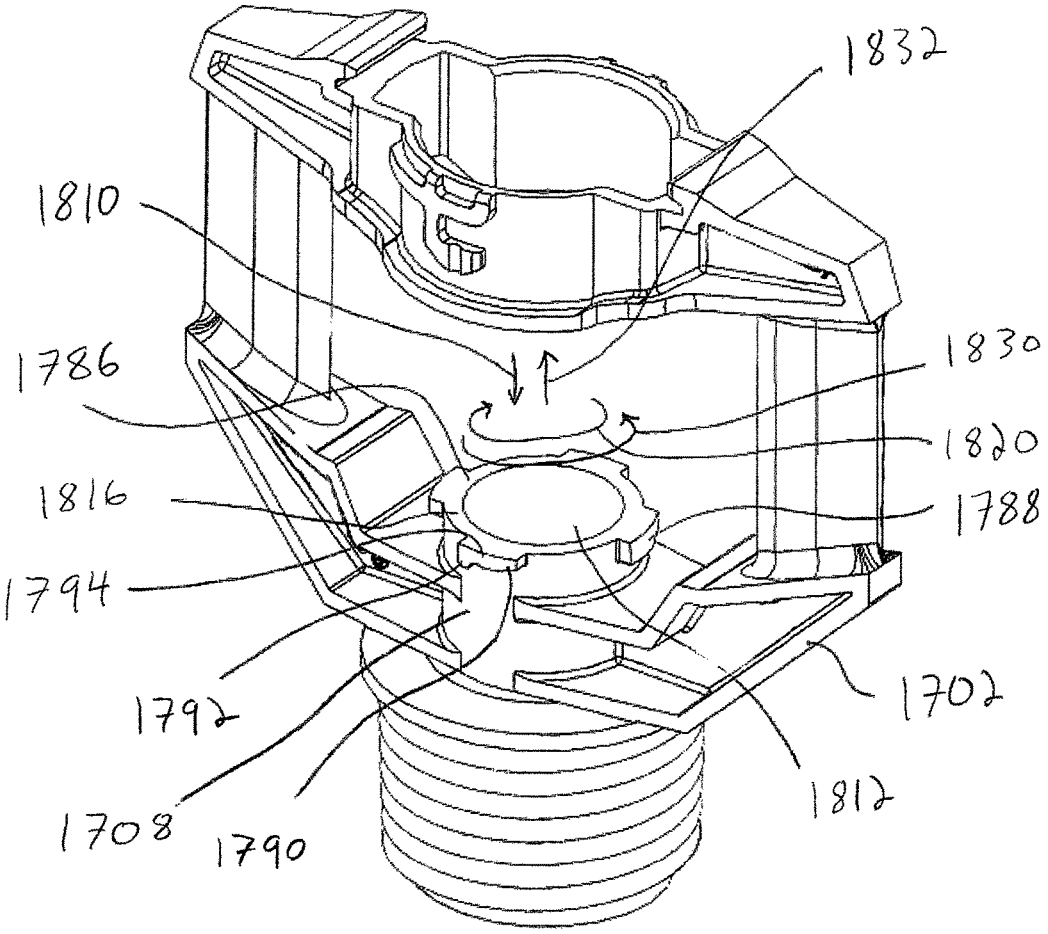
FIG. 66 is a perspective view of a frame of the rotary sprinkler of FIG. 59.
Figure 67:
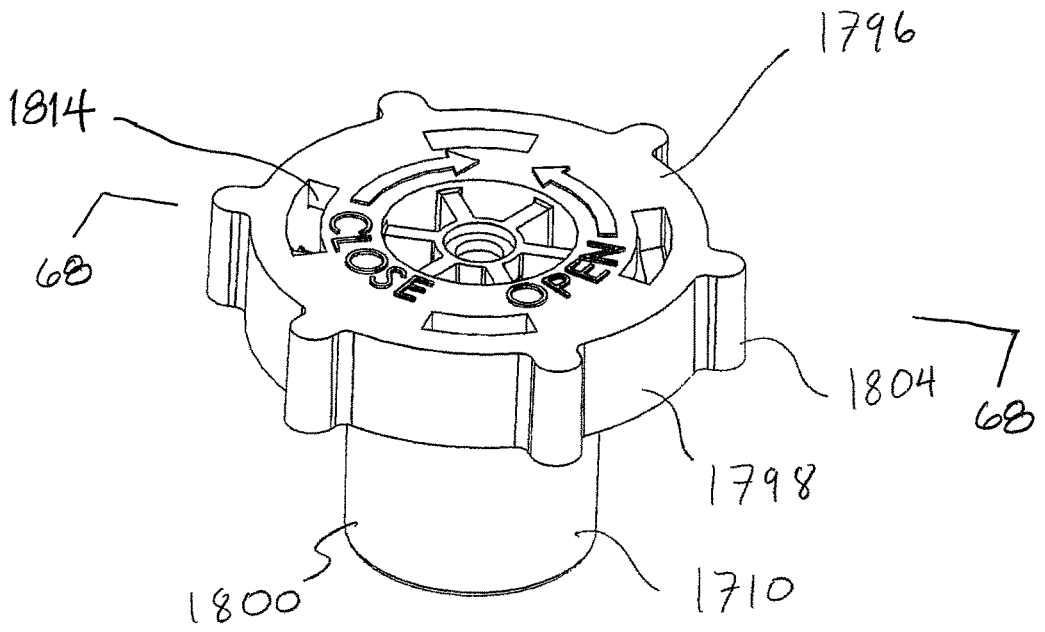
FIG. 67 is a perspective view of a nozzle of the rotary sprinkler of FIG. 59.
Figure 68:
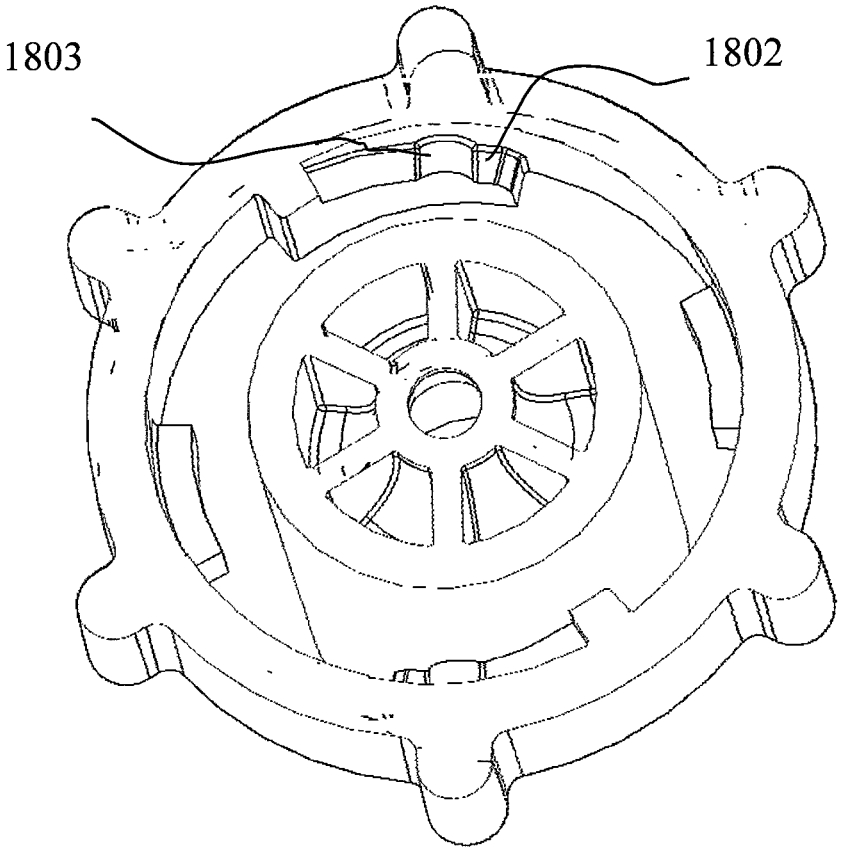
FIG. 68 is a cross-sectional view taken across line 68-68 in FIG. 67.
Figure 69:
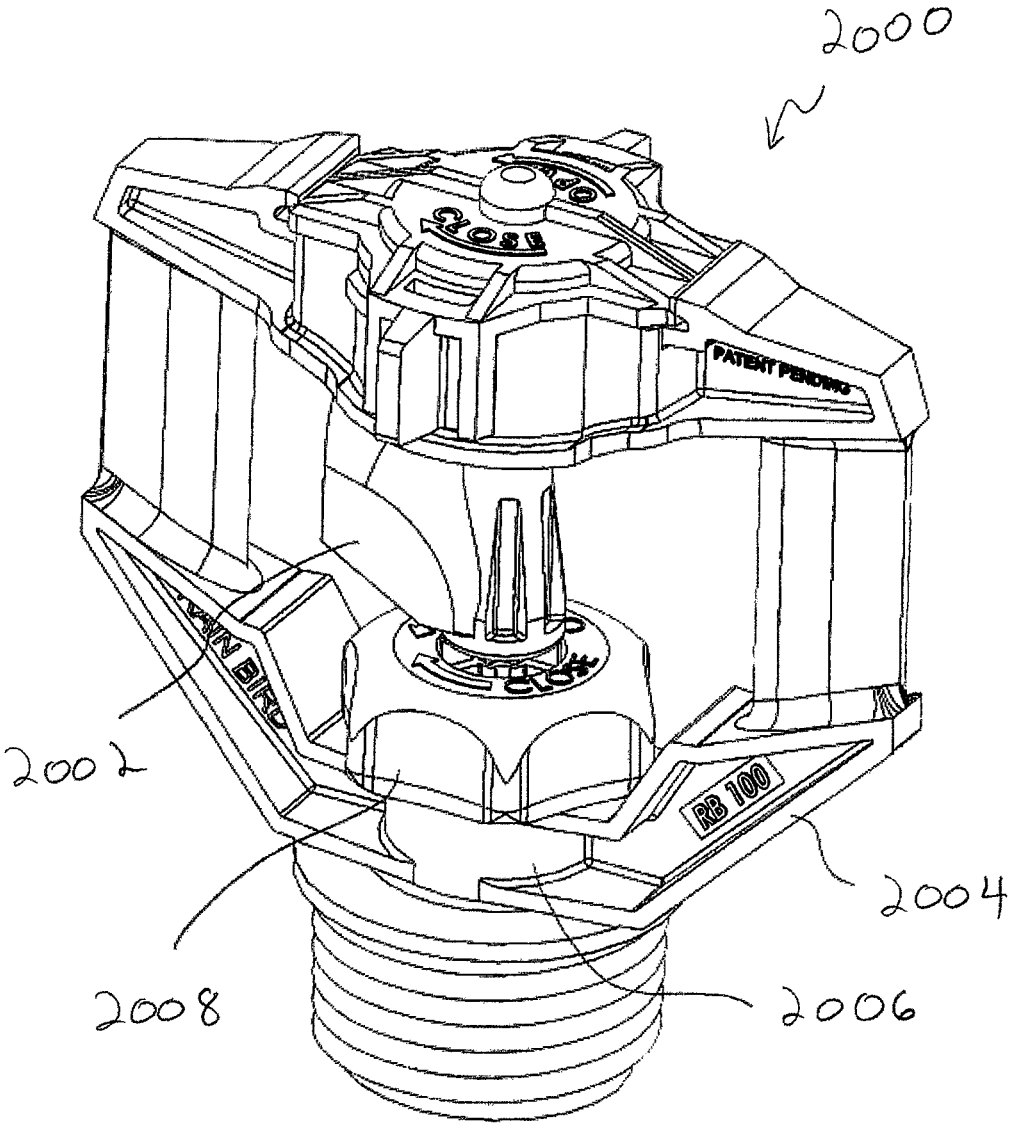
FIG. 69 is a perspective view of another rotary sprinkler.

With reference to FIG. 59, the sprinkler 1700 has a locking mechanism 1784 for releasably securing the nozzle 1710 in the frame lower socket 1708. As shown in FIG. 66, the lower socket 1708 includes a wall 1786 with coupling members 1788 extending outwardly therefrom. Each coupling member 1788 has an underside with a cam portion 1790, a stop portion 1792, and a recessed portion 1794 formed on an underside of the coupling member 1788. Turning to FIG. 67, the nozzle 1710 has a cap 1796 with a skirt 1798 and a tube 1800 depending from the cap 1796. The skirt 1798 has members 1802 (see FIG. 68) extending inwardly and having detents 1803 that are configured to engage the coupling members 1788 of the frame lower socket 1708. Opposite the members 1802, the skirt 1798 has projections 1804 extending outwardly that provide gripping surfaces for a user to grasp the nozzle 1710 as the user inserts and turns the nozzle 1710 in the lower socket 1708.

With reference to FIG. 66, a user inserts the nozzle tube 1800 in direction 1810 into an opening 1812 of the socket 1708 until a cap underside surface 1814 (see FIG. 67) seats against a rim 1816 of the socket wall 1786. Then, the user turns the nozzle 1710 in direction 1820 which engages the nozzle members 1802 and detents 1803 thereof with the socket coupling members 1788. Initially, each detent 1803 engages the cam portion 1790 of a respective coupling member 1788 and shifts downwardly in direction 1810 with turning of the nozzle in direction 1820 due to the camming engagement of the detent 1803 and the cam portion 1790. Because the cap underside surface 1814 rests upon the socket rim 1816, the downward shifting of the detent 1803 due to the camming engagement of the detent 1803 and the cam portion 1790 applies tension to the nozzle skirt 1798 and compresses the cap underside surface 1814 against the socket rim 1816.

Continued turning of the nozzle 1710 in direction 1820 slides the detent 1803 along the coupling member 1788 until the detent 1803 contacts the stop portion 1792. The user then releases the nozzle 1710 and the tension in the nozzle skirt 1798 draws the detent 1803 in direction 1832 against the recessed portion 1794 of the coupling member 1788 and seats the detent 1803 against the recessed portion 1794. The recessed portions 1794 of the coupling members 1788 permit the detents 1803 to shift upwardly slightly in direction 1832 which relieves some tension in the skirt 1798, although the cap underside surface 1814 remains compressed against the socket rim 1816. At this point, the detents 1803 are generally held against the recessed portion 1794 between the stop portion 1792 and the cam portion 1790 of the respective coupling members 1788. The engagement of the detents 1803 and the coupling members 1788 holds the cap underside surface 1814 tightly against the socket rim 1816 and functions to seal the nozzle 1710 in the socket 1708. Further, the nozzle detents 1803 and socket recessed portions 1794 are configured to engage and resist turning of the nozzle 1710 in direction 1830.

To release the nozzle 1710 from the socket 1708, the user grasps the cap 1796 and turns the nozzle 1710 in direction 1830 which overcomes the engagement of the detents 1803 and recessed portions 1794. Turning of the nozzle 1710 in direction 1830 slides the detents 1803 out of the recessed portions 1794 and along the cam portion 1790 of the respective coupling member 1788 until the detents 1803 are clear of the coupling members 1788. The user may then remove the nozzle 1710 from the socket 1708 by lifting the nozzle 1710 upward in direction 1832 which withdraws the tube 1800 from within the socket 1708.

With reference to FIGS. 69-73, another sprinkler 2000 is shown having a deflector 2002, a frame 2004, a socket 2006 of the frame 2004, and a nozzle 2008 releasably secured in the socket 2006. The nozzle 2008 is threadingly engaged with the socket 2006 such that the nozzle 2008 may be readily connected and disconnected from the socket 2006. The sprinkler 2000 may be packaged with several nozzles 2008, each having a different flow rating, so that the sprinkler 2000 may be readily tailored to a particular application.

Figure 70:
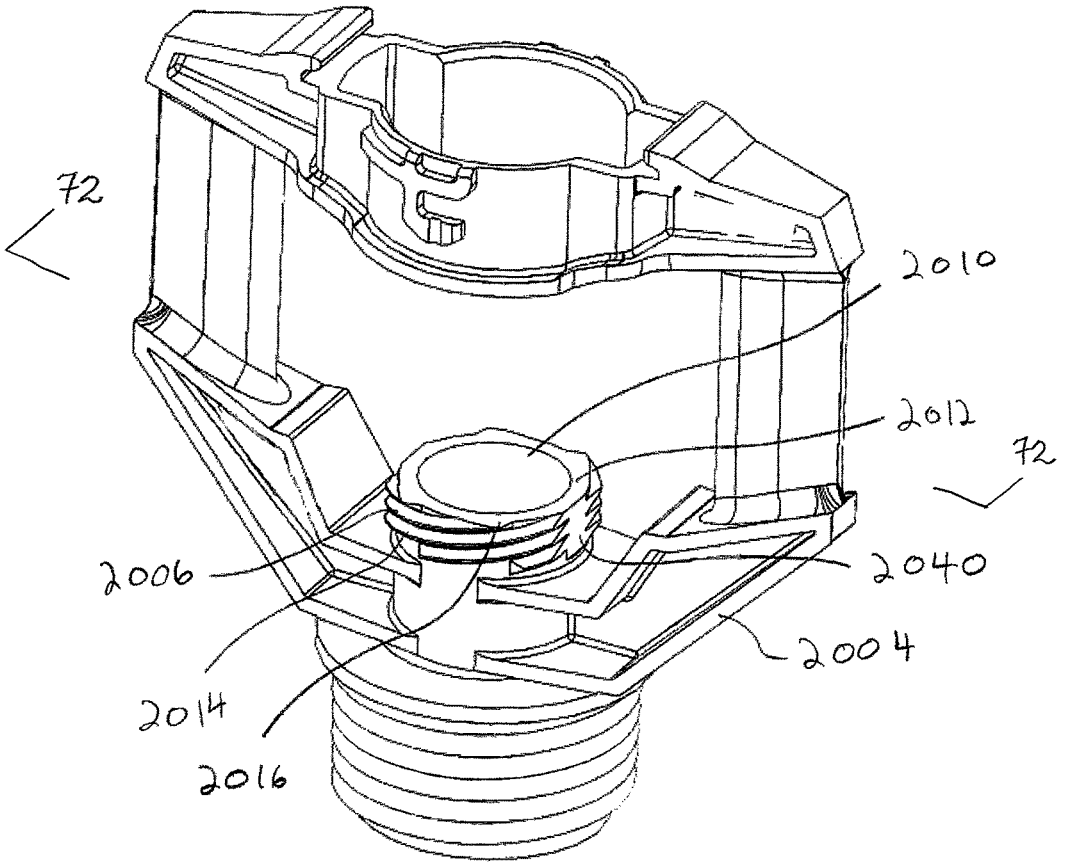
FIG. 70 is a perspective view of a frame of the rotary sprinkler of FIG. 69.

More specifically, the socket 2006 includes an opening 2010 for receiving the nozzle 2008 and a wall 2012 extending about the opening 2010, as shown in FIG. 70. The wall 2012 has outer threads 2014 formed thereon with multiple leads 2016. Similarly, the nozzle 2008 includes a cap 2030 (see FIG. 71) having a skirt 2032 with inner threads 2034 and multiple leads 2036. In one form, the socket threads 2014 have four leads 2016, and the nozzle cap threads 2034 have six leads 2036. By utilizing multiple leads 2016, 2036, the sprinkler 2000 has a higher strength for holding the nozzle 2008 in place within the socket 2006 during high pressure conditions in an associated supply line.

The fewer number of leads 2016 on the socket 2006 is attributable to flats 2040 on the wall 2012. The flats 2040 are diametrically opposed across the opening 2010 and interrupt the threads 2014. The flats 2040 provide a gripping area for a wrench so that a user may connect a wrench to the socket 2006 and turn the frame 2004 to thread the sprinkler 2000 on to a stand pipe, for example. The flats 2040 are optional and may be used to improve the ease of molding.

Figure 71:
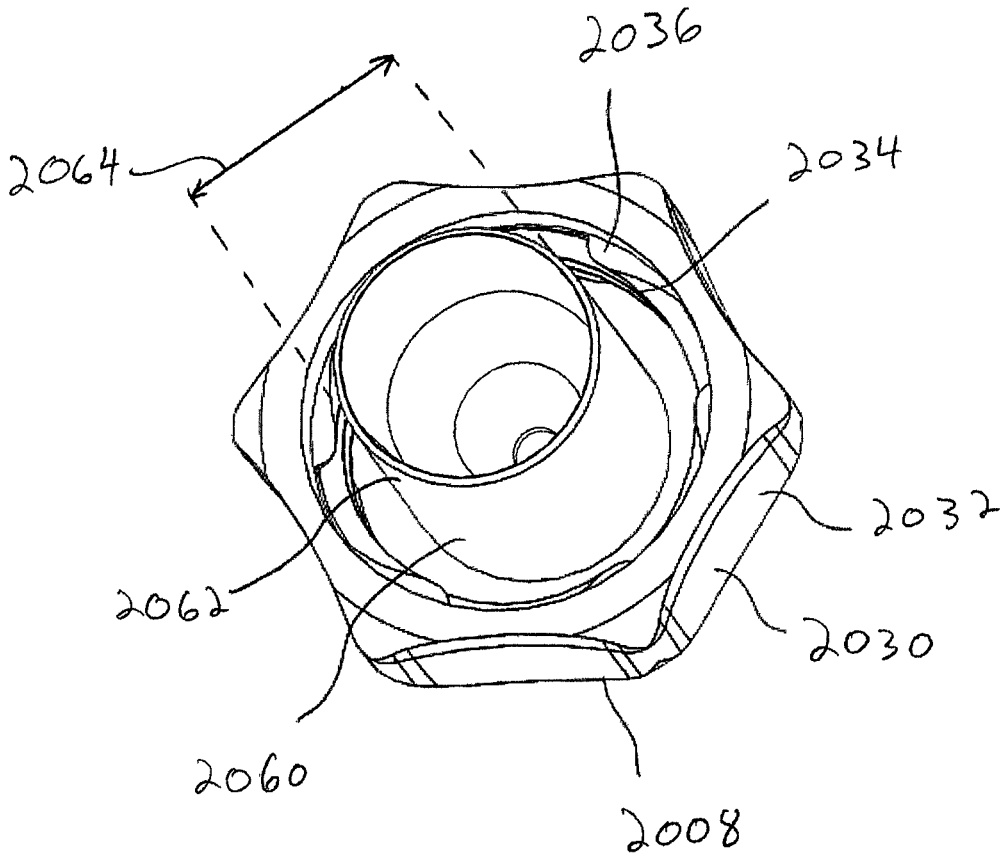
FIG. 71 is a bottom perspective view of a nozzle of the rotary sprinkler of FIG. 71.
Figure 72:
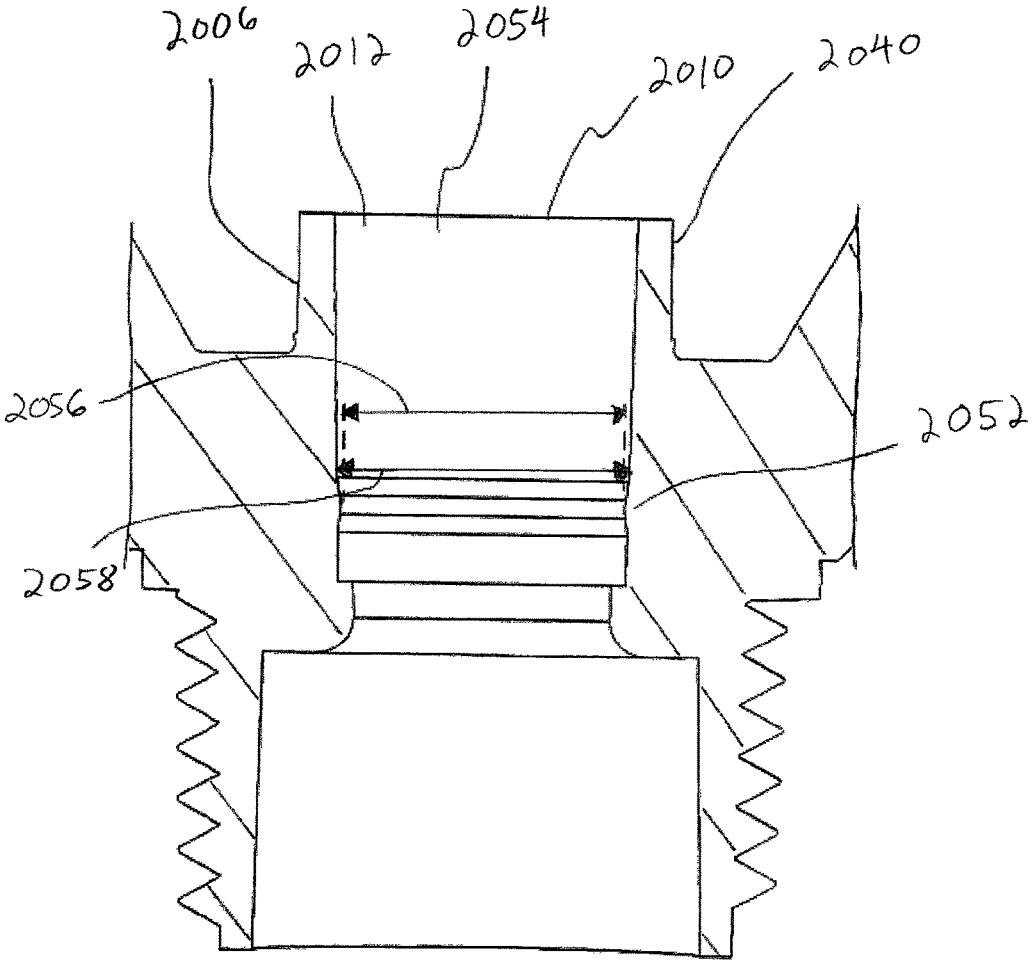
FIG. 72 is a partial cross-sectional view taken along line 72-72 in FIG. 70 showing a socket of the frame.
Figure 73:
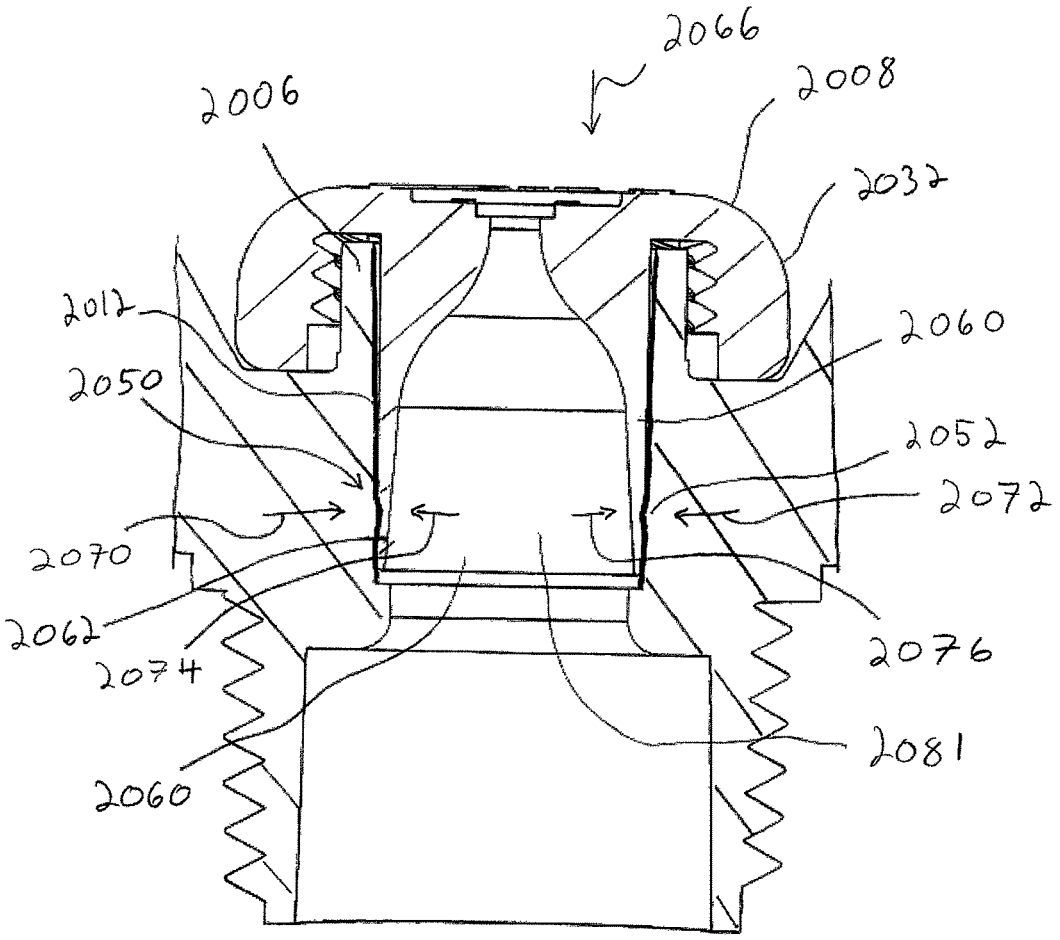
FIG. 73 is a cross-sectional view similar to FIG. 72 showing the nozzle of FIG. 71 received in the frame socket.

With reference to FIG. 73, the sprinkler 2000 includes a sealing mechanism 2050 for forming a watertight seal between the socket 2006 and the nozzle 2008. In one form, the sealing mechanism 2050 includes an annular protrusion 2052 that extends inwardly from an inner surface 2054 of the socket wall 2012, as shown in FIG. 72. The protrusion 2052 defines a narrower diameter 2056 across the opening 2012 than a diameter 2058 across the opening 2012 immediately downstream of the protrusion 2052. With reference to FIG. 71, the nozzle 2008 includes a tube 2060 with an upstream end portion 2062 having a diameter 2064 thereof. The upstream end portion diameter 2064 of the nozzle 2008 is larger than the diameter 2056 defined by the protrusion 2052 within the socket 2006. The larger diameter 2064 of the nozzle tube 2060 and the smaller diameter 2056 of the socket protrusion 2052 makes an interference fit between the nozzle tube 2060 and the socket protrusion 2052. The interference fit functions to form a watertight seal between the nozzle tube 2060 and the socket protrusion 2052 when the nozzle 2008 is secured in the socket 2006. Unlike some conventional sprinkler seals, the seal between the nozzle tube 2060 and the socket protrusion 2052 is generally not affected by high supply line pressures or by the plastic deformation (or material set, or creep) that a material undergoes when it is under continuous preload.

To secure the nozzle 2008 in the socket 2006, the user first positions the nozzle tube 2060 in the socket opening 2012 and advances the nozzle tube 2060 in direction 2066 into the socket 2006 until the nozzle threads 2034 reach socket threads 2014 (see FIGS. 72 and 73). The user turns the nozzle 2008 to engage the nozzle and socket threads 2014, 2034 and continues turning the nozzle 2008 to fully tighten the nozzle 2008 into the socket 2006. As the user turns the nozzle 2008, the engagement between the threads 2014, 2034 draws the nozzle 2008 farther in direction 2066 into the socket 2006. Further, turning the nozzle 2008 advances the nozzle tube upstream end 2062 in direction 2066 into contact with the annular protrusion 2052 within the socket 2006. Continued turning of the nozzle 2008 causes the protrusion 2052 to cam the upstream end portion 2062 inwardly in directions 2070, 2072 and compress the nozzle tube upstream end portion 2062. The nozzle 2008 is preferably made from a polymer-based material, and has resilient properties that tend to resist the compression of the tube 2060 due to the protrusion 2052 and bias the tube upstream end portion 2062 outwardly in directions 2074, 2076. This operation firmly engages the nozzle tube 2060 with the socket wall protrusion 2052, forms an interference fit between the socket 2006 and the nozzle 2008, and functions to form a seal between the nozzle tube 2060 and the protrusion 2052. Further, as the fluid pressure upstream of the nozzle 2008 increases (which increases pressure within a cavity 2081 of the tube 2060, as shown in FIG. 73), the tube 2060 presses outward in direction 2074, 2076 with greater force, which increases the sealing pressure.

Figure 74:
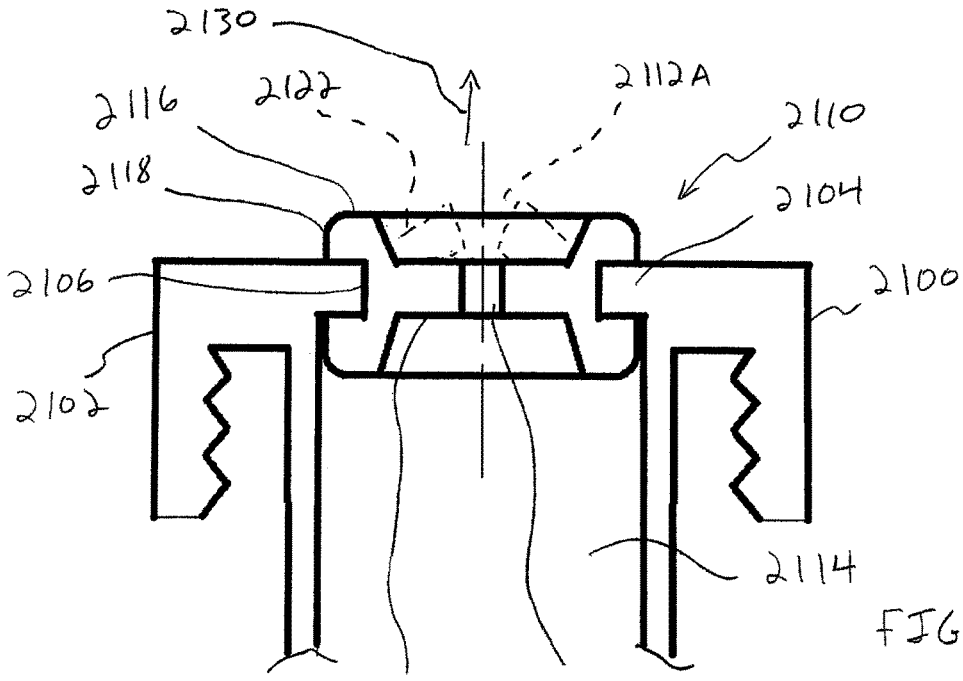
FIG. 74 is a schematic view of a nozzle having a flow controller.

With reference to FIG. 74, another nozzle 2100 is shown. The nozzle 2100 includes a flow controller 2110 having an opening 2112 with a diameter that changes in response to changes in fluid pressure within an upstream area 2114 of the nozzle 2100. The flow controller 2110 is configured to compensate for variation in supply line pressure by constricting the opening 2112 (at higher supply line pressure) or enlarging the opening 2112 (at lower supply line pressure)

which adjusts the volume flow rate of fluid striking the deflector 2002 and causes the deflector 2002 to rotate at a generally constant rotational velocity despite variation in the supply line pressure. In one approach, the supply line pressure varies within the range of fifteen pounds per square inch and fifty pounds per square inch during operation of the sprinkler 2000.

Specifically, the nozzle 2100 includes a cap 2102 with a rim 2104 and a grommet 2116 having an outer region 2118 engaged with the nozzle rim 2104. The grommet 2116 has an inner region 2120 with the opening 2112 formed therein. The grommet 2116 permits outward flexing of the inner region 2120 in response to pressure increases within the upstream area 2114. When the fluid pressure upstream of the nozzle 2008 increases, the increased fluid pressure causes the grommet inner region 2120 to bow downstream to a position 2122 generally as shown in dashed lines in FIG. 74. In the deflected position 2122, the inner region 2120 has an opening 2112A with a constriction having a smaller diameter than the opening 2112 when the grommet inner region 2120 is in the undeflected position shown in solid in FIG. 74. The constricted opening 2112A permits a reduced volume of fluid to exit the opening 2112 in direction 2130. This operation of the grommet 2116 functions to compensate for increases in supply line pressure by reducing the volume of fluid that strikes the associated deflector, such as deflector 2002. For example, if there is a spike in the upstream fluid pressure, the grommet 2116 responds by bowing downstream, which forms a constriction in the opening 2112 and the volume of water impacting the deflector 2002 such that the deflector 2002 continues to rotate at a generally constant speed despite the higher upstream water pressure. The grommet 2116 may be made of a flexible material, such as a silicone rubber having a durometer range of about 50 to about 70 Shore A.

Figure 75:
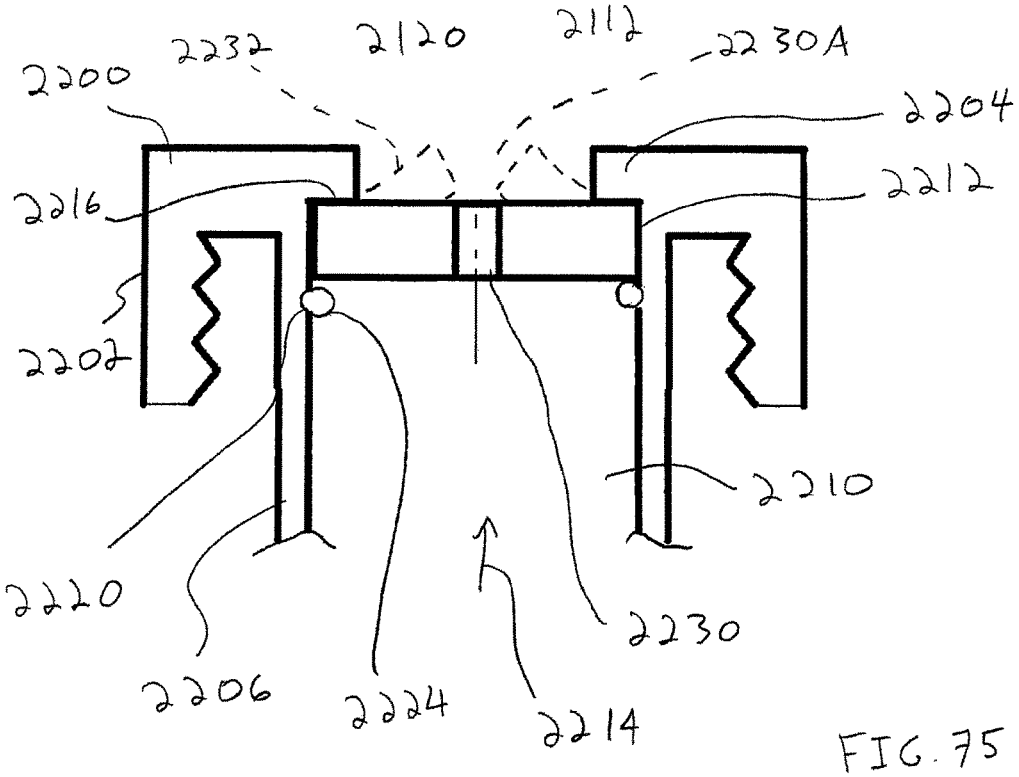
FIG. 75 is a schematic view of another nozzle having a flow controller.

Another nozzle 2200 is shown in FIG. 75. The nozzle 2200 includes a cap 2202 with a rim 2204 and a tube 2206 depending from the cap 2202. The nozzle tube 2206 has an upstream area 2210 sized to permit an elastomeric disc 2212 to be inserted in direction 2214 and seated against an underside 2216 of the rim 2204. The tube 2206 further includes an annular recess 2220 extending about the tube 2206 upstream of the elastomeric disc 2212 and a ring 2224 configured to snap into the tube recess 2220 and retain the elastomeric disc 2212 within the nozzle 2200. As shown in FIG. 75, the disc 2212 has an opening 2230 and the disc 2212 deflects to a position 2232 in response to increased fluid pressure in the upstream area 2210. In the deflected position 2232, the disc 2212 has an opening 2230A with a constriction having a smaller diameter than opening 2230 which reduces the flow rate through the disc 2212 in response to the increased supply line pressure upstream of the nozzle 2200.

While the foregoing description is with respect to specific examples, those skilled in the art will appreciate that there are numerous variations of the above that fall within the scope of the concepts described herein and the appended claims.

What is claimed is:

1. A sprinkler comprising:

a frame having an upper portion, a lower portion, and at least one support member connecting the upper and lower portions;

a rotatable deflector connected to the frame upper portion for directing fluid outwardly from the sprinkler;

a socket of the frame lower portion;

a nozzle configured to be releasably connected to the socket and having an outlet configured to direct fluid toward the deflector;

a skirt of the nozzle that extends about the socket with the nozzle connected to the socket;

at least one nozzle member of the nozzle extending toward the socket from the skirt;

at least one detent and at least one recess on upper and lower surfaces of the at least one nozzle member and the socket adapted to releasably couple the nozzle to the socket.

2. The sprinkler of claim 1 wherein the upper and lower surfaces include cam surface portions adapted to cammingly engage with turning of the nozzle in the socket and urge the nozzle downward in the socket.

3. The sprinkler of claim 1 wherein one of the upper and lower surfaces includes a stop surface portion adapted to limit turning of the nozzle in the socket beyond a predetermined position.

4. The sprinkler of claim 1 wherein the socket includes an annular wall and the at least one detent and the at least one recess includes a plurality of detents and recesses engaged at positions spaced around the circumference of the annular wall with the nozzle connected to the socket.

5. The sprinkler of claim 1 wherein the socket includes an opening sized to receive a portion of the nozzle and a wall extending about the opening, the socket further including a coupling member protruding from the wall with the coupling member including one of the upper and lower surfaces thereon.

6. The sprinkler of claim 1 wherein the socket includes an annular wall and the nozzle skirt has an annular shape concentric with the socket annular wall when the nozzle is connected to the socket.

7. The sprinkler of claim 1 further comprising a brake assembly releasably connecting the deflector to the frame upper portion.

8. The sprinkler of claim 7 wherein the frame upper portion includes an opening that receives at least a portion of the brake assembly, the frame upper portion opening being sized to permit the deflector to be advanced upwardly through the frame upper portion opening as the brake assembly is disconnected from the frame upper portion.

9. The sprinkler of claim 1 wherein the frame upper portion, lower portion, and at least one support member are integrally formed.

* * * * *